US009893475B2

(12) United States Patent
Toba et al.

(10) Patent No.: US 9,893,475 B2
(45) Date of Patent: Feb. 13, 2018

(54) CONNECTOR SYSTEM CAPABLE OF MITIGATING SIGNAL DETERIORATION

(71) Applicant: SONY CORPORATION, Tokyo (JP)

(72) Inventors: Kazuaki Toba, Kanagawa (JP); Taichi Hirano, Kanagawa (JP); Akira Matsuda, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/649,625

(22) PCT Filed: Nov. 19, 2013

(86) PCT No.: PCT/JP2013/081219

§ 371 (c)(1),
(2) Date: Jun. 4, 2015

(87) PCT Pub. No.: WO2014/103566

PCT Pub. Date: Jul. 3, 2014

(65) Prior Publication Data

US 2015/0333456 A1 Nov. 19, 2015

(30) Foreign Application Priority Data

Dec. 26, 2012 (JP) ..... 2012-283320

(51) Int. Cl.
*H01R 24/00* (2011.01)
*H01R 33/00* (2006.01)
(Continued)

(52) U.S. Cl.
CPC ..... *H01R 13/6691* (2013.01); *H01R 13/6471* (2013.01); *H01R 13/6585* (2013.01); *H01R 24/60* (2013.01)

(58) Field of Classification Search
CPC ..... H01R 23/02; H01R 24/60; H01R 24/62; H01R 13/652; H01R 13/648; H01R 13/6581
(Continued)

(56) References Cited

U.S. PATENT DOCUMENTS 6,875,031 B1 4/2005 Korsunsky
6,902,433 B1 * 6/2005 Hashimoto ..... H01R 23/6873 439/620.15
(Continued)

FOREIGN PATENT DOCUMENTS

CN 101350480 A 1/2009
EP 2017926 A 1/2009
(Continued)

OTHER PUBLICATIONS

European Extended Search Report Received for European Patent Application No. 13867006.2, dated Jun. 23, 2016, p. 11.
(Continued)

*Primary Examiner* — Hae Moon Hyeon
(74) *Attorney, Agent, or Firm* — Chip Law Group

(57) ABSTRACT

There is provided a connector including a signal pin that stretches in a first direction and transmits a signal, a substrate that has one surface on which the signal pin is formed, and an electric conductor layer that has ground potential, the electric conductor layer being formed on an opposite surface of the surface of the substrate on which the signal pin is formed.

18 Claims, 44 Drawing Sheets

(51) Int. Cl.
*H01R 13/66* (2006.01)
*H01R 13/6471* (2011.01)
*H01R 13/6585* (2011.01)
*H01R 24/60* (2011.01)

(58) Field of Classification Search
USPC ..... 439/660, 108, 607.01
See application file for complete search history.

(56) References Cited

U.S. PATENT DOCUMENTS 7,244,126 B2 * 7/2007 Morana ..... H01R 13/6658 439/76.1
7,267,579 B1 * 9/2007 Wu ..... H01R 13/6658 439/607.41
7,462,071 B1 * 12/2008 Wu ..... H01R 9/032 439/497
7,497,703 B2 * 3/2009 Fogg ..... H05K 1/0231 439/108
7,578,700 B2 * 8/2009 Xiong ..... H01R 13/65802 439/606
7,736,190 B2 * 6/2010 Yuan ..... H01R 4/02 439/516
8,011,950 B2 * 9/2011 McGrath ..... H01R 12/594 439/497
8,267,718 B2 * 9/2012 Straka ..... H01R 9/034 439/497
8,827,750 B2 * 9/2014 Chung ..... H01R 13/6461 439/660
8,979,576 B2 * 3/2015 Nonen ..... H01R 4/04 439/497
2009/0023338 A1 * 1/2009 He ..... H01R 43/24 439/607.01
2009/0318024 A1 * 12/2009 Wu ..... H01R 24/62 439/607.01
2011/0250791 A1 * 10/2011 Straka ..... H01R 9/034 439/607.09
2012/0122348 A1 * 5/2012 Cho ..... H01R 31/06 439/660
2014/0051288 A1 * 2/2014 Smink ..... H01R 13/6461 439/607.01

FOREIGN PATENT DOCUMENTS

EP 2373131 A 10/2011
FR 2900280 A 10/2007
JP 07-094244 A 4/1995
JP H07-094244 A 4/1995
JP 2000-242381 A 9/2000
JP 2001-291562 A 10/2001
JP 2005-174904 A 6/2005
JP 2009-026667 A 2/2009
JP 2009-129649 A 6/2009
JP 2011-216215 A 10/2011
JP 2012-089507 A 5/2012
JP 2012-124042 A 6/2012
JP 5161394 B1 3/2013

OTHER PUBLICATIONS

Office Action for CN Patent Application No. 201380066805.X, dated Dec. 1, 2016, 9 pages of Office Action and 13 pages of English Translation.

* cited by examiner

D–D

B–B

A-A

CONNECTOR SYSTEM CAPABLE OF MITIGATING SIGNAL DETERIORATION

TECHNICAL FIELD

The present disclosure relates to a connector, a data receiving apparatus, a data transmitting apparatus, and a data transmitting and receiving system.

BACKGROUND ART

As information-oriented society has developed in recent years, the amounts of information (amounts of data and amounts of signals) handled by information processing apparatuses such as personal computers (PCs) and servers have explosively increased. According to such increases in data amounts, the need to transfer more data at higher speeds in data transmission and reception performed between apparatuses has grown.

However, deterioration in signals is generally caused by increase in the data transmission amounts and increase in data transmission speed. Accordingly, a technology of increasing the data transmission amounts and reducing the deterioration in signals is being desired.

For example, Patent Literature 1 discloses a technology of reducing deterioration in signals by adjusting characteristic impedance of a connector mounting unit of a substrate to be connected with a connector applicable to a High-Definition Multimedia Interface (HDMI) (registered trademark) standard, according to change in thickness of the substrate, the connecter transmitting digital signals.

CITATION LIST

Patent Literature

Patent Literature 1: JP 2009-129649A

SUMMARY OF INVENTION

Technical Problem

However, the technology described in Patent Literature 1 is a technology of the receptacle-side connector mounting unit in an apparatus. In this technology, an existing technology of a receptacle side connector and plug-side connectors in a cable is used. Accordingly, in a case of trying to increase data transmission amounts more, the technology described in Patent Literature 1 is not sufficient as a measure to reduce the deterioration in signals.

Accordingly, the present disclosure proposes a novel and improved connector, data receiving apparatus, data transmitting apparatus, and data transmitting and receiving system that are capable of reducing deterioration in signals.

Solution to Problem

According to the present disclosure, there is provided a connector including a signal pin that stretches in a first direction and transmits a signal, a substrate that has one surface on which the signal pin is formed, and an electric conductor layer that has ground potential, the electric conductor layer being formed on an opposite surface of the surface of the substrate on which the signal pin is formed.

According to the present disclosure, there is provided a data transmitting apparatus including a connector including a signal pin that stretches in a first direction and transmits a signal, a substrate that is formed of a dielectric and has a surface on which the signal pin is formed, and an electric conductor layer that has ground potential, the electric conductor layer being formed on an opposite surface of the surface of the substrate on which the signal pin is formed. A signal is transmitted to any apparatus via the connector.

According to the present disclosure, there is provided a data receiving apparatus including a connector including a signal pin that stretches in a first direction and transmits a signal, a substrate that is formed of a dielectric and has a surface on which the signal pin is formed, and an electric conductor layer that has ground potential, the electric conductor layer being formed on an opposite surface of the surface of the substrate on which the signal pin is formed. A signal transmitted from any apparatus is received via the connector.

According to the present disclosure, there is provided a data transmitting and receiving system including a data transmitting apparatus that transmits a signal to any device via a connector including a signal pin that stretches in a first direction and transmits a signal, a substrate that is formed of a dielectric and has a surface on which the signal pin is formed, and an electric conductor layer that has ground potential, the electric conductor layer being formed on an opposite surface of the surface of the substrate on which the signal pin is formed, and a data receiving apparatus that receives a signal transmitted from any apparatus via the connector.

According to the present disclosure, the electric conductor layer, the substrate (dielectric layer), and the signal pin are stacked in this order, and thereby so-called microstripline is formed. Accordingly, it is possible to reduce effect of current (signal) flowing through a signal pin on another signal pin.

Advantageous Effects of Invention

As described above, according to the present disclosure, it is possible to reduce deterioration in a signal more.

DESCRIPTION OF EMBODIMENTS

Figure 1A:
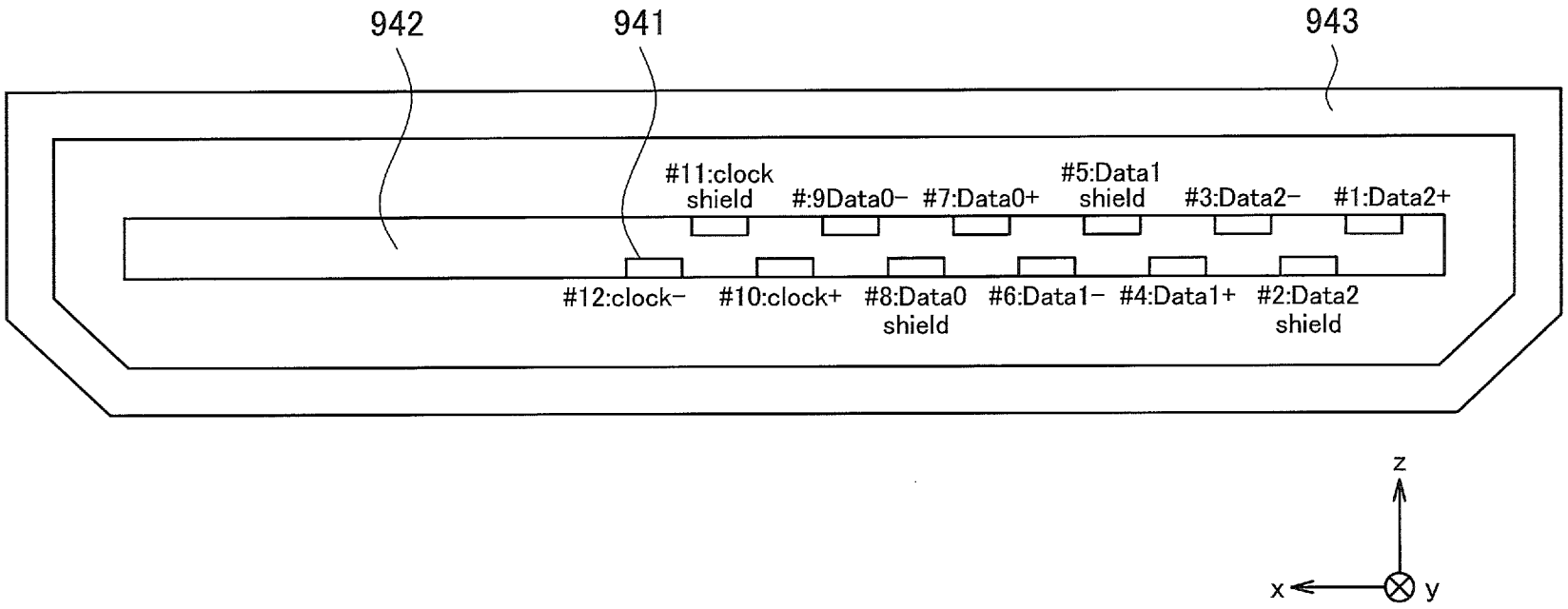
FIG. 1A is a schematic view showing pin arrangement for transmitting a high-speed differential signal in a general Type A HDMI connector or in a general Type D HDMI connector.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that, in the following explanation, a connector (hereinafter, referred to as an HDMI connector), a data receiving apparatus, a data transmitting apparatus, and a data transmitting and receiving system that are applicable to a High-Definition Multimedia Interface (HDMI) standard are used as an example of a connector, a data receiving apparatus, a data transmitting apparatus, and a data transmitting and receiving system according to an embodiment of the present disclosure. However, the present embodiment is not limited thereto, and can be applied to a connector, a data receiving apparatus, a data transmitting apparatus, and a data transmitting and receiving system that are based on another communication method or another communication standard.

In addition, the connector according to an embodiment of the present disclosure can be applied to any of plug-side connectors in a cable or receptacle-side connectors in a data receiving apparatus and a data transmitting apparatus. In the following explanation, the plug-side connectors in the cable are simply referred to as a "plug-side connectors", and the receptacle-side connectors in the data receiving apparatus and the data transmitting apparatus are simply referred to as "receptacle-side connectors." In addition, a "connector" simply means any of a plug-side connector and a receptacle-side connector unless particularly stated. Moreover, in the following explanation, the plug-side connector has a so-called male terminal shape, and the receptacle-side connector has a so-called female terminal shape. However, the present embodiment is not limited thereto. Relation between the terminal shape of the plug-side connector and the terminal shape of the receptacle-side connector may be reversed.

Note that the description is given in the following order.

1. Study on Increase in Transmission Data Amount
2. First Embodiment
2.1. Structural Example of General Type C Connector
2.2. Structural Example of Connector according to First Embodiment
2.3. Comparison of Characteristic
3. Second Embodiment
3.1. Structural Example of General Type D Connector
3.2. Structural Example of Connector according to Second Embodiment
3.3. Comparison of Characteristic
4. Modification
4.1. Expansion of Cross-sectional Area of Signal Pin
4.2. Mounting of Device on Substrate
5. Application Example
5.1. CEC Control
5.2. Power Supply Control
6. Conclusion

1. Study on Increase in Transmission Data Amount

In this section, a background led the present inventors to arrive at the present invention is first explained so as to clarify the present disclosure.

Recently, HDMI has been widespread as a communication interface for transmitting video signals (video data, audio data, or the like) between video devices at high speed. In communication based on the HDMI standard, a device that is a video signal source such as a disk reproduction apparatus is generally connected to a display device (monitor receiver, television receiver, or the like) via an HDMI cable. Note that, in the following explanation, a device for outputting signals such as a video signal is referred to as a source device, an output apparatus, a transmitting apparatus, or the like, and a device to which the signal such as the video signal is input is referred to as a sink device, an input apparatus, a receiving device, or the like.

Such as the disk reproduction apparatus and the display device, demand for consumer electrics (CEs) that can handle a video with higher-quality images and higher-quality sounds has been increasing. Thus, recently, transmission of larger amount of data has been desired with regard to the video signal such as video data and audio data, when the data is transmitted on the basis of the HDMI standard.

According to the HDMI standard, an HDMI connector has 19 pins. In a general HDMI connector, 12 of the pins are used for transmitting video signals, and the other pins are used for consumer electrics control (CEC), a power source, a hot plug detector (HPD), and the like. For details of the HDMI standard including pin arrangement in a general HDMI connector, "HDMI Specification Version 1.4" can be referred, for example.

Here, with reference to FIG. 1A, pin arrangement in a general Type A HDMI connector is explained. Note that, pin arrangement in a Type D HDMI connector is similar to the pin arrangement in the Type A HDMI connector.

FIG. 1A is a schematic view showing pin arrangement for transmitting a high-speed differential signal in a general Type A HDMI connector or in a general Type D HDMI connector. Note that, FIG. 1A shows only 12 signal pins relating to video signal transmission, and the other signal pins are not shown. In addition, FIG. 1A shows a terminal surface of a receptacle-side HDMI connector in an input apparatus.

With reference to FIG. 1A, signal pins 941 are arranged in two lines in zigzag on the terminal surface of the general Type A HDMI connector, the signal pins 941 being embedded in a dielectric 942 covered by an outer shell (shell) 943. To each of the signal pins 941, a different kind of signal is applied, and FIG. 1A shows the kinds of signals.

Specifically, "Data2+", "Data2 Shield", and "Data2−" are allocated to the signal pins #1, #2, and #3, respectively. In a similar way, "Data1+", "Data1 Shield", and "Data1−" are allocated to the signal pins #4, #5, and #6, respectively. In addition, in a similar way, "Data0+", "Data0 Shield", and "Data0−" are allocated to the signal pins #7, #8, and #9, respectively. In addition, "clock+", "clock Shield", and "clock−" are allocated to the signal pins #10, #11, and #12, respectively.

That is, each of the data lines (Data0/1/2) and the clock is constituted by three lines including differential lines Datai+, Datai−, and Datai Shield (i=0, 1, 2). When data is transmitted, the differential lines Datai+ and Datai− generates coupling between differential signals (differential coupling is generated). By using Data0/1/2, an HDMI source device transmits, to an HDMI sink device, each of digital video data sets (video data) of R (red), G (green), and B (blue) as serial data at maximum 3.425 Gbps, and pixel clock (maximum 340.25 MHz) that is 10-frequency division of the serial video data as clock.

Here, in the following description, coordinate axes are defined, and an explanation of the connector is provided. Specifically, a direction in which the signal pins are arranged on the terminal surface of the connector is defined as an x axis direction. A direction in which a pair of connectors fit with each other is defined as a y axis direction. A direction perpendicular to the x axis and the y axis is defined as a z axis direction, With regard to positive and negative directions of the x axis, a direction in which a signal pin number becomes larger (left in FIG. 1A) is defined as a positive direction of the x axis in conformity with the HDMI standard. With regard to positive and negative directions of the y axis, a direction from the plug-side connector to the receptacle-side connector (toward a plane of a paper of FIG. 1A in a direction perpendicular to the plane of the paper) is defined as a positive direction of the y axis. With regard to positive and negative directions of the z axis, an upper direction of FIG. 1A is defined as a positive direction of the z axis.

Here, as a way to transmit more video signals, change in allocation of signal pins can be considered. Specifically, in FIG. 1A, it can be considered that "Data2 Shield", "Data1 Shield", and "Data0 Shield" that are signal pins used as shields of differential line (differential data lane) pairs, and "clock+", "clock-", and "clock Shield" that are signal pins for transmitting clock signals are used as signal pins corresponding to new data lines.

Figure 1B:
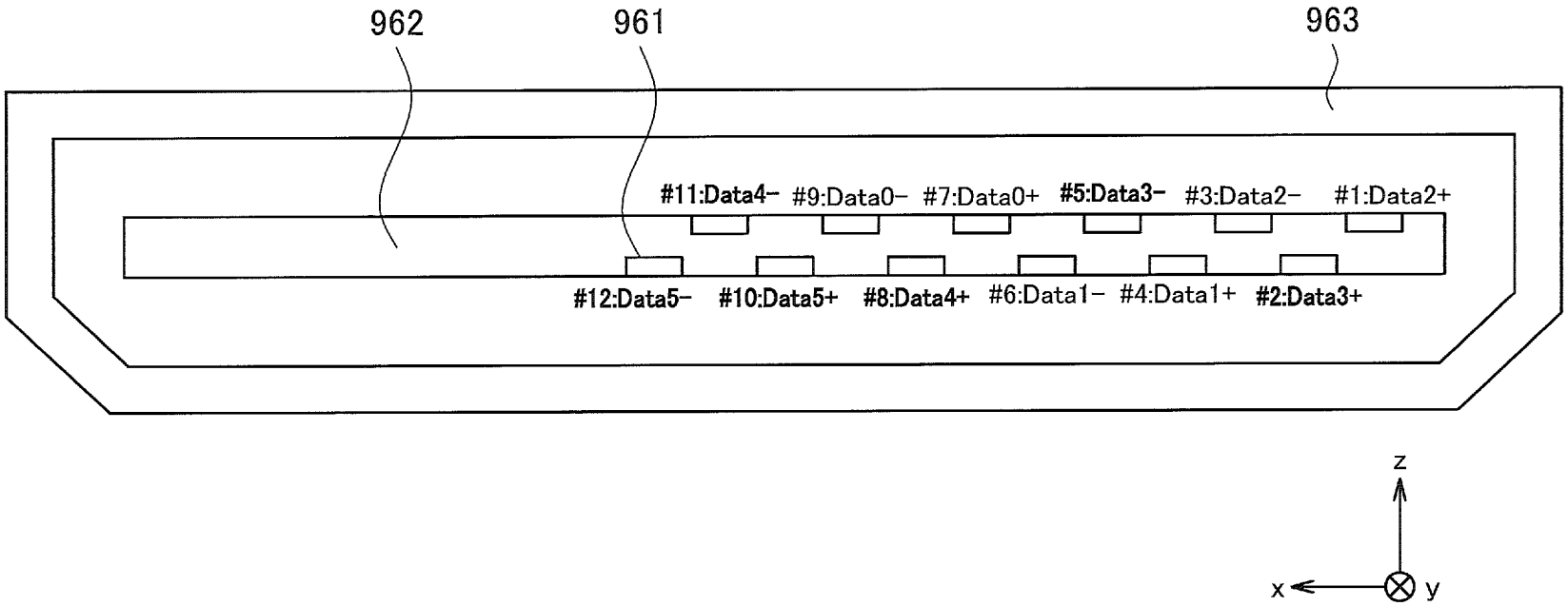
FIG. 1B is a schematic view showing an example of pin arrangement in which high-speed differential data lines are newly added in a Type A HDMI connector or in a Type D HDMI connector.

FIG. 1 B shows an example of such way to change allocation of signal pins. FIG. 1B is a schematic view showing an example of pin arrangement in which high-speed differential data lines are newly added in a Type A HDMI connector or in a Type D HDMI connector.

With reference to FIG. 1B, new differential line pairs "Data3+", "Data3−", "Data4+", and "Data4−" are respectively allocated to the signal pins #2, #5, #8, and #11 that are used as the shields in FIG. 1A. In addition, a new differential line pair "Data5+" and "Data5−" are respectively allocated to the signal pins #10 and #12 that are used as the clock in FIG. 1A.

A shield of a cable can be secured by connecting a drain wire of an STP cable to a shell part of the plug-side connector and by connecting and grounding shell parts of the receptacle-side connectors of the source device and the sink device, the drain wire being connected as a shield in the general signal pin arrangement as shown in FIG. 1A. With regard to the clock, the sink device extracts bit clock from data in an individual data lane, the frequency of the extracted bit clock is divided by 10, and the sink device generates pixel clock by itself.

As explained above, by expanding the number of the differential line pairs from three to six, the data transmission amounts can be doubled while keeping the transmission speed of the individual line the same. However, signals to be transmitted may deteriorate in the pin arrangement shown in FIG. 1B.

It is because, with regard to the new defined signal pins "Data3+", "Data3−", "Data4+", and "Data4−", physical distances between the differential lines to be paired are more separated than the initial differential line pairs, as shown in FIG. 1B. Accordingly, in the new defined signal pins, coupling is less likely to occur between differential signals, and impedance mismatches may occur.

Moreover, there is no line functioning as a shield between each of the differential line pairs. Accordingly, each of the differential line pairs is likely to be affected by crosstalk from adjacent lines, and it is highly possible that signals deteriorate.

As a measure against the deterioration in signals, for example, shapes of the signal pins and positions where the signal pins are disposed in the connector are improved so as to reduce the deterioration in the signals. Specifically, for example, wiring width of the signal pins is narrowed. Accordingly, intervals between the signal pins are relatively widened, and the crosstalk effect is reduced.

Alternatively, for example, the deterioration in the signals can be reduced by stretching the signal pins near a ground conductor that constitutes a periphery of the connector and by transmitting differential signals applied to the signal pins with single end.

Here, the HDMI connectors include different types of connectors from Type A to Type E. The Type C HDMI connector and the Type D HDMI connector are referred to as a mini-HDMI connector and a micro-HDMI connector, respectively. In addition, the Type C HDMI connector and the Type D HDMI connector are smaller than a standard Type A HDMI connector. For example, an area of a terminal surface of the Type A HDMI connector is set to be 14 mm×4.5 mm, an area of a terminal surface of the Type C HDMI connector is set to be 10.5 mm×2.5 mm, and an area of a terminal surface of the Type D HDMI connector is set to be 5.8 mm×2.0 mm.

Thus, the measure against the deterioration in signals is effective in a case where a size of a connector is comparatively large like the Type A HDMI connector and shapes of signal pins and signal pin arrangement can be freely changed. However, in a case where a size of a connector is comparatively small like the Type C HDMI connector or the Type D HDMI connector, shapes of signal pins and signal pin arrangement are less freely changed, and the measure may not be sufficiently effective for reducing the deterioration in signals.

As explained above, a conclusion of the study is that a way to change allocation of signal pins in an HDMI connector can be considered for increasing the data transmission amounts. However, signals may deteriorate due to increase in the number of data lines allocated to the signal pins. It is difficult for a relatively small HDMI connector such as the Type C HDMI connector or the Type D HDMI connector to achieve sufficient effect by the way to change shapes of the signal pins or signal pin arrangement position so as to reduce the deterioration in signals. Accordingly, a more versatile way to reduce deterioration in signals has been desired, the way being applicable to more diverse types of connectors.

On the basis of the above-described study, the present inventors have arrived at the connector, data receiving apparatus, data transmitting apparatus, and data transmitting and receiving system according to the present disclosure that are capable of reducing deterioration in signals. Next, preferred embodiments are explained.

2. First Embodiment

First, a structure of a connector according to a first embodiment of the present disclosure is explained. Note that, the connector according to the first embodiment corresponds to the Type C HDMI connector.

Figure 2A:
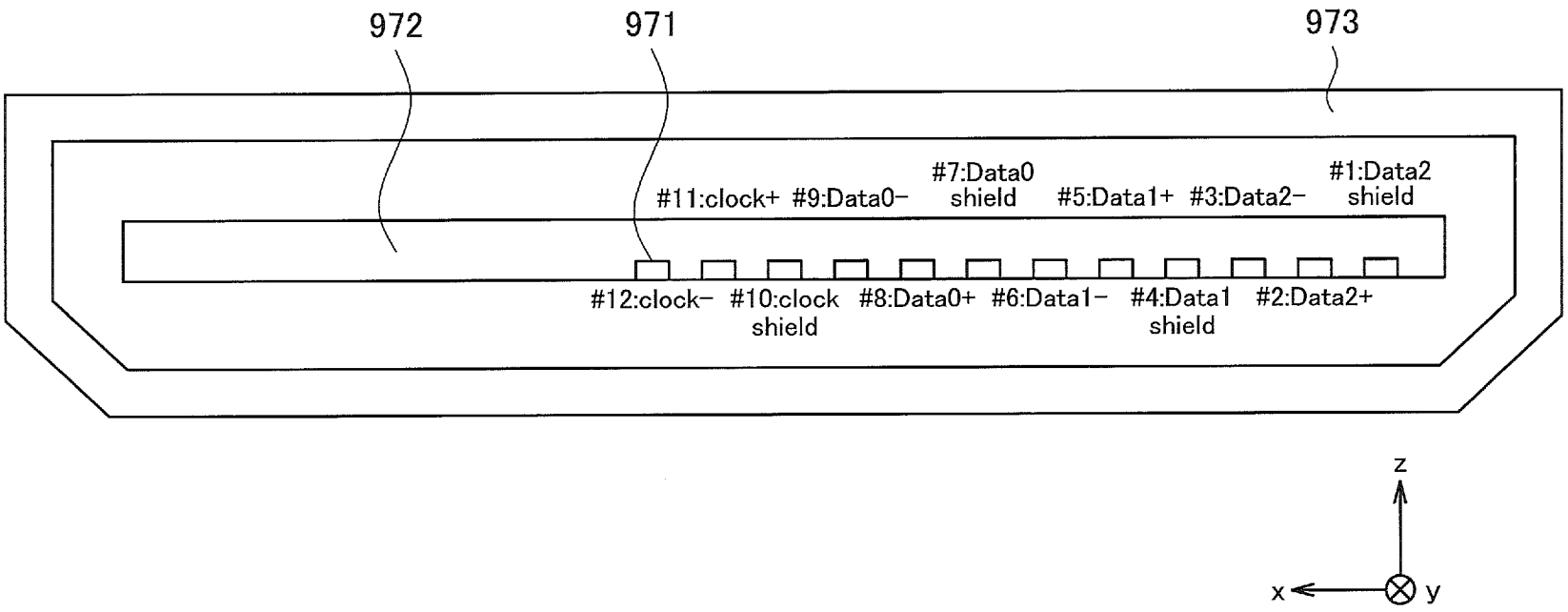
FIG. 2A is a schematic view showing pin arrangement for transmitting a high-speed differential signal in a general Type C HDMI connector.
Figure 2B:
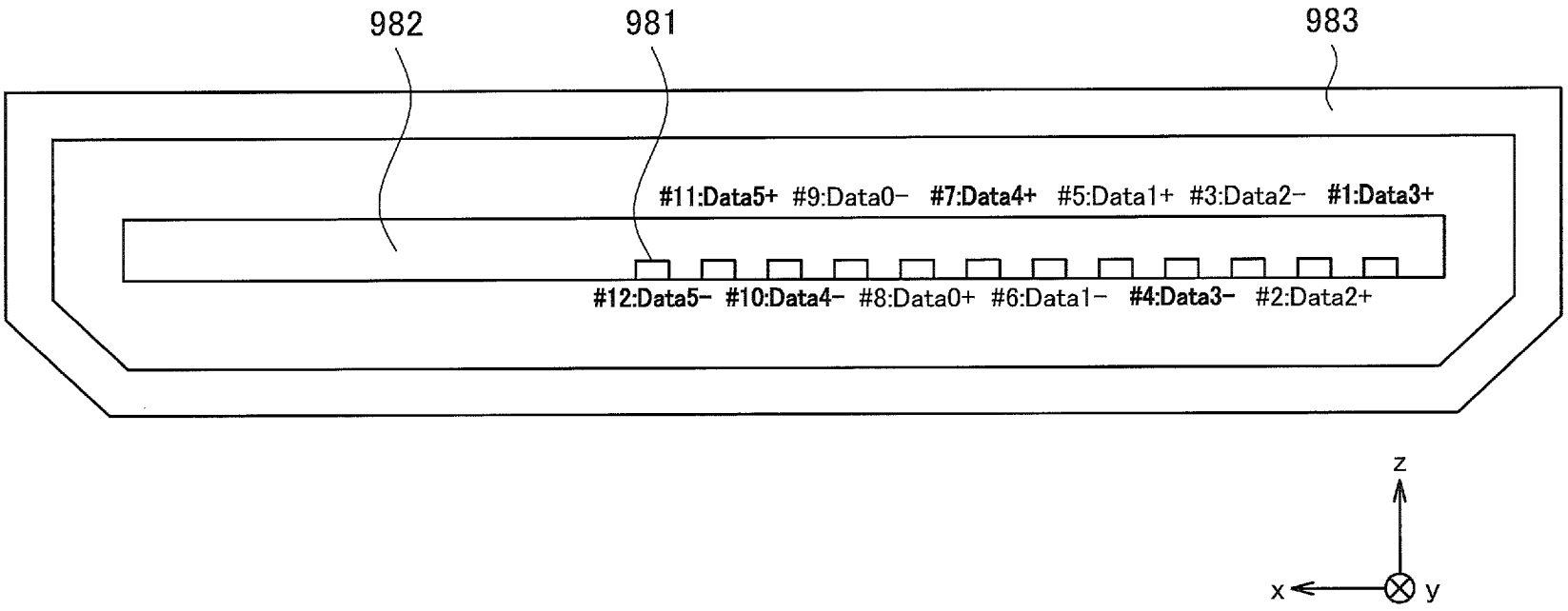
FIG. 2B is a schematic view showing an example of pin arrangement in which high-speed differential data lines are newly added in a Type C HDMI connector.

The Type C HDMI connector has different signal pin arrangement position on a terminal surface from that of the Type A HDMI connector shown in FIGS. 1A and 1B. Here, with reference to FIGS. 2A and 2B, pin arrangement in the Type C HDMI connector is explained. FIG. 2A is a schematic view showing pin arrangement for transmitting a high-speed differential signal in a general Type C HDMI connector. FIG. 2B is a schematic view showing an example of pin arrangement in which high-speed differential data lines are newly added in a Type C HDMI connector. Note that, FIGS. 2A and 2B show only signal pins relating to video signal transmission, and the other signal pins are not shown. In addition, FIGS. 2A and 2B show terminal surfaces of receptacle-side connectors.

In the following explanation about pin arrangement in the Type C HDMI connector, differences from the pin arrangement in the Type A HDMI connector that has been explained with reference to FIGS. 1A and 1B are mainly explained, and detailed explanations about overlapping configuration and function are omitted.

First, with reference to FIG. 2A, signal pins 971 are embedded in a dielectric 972 covered by an outer shell (shell) 973, in a terminal surface of the general Type C HDMI connector. However, in contrast to the pin arrangement in the general Type A HDMI connector shown in FIG. 1A, the signal pins 971 are arranged in a line on the terminal surface of the general Type C HDMI connector in an x axis direction. In addition, a different kind of signal is applied to each of the signal pins 971, and FIG. 2A shows the kinds of signals.

Specifically, "Data2 Shield", "Data2+", and "Data2−" are allocated to the signal pins #1, #2, and #3, respectively. In a similar way, "Data1 Shield", "Data1+", and "Data1−" are allocated to the signal pins #4, #5, and #6, respectively. In addition, in a similar way, "Data0 Shield", "Data0+", and "Data0−" are allocated to the signal pins #7, #8, and #9, respectively. In addition, "clock Shield", "clock+", and "clock−" are allocated to the signal pins #10, #11, and #12, respectively.

That is, each of the data lines (Data0/1/2) and the clock is constituted by three lines including differential lines Datai+, Datai−, and Datai Shield (i=0, 1, 2). When data is transmitted, the differential lines Datai+ and Datai− generates coupling between differential signals (differential coupling is generated). Note that, functions of the data lines (Data0/1/2) and the clock are similar to those in pin arrangement in the general Type A HDMI connector shown in FIG. 1A. Accordingly, detailed explanation is omitted here.

Next, with reference to FIG. 2B, the number of data lines allocated to the signal pins are increased in the pin arrangement in the connector according to the first embodiment of the present disclosure, in comparison with the pin arrangement in the general Type C HDMI connector shown in FIG. 2A.

Specifically, new differential line pairs "Data3+", "Data3−", "Data4+", and "Data4−" are respectively allocated to the signal pins #1, #4, #7, and #10 that are used as the shields in FIG. 2A. In addition, a new differential line pair "Data5+" and "Data5−" are respectively allocated to the signal pins #11 and #12 that are used as the clock in FIG. 2A. As explained above, by expanding the number of the differential line pairs from three to six, the data transmission amounts can be doubled while keeping the transmission speed of the individual line the same. Note that, the way to secure the shields in the cable and the way to generate the clock are similar to those of the general Type A HDMI connector explained with reference to FIG. 1B. Accordingly, detailed explanation is omitted here.

With reference to FIGS. 2A and 2B, pin arrangement in the Type C HDMI connector has been explained. Here, when the pin arrangement in which the data lines are newly added as shown in FIG. 2B is applied to the Type C HDMI connector having a general connector structure, deterioration in signals occurs like the Type A HDMI connector explained in <1. Study on Increase in Transmission Data Amount>. On the other hand, a connector structure (to be described later) according to the first embodiment of the present disclosure can reduce the deterioration in signals even in a case of pin arrangement in which data lines are newly added as shown in FIG. 2B.

In order to clearly explain the structure of the connector according to the first embodiment, a structural example of the general Type C HDMI connector is firstly explained in [2.1. Structural Example of General Type C Connector]. Next, in [2.2. Structural Example of Connector according to First Embodiment], a structural example of the connector according to the first embodiment of the present disclosure and differences in structure from the general Type C HDMI connector are explained. Subsequently, characteristics of signals transmitted in the both structures are compared in [2.3. Comparison of Characteristic], and effect to reduce deterioration in signals in the connector according to the first embodiment is explained.

[2.1. Structural Example of General Type C Connector]

Figure 3A:
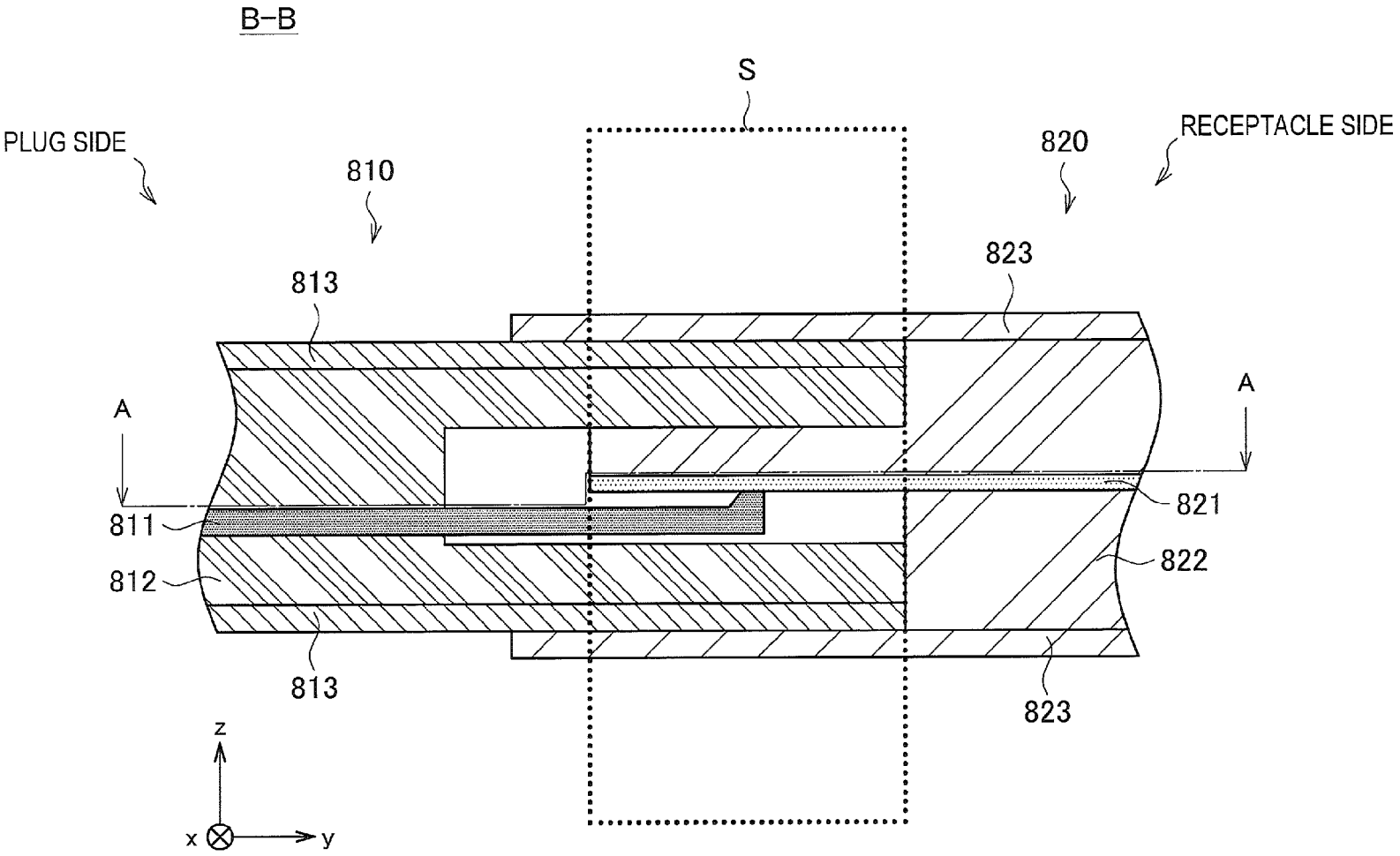
FIG. 3A is a cross-sectional view showing a structural example of general Type C HDMI connectors when being cut at a cross section constituted by a y axis and a z axis through signal pins.
Figure 3B:
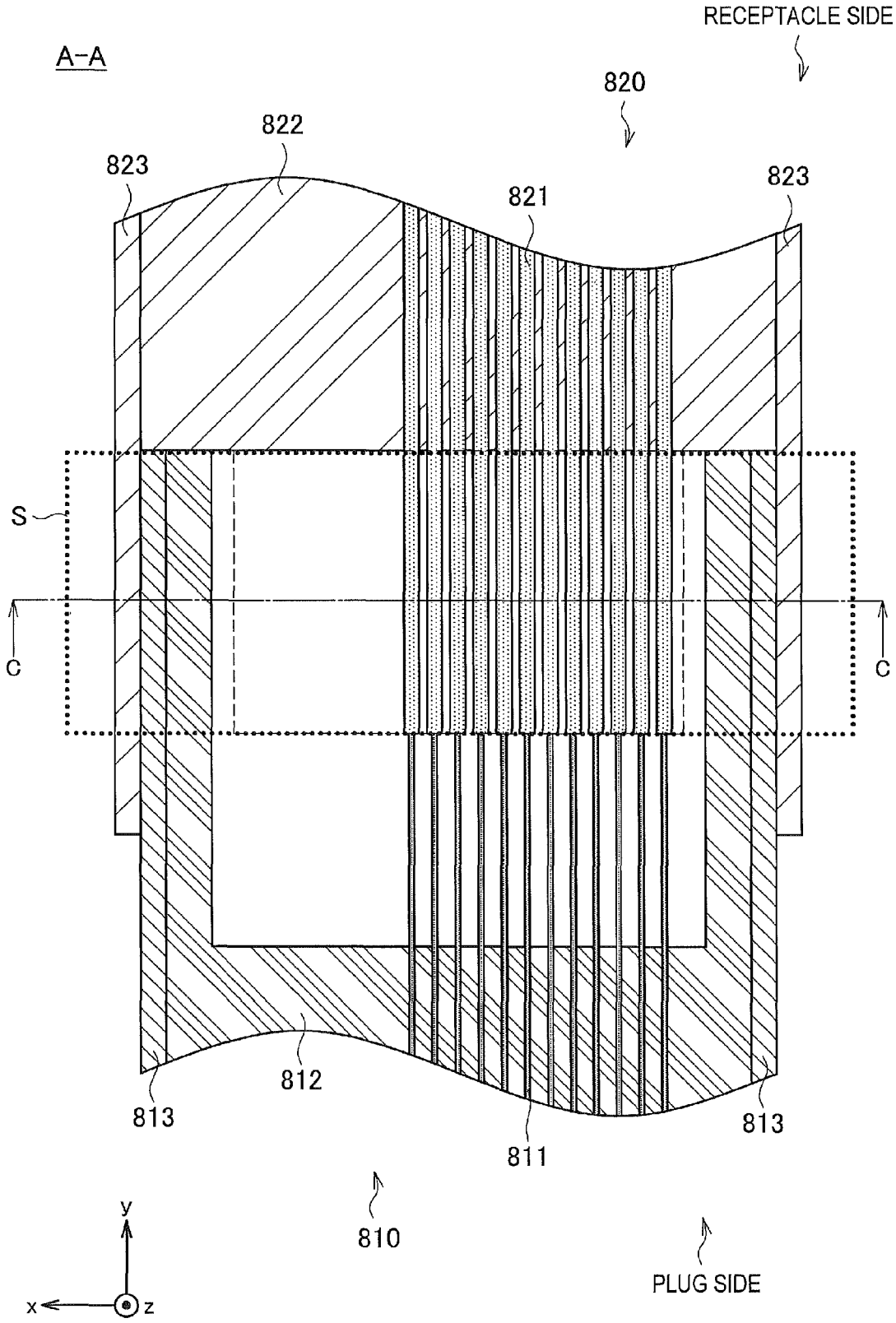
FIG. 3B is a cross-sectional view of the general Type C HDMI connectors corresponding to an A-A cross section in FIG. 3A, the A-A cross section being constituted by an x axis and the y axis.
Figure 3C:
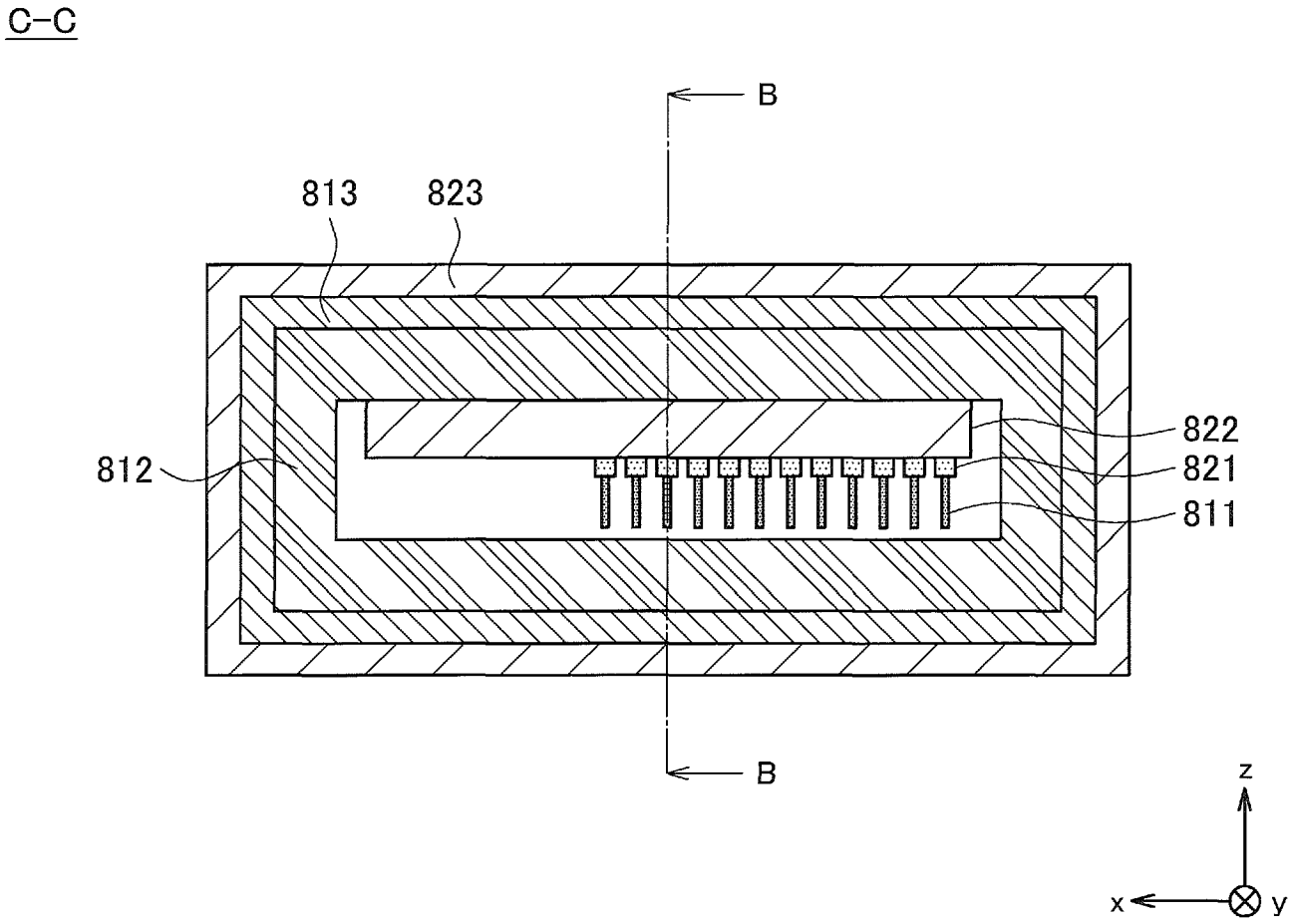
FIG. 3C is a cross-sectional view of the general Type C HDMI connectors corresponding to a C-C cross section in FIG. 3B, the C-C cross section being constituted by the x axis and the z axis.

First, with reference to FIGS. 3A to 3C, a structural example of the general Type C HDMI connectors is explained. FIG. 3A is a cross-sectional view showing a structural example of a general Type C HDMI connectors when being cut at a cross section constituted by a y axis and a z axis through signal pins. FIG. 3B is a cross-sectional view of the general Type C HDMI connectors corresponding to an A-A cross section in FIG. 3A, the A-A cross section being constituted by an x axis and the y axis. FIG. 3C is a cross-sectional view of the general Type C HDMI connectors corresponding to a C-C cross section in FIG. 3B, the C-C cross section being constituted by the x axis and the z axis. Note that, in FIGS. 3A to 3C, the plug-side connector and the receptacle-side connector are fitted with each other.

First, a structure of the plug-side connector is explained. With reference to FIGS. 3A to 3C, a plug-side connector 810 of the general Type C HDMI connector includes signal pins 811, a dielectric 812, and an outer shell (shell) 813. The signal pins 811 extend in the first direction, in other words, the y axis direction. Parts of the signal pins 811 are embedded in the dielectric 812.

The shell 813 covers the signal pins 811 and the dielectric 812. One surface of the shell 813 in the positive direction of the y axis is an open surface open to an outside. As shown in FIGS. 3A to 3C, the plug-side connector 810 and a receptacle-side connector 820 (to be described later) are connected via the open surface of the shell 813. In addition, the shell 813 is formed of an electric conductor. Potential of the shell 813 is fixed to, for example, the ground potential via the receptacle-side connector 820 (to be described later).

In a predetermined region near the open surface of the shell 813, tips of the signal pins 811 are exposed from the dielectric 812. The exposed part constitutes a protrusion protruded toward the open surface of the shell 813. When the plug-side connector 810 and the receptacle-side connector 820 (to be described later) are fitted with each other, the protrusion of the signal pins 811 contacts signal pins 821 of the receptacle side connector 820 (to be described later). Accordingly, the plug-side connector 810 and the receptacle-side connector 820 (to be described later) are electrically connected to each other. Note that, a contact part may be provided on a part of a region of the protrusion of the signal pins 811, the contact part further protruding toward the signal pins 821 of the receptacle-side connector 820. Thus, the signal pins 811 of the plug-side connector 810 and the signal pins 821 of the receptacle-side connector may contact to each other via the contact part.

Next, a structure of the receptacle-side connector is explained. With reference to FIGS. 3A to 3C, the receptacle-side connector 820 of the general Type C HDMI connector includes the signal pins 821, a dielectric 822, and an outer shell (shell) 823. The signal pins 821 extend in the first direction, in other words, the y axis direction. Parts of the signal pins 811 are embedded in the dielectric 822.

The shell 823 covers the signal pins 821 and the dielectric 822. One surface of the shell 823 in the negative direction of the y axis is an open surface open to an outside. In addition, the shell 823 is formed of an electric conductor. Potential of the shell 823 is fixed to, for example, the ground potential.

An area of an opening of the open surface of the shell 823 is slightly larger than the cross-sectional area of the open surface of the shell 813 of the plug-side connector 810. As shown in FIGS. 3A to 3C, an end provided with the open surface of the shell 813 of the plug-side connector 810 is inserted into the opening of the open surface of the shell 823 of the receptacle-side connector 820, and the plug-side connector 810 and the receptacle-side connector 820 are fitted with each other. Note that, a region indicated by a dotted line in FIGS. 3A and 3B represents a fitting part S of the plug-side connector 810 and the receptacle-side connector 820.

In a predetermined region near the open surface, the signal pins 821 include an exposed part in which parts of regions of surfaces of the signal pins 821 is exposed from the dielectric 822. When the plug-side connector 810 and the receptacle-side connector 820 are fitted with each other, the exposed part of the signal pins 821 contacts the protrusion (contact part) of the signal pins 811 of the plug-side connector 810.

With reference to FIGS. 3A to 3C, a structure of the general Type C HDMI connector has been explained.

[2.2. Structural Example of Connector According to First Embodiment]

Figure 4A:
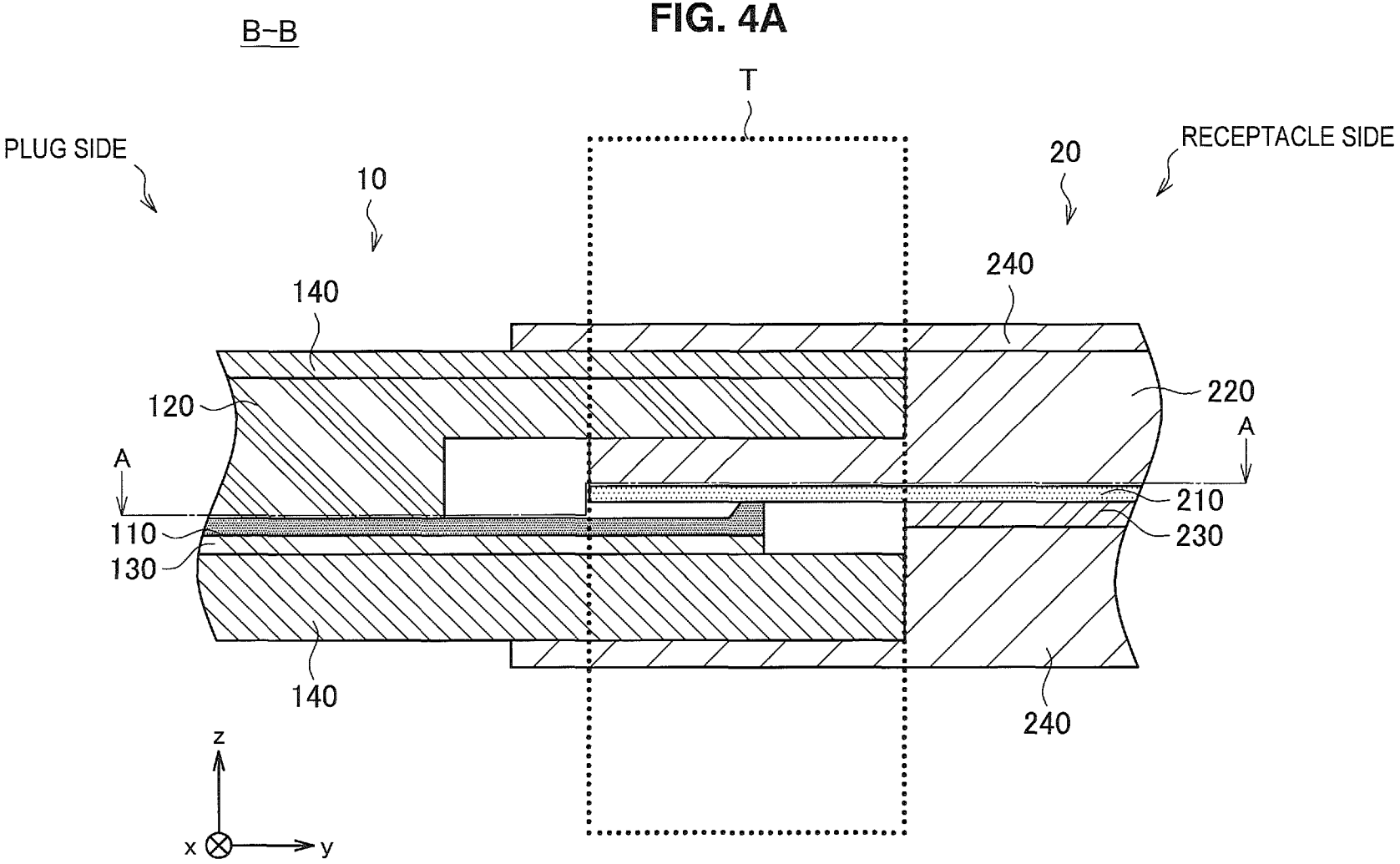
FIG. 4A is a cross-sectional view showing a structural example of connectors according to a first embodiment of the present disclosure when being cut at a cross section constituted by a y axis and a z axis through signal pins.
Figure 4B:
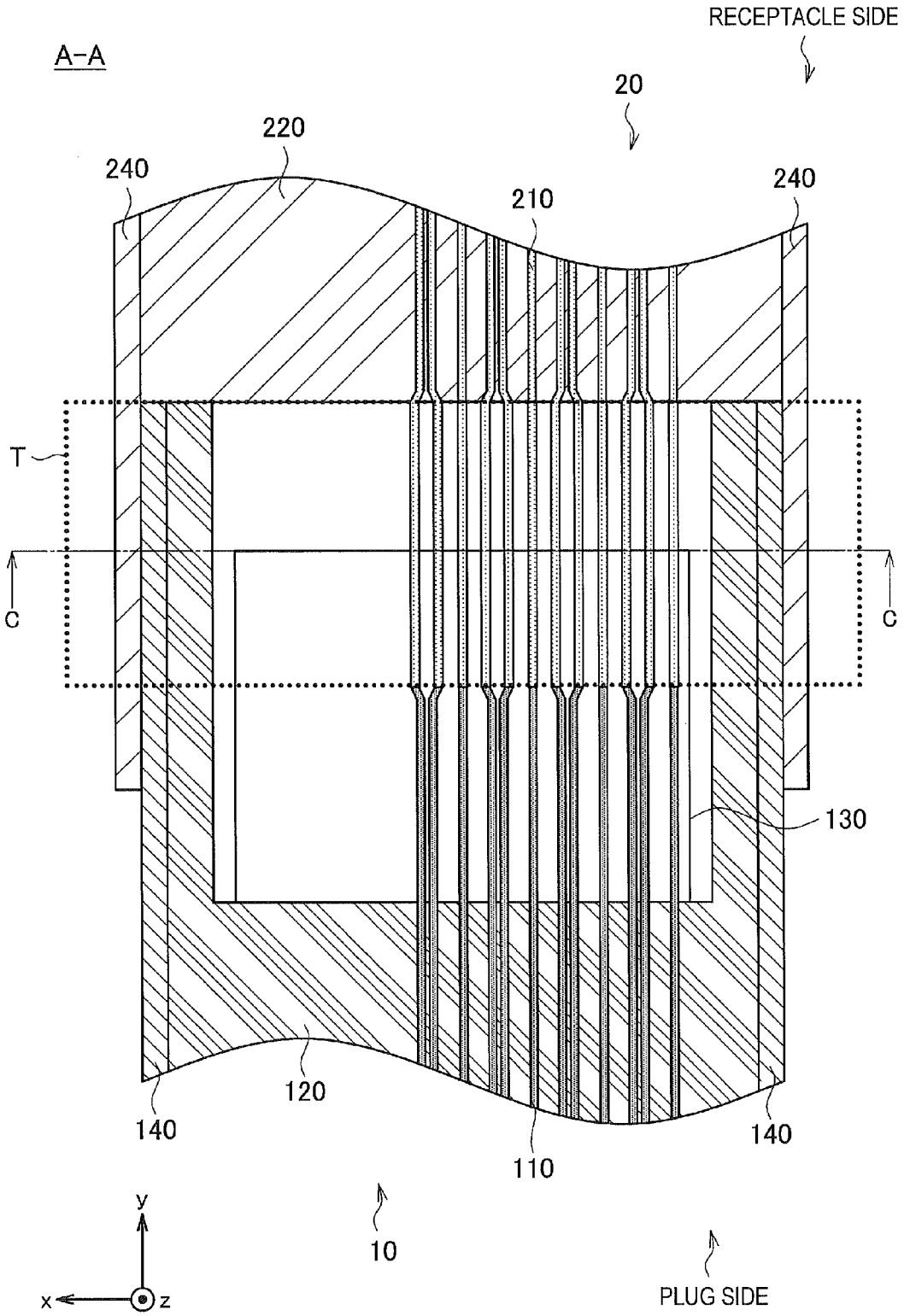
FIG. 4B is a cross-sectional view of the connectors according to the first embodiment corresponding to an A-A cross section in FIG. 4A, the A-A cross section being constituted by an x axis and the y axis.
Figure 4C:
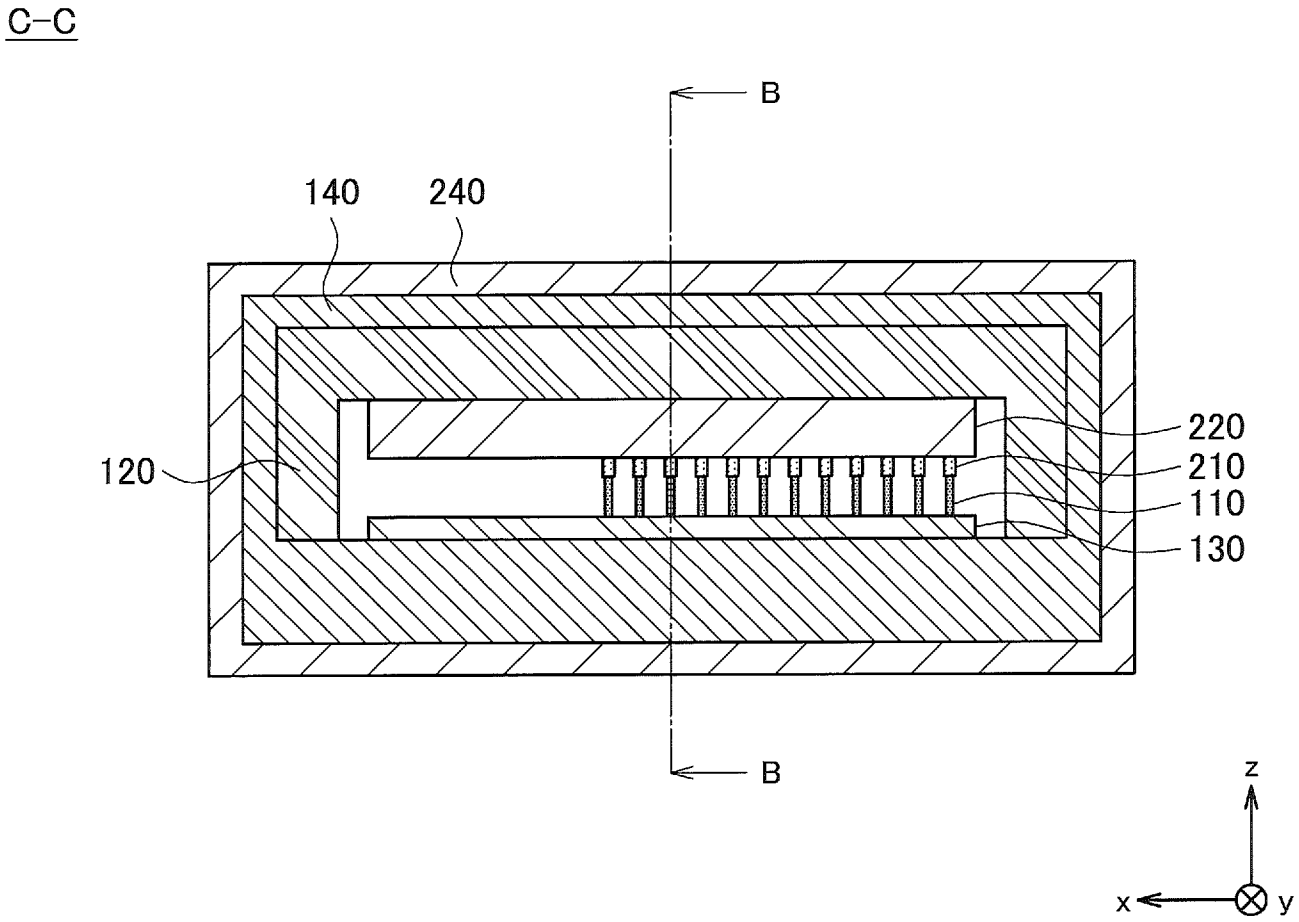
FIG. 4C is a cross-sectional view of the connectors according to the first embodiment corresponding to a C-C cross section in FIG. 4B, the C-C cross section being constituted by the x axis and the z axis.

Next, with reference to FIGS. 4A to 4C, a structural example of connectors according to the first embodiment of the present disclosure is explained. FIG. 4A is a cross-sectional view showing a structural example of connectors according to a first embodiment when being cut at a cross section constituted by a y axis and a z axis through signal pins. FIG. 4B is a cross-sectional view of the connectors according to the first embodiment corresponding to an A-A cross section in FIG. 4A, the A-A cross section being constituted by an x axis and the y axis. FIG. 4C is a cross-sectional view of the connectors according to the first embodiment corresponding to a C-C cross section in FIG. 4B, the C-C cross section being constituted by the x axis and the z axis. Note that, in FIGS. 4A to 4C, a plug-side connector and a receptacle-side connector are fitted with each other.

First, a structure of the plug-side connector is explained. With reference to FIGS. 4A to 4C, a plug-side connector 10 according to the first embodiment includes signal pins 110, a dielectric 120, a substrate 130, and an outer shell (shell) 140.

The signal pins 110 extend in a first direction, in other words, a y axis direction. In addition, the signal pins 110 are formed as a wiring pattern on a surface of the substrate 130 formed of dielectric.

The shell 140 covers the signal pins 110 and the substrate 130. One surface of the shell 140 in the positive direction of the y axis is an open surface open to an outside. As shown in FIGS. 4A to 4C, the plug-side connector 10 and a receptacle-side connector 20 (to be described later) are connected via the open surface of the shell 140. In addition, the shell 140 is formed of an electric conductor. Potential of the shell 140 is fixed to, for example, a ground potential via the receptacle-side connector 20 (to be described later).

An electric conductor layer having a ground potential is formed on a rear surface of the substrate 130, in other words, an opposite surface of a surface on which the signal pins 110 are formed. With reference to FIGS. 4A to 4C, according to the present embodiment, a surface of a shell 140 that faces the rear surface of the substrate is thicker than other surfaces, and is in contact with the rear surface of the substrate 130. Thus, the electric conductor layer formed on the rear surface of the substrate 130 is integrated with the shell 140. Note that, in the present embodiment, it is only necessary to form the electric conductor layer having a ground potential on the rear surface of the substrate 130. The structure of the electric conductor layer is not limited to the above example. Accordingly, the surface of the shell 140 is not necessarily thickened. For example, the electric conductor layer formed on the rear surface of the substrate 130 may be electrically connected to the shell 140 through a via hole or the like.

In addition, the dielectric may be stacked above (in positive direction of the z axis) the signal pins 110 formed on the substrate 130. Note that, when the dielectric 120 is formed, the dielectric 120 does not cover the entire surfaces of the signal pins 110, and parts of regions of the signal pins 110 are exposed in a predetermined region near the open surface of the shell 140. When the plug-side connector 10 and the receptacle-side connector 20 (to be described later) are fitted with each other, the exposed parts of the signal pins 110 of the plug-side connector contact signal pins 210 (wiring pattern) of the receptacle side connector 20. Accordingly, the plug-side connector 10 and the receptacle-side connector 20 (to be described later) are electrically connected to each other. Note that, contact parts may be provided on parts of regions of the exposed parts of the signal pins 110, the contact parts protruding toward the signal pins 210 of the receptacle-side connector 20. Thus, the signal pins 110 of the plug-side connector 10 and the signal pins 210 of the receptacle-side connector 20 may contact to each other via the contact parts.

Next, a structure of the receptacle-side connector is explained. With reference to FIGS. 4A to 4C, the receptacle-side connector 20 according to the first embodiment includes signal pins 210, a dielectric 220, a substrate 230, and an outer shell (shell) 240.

The signal pins 210 extend in a first direction, in other words, the y axis direction. In addition, the signal pins 210 are formed as a wiring pattern on a surface of the substrate 230 formed of dielectric.

The shell 240 covers the signal pins 210 and the substrate 230. One surface of the shell 240 in the negative direction of the y axis is an open surface open to an outside. In addition, the shell 240 is formed of an electric conductor. Potential of the shell 240 is fixed to, for example, a ground potential.

An area of an opening of the open surface of the shell 240 is slightly larger than the cross-sectional area of the open surface of the shell 140 of the plug-side connector 10. As shown in FIGS. 4A to 4C, an end provided with the open surface of the shell 140 of the plug-side connector 10 is inserted into the opening of the open surface of the shell 240 of the receptacle-side connector 20, and the plug-side connector 10 and the receptacle-side connector 20 are fitted with each other. Note that, regions indicated by dotted lines in FIGS. 4A and 4B represent a fitting part T of the plug-side connector 10 and the receptacle-side connector 20.

An electric conductor layer having a ground potential is formed on a rear surface of the substrate 230, in other words, an opposite surface of a surface on which the signal pins 210 are formed. With reference to FIGS. 4A to 4C, according to the present embodiment, a surface of a shell 240 that faces the rear surface of the substrate 230 is thicker than other surfaces, and is in contact with the rear surface of the substrate 230. Thus, the electric conductor layer formed on the rear surface of the substrate 230 is integrated with the shell 240. Note that, in the present embodiment, it is only necessary to form the electric conductor layer having a ground potential on the rear surface of the substrate 230. The structure of the electric conductor layer is not limited to the above example. Accordingly, the surface of the shell 240 is not necessarily thickened. For example, the electric conductor layer formed on the rear surface of the substrate 230 may be electrically connected to the shell 240 through a via hole or the like.

In addition, the dielectric 220 may be stacked above (in positive direction of the z axis) the signal pins 210 formed on the substrate 230. Note that, when the dielectric 220 is formed, parts of regions of the signal pins 210 are exposed in a predetermined region near the open surface of the shell 240. The exposed parts of the signal pins 210 of the receptacle-side connector 20 contact the exposed parts and/or the contact parts of the signal pins 110 (wiring pattern) of the receptacle side connector 10. Accordingly, the plug-side connector 10 and the receptacle-side connector 20 are electrically connected to each other.

With reference to FIG. 4B, among the signal pins 110 of the plug-side connector 10 and the signal pins 210 of the receptacle-side connector, intervals between pairs of the signal pins 110 and 210 that transmit differential signals and adjacently extend are shorter than intervals from other signal pins 110 and 210 adjacent to the pairs of the signal pins 110 and 210. Note that, the intervals of the signal pins 110 and the intervals of the signal pins 210 may be identical in the fitting part T. On the other hand, in a region other than the fitting part T, the intervals between the pairs of the signal pins 110 and 210 that transmit the differential signal and adjacently extend may be shorter than the intervals from other signal pins 110 and 210 adjacent to the pairs of the signal pins 110 and 210.

The wiring intervals between the signal pins 110 and the wiring intervals between the signal pins 210 in the fitting part T may be similar to the wiring intervals of the signal pins 811 and the wiring intervals of the signal pins 821 in the fitting part S shown in FIGS. 3A to 3C. Thus, the signal pins of the connector according to the first embodiment and the signal pins of the general Type C HDMI connector may have identical wiring intervals in the fitting parts.

As explained with reference to FIGS. 4A to 4C, the connector according to the first embodiment and the general Type C HDMI connector are different as follows: The connector according to the first embodiment are formed of the dielectric, and includes signal pins (wiring pattern corresponding to the signal pins) on one surface and the substrate, in which the electric conductor layer having the ground potential is formed, on the other surface. In addition, among the signal pins in the connector according to the first embodiment, the intervals between pairs of the signal pins that transmit the differential signals and adjacently extend are shorter than the intervals from other signal pins adjacent to the pairs of the signal pins. Next, effects of the connector according to the first embodiment achieved due to such configuration are explained.

As explained above, in the connectors 10 and 20 according to the first embodiment, signal pins 110 and 210 are formed on the substrates 130 and 230 formed of the dielectric, and the electric conductor layers having the ground potential are formed on the opposite sides of the surfaces of the substrates 130 and 230 on which the signal pins 110 and 210 are formed. Accordingly, the connectors according to the first embodiment have configurations in which ground planes (electric conductor layers), dielectric layers (substrate 130 and 230), and wiring (signal pins 110 and 210) are stacked in this order. According to such configurations, an electromagnetic field due to current (signal) flowing in the signal pins 110 and 210 is trapped between the substrates 130 and 230 and the electric conductors, and the so-called microstripline (microstrip structure) is formed. Thus, in the connector according to the first embodiment, it is possible to reduce effects of the current (signal) flowing through the signal pins 110 and 210 on other signal pins 110 and 210, and the deterioration in signals can be reduced.

In addition, as explained above, among the signal pins 110 and 210 in the connectors 10 and 20 according to the first embodiment, intervals between pairs of the signal pins 110 and 210 that transmit differential signals and adjacently extend may be shorter than intervals from other signal pins 110 and 210 adjacent to the pairs of the signal pins 110 and 210. Since the intervals between pairs of signal pins 110 and 210 that transmit differential signals to be paired are narrowed more, an electromagnetic field due to current (signal) flowing in the pairs of the signal pins 110 and 210 is trapped between the pairs of signal pins 110 and 210 and between the substrates 130 and 230 and the electric conductors, and so-called differential stripline (differential strip structure) is formed. Note that, a return path of the differential coupling is secured on the ground plane at a rear surface of the wiring surface. Accordingly, since the coupling is generated between the differential data lines, it is possible to narrow the wiring width and the wiring intervals between the signal pins, while the differential impedance is maintained. Thus, intervals from a different kind of adjacent signal wiring can be widened. Accordingly, the crosstalk can be reduced and signal quality can be improved. Thus, in the connectors according to the first embodiment, it is possible to further reduce effects of the current (signal) flowing through the pair of the signal pins 110 and 210 that transmit a differential signal, on other signal pins 110 and 210. In addition, the deterioration in signals can be reduced more.

Note that, in a case where the pin arrangement shown in FIG. 2B in which the data lines are newly added is applied to the connector according to the first embodiment, signal pins to which a pair of differential signals "Data3+" and "Data3−", and a pair of differential signals "Data4+" and "Data4−" are allocated are not arranged at positions where the pairs of the differential signals are next to each other, from among the newly added pairs of the differential signals. Thus, in the connector according to the first embodiment, pairs of adjacent signal pins to which a "Data0" and "Data0−" pair, a "Data1+" and "Data1−" pair, a "Data2+" and "Data2−" pair, and a "Data5+" and "Data5−" pair are applied transmit signals using the differential striplines. On the other hand, pairs of nonadjacent signal pins to which a "Data3+" and "Data3−" pair and a "Data4+" and "Data4−" pair are applied transmit signals using single-ended microstriplines.

In addition, as explained above, the connector according to the first embodiment of the present disclosure can be more effective in the case of the pin arrangement as shown in FIG. 2B in which the data lines are newly added. However, the connector according to the first embodiment also can be applied to the general pin arrangement as shown in FIG. 2A. Even if the connector according to the first embodiment of the present disclosure is applied to the general pin arrangement shown in FIG. 2A, effects of current (signals) flowing through the signal pins 110 and 210 on other signals 110 and 210 and deterioration in the signals can be reduced by forming a microstripline and a differential stripline with regard to each signal pin.

Note that, as explained with reference to FIG. 4B, the intervals between the signal pins 110 and the intervals between the signal pins 210 in the fitting part T of the connectors according to the first embodiment of the present disclosure may be identical to the intervals between the signal pins 811 and the intervals between the signal pins 821 in the fitting part S of the general Type C HDMI connectors. According to such configuration, it is possible to ensure compatibility between the connector according to the first embodiment and the general Type C HDMI connector. Thus, when the connector according to the first embodiment and the general Type C HDMI connector are fitted with each other, predetermined signal pins defined by the HDMI standard are electrically connected. Accordingly, the connector according to the first embodiment also can be applied to a case where signals transmission corresponding to the general pin arrangement shown in FIG. 2A are performed.

Figure 5:
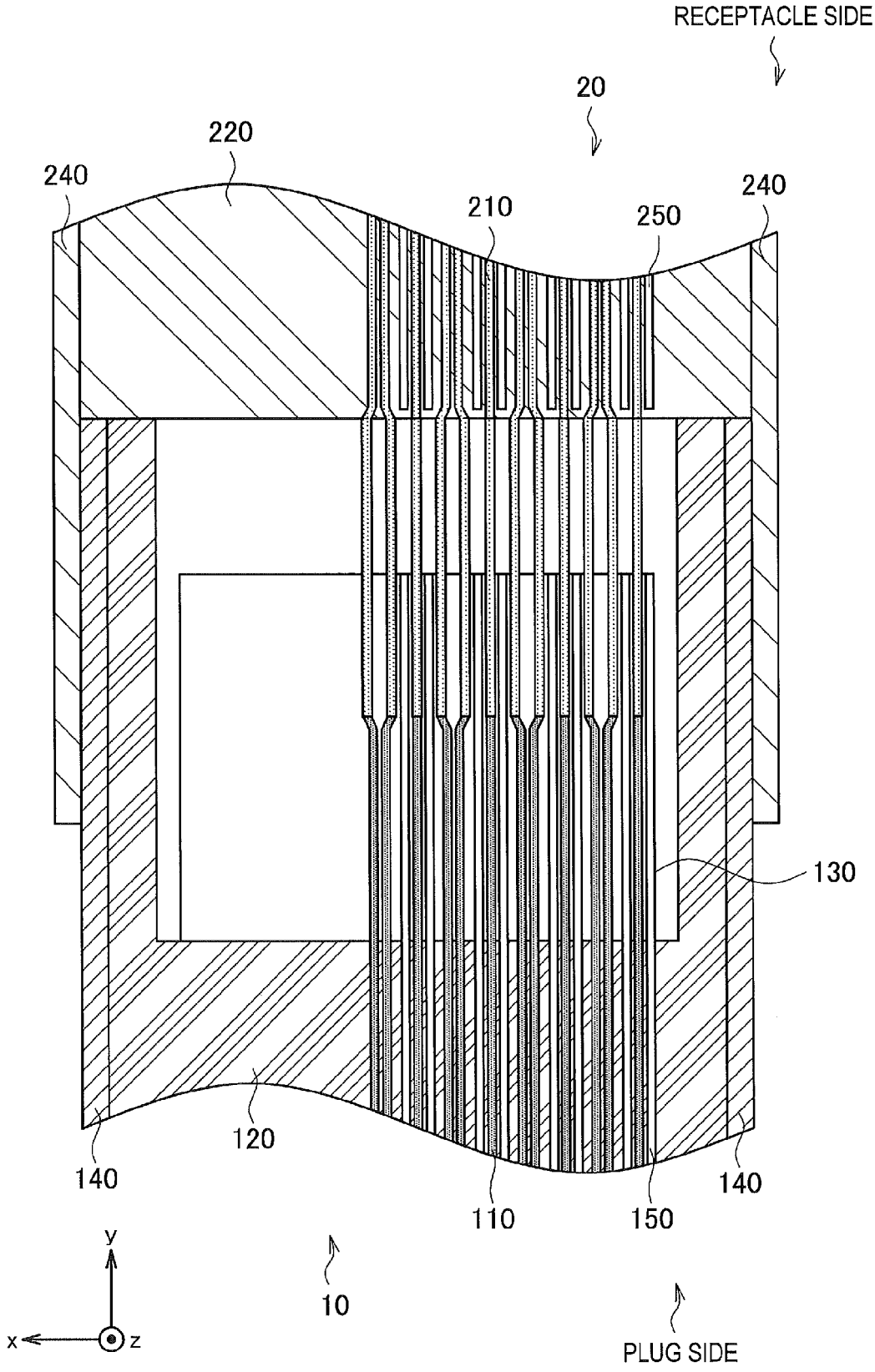
FIG. 5 is an explanatory diagram illustrating a configuration in which guard lines are disposed.

Here, with reference to FIG. 5, a modification of connectors according to the first embodiment of the present disclosure is explained. In the connector according to the first embodiment of the present disclosure, guard lines having ground potential may further extend at positions for sandwiching a signal pin in a manner that the guard lines are substantially parallel to the signal pin. In addition, the guard lines may be disposed so as to sandwich a signal pin that transmits a signal with single end. FIG. 5 is an explanatory diagram illustrating a configuration in which guard lines are disposed.

FIG. 5 shows a configuration in which guard lines are newly disposed in the connectors according to the first embodiment shown in FIG. 4B. Thus, FIG. 5 shows the configuration in which guard lines are provided in the connector according to the first embodiment when viewed from the positive direction of the z axis. With reference to FIG. 5, for example, guard lines 150 are disposed so as to sandwich a signal pin 110 that transmits a signal by single coupling in a plug-side connector 10. For example, in a similar way, guard lines 250 are disposed so as to sandwich a signal pin 210 that transmits a signal with single end in a receptacle-side connector 20. Potential of the guard lines 150 and 250 are set to the ground potential. Since the guard lines 150 and 250 are provided, it is possible to reduce effects of the current (signal) flowing through the signal pins 110 and 210 on other signal pins 110 and 210, and the deterioration in signals can be reduced.

[2.3. Comparison of Characteristic]

Next, a result of comparison between a characteristic of a signal flowing a signal pin in the general Type C HDMI connector structure shown in FIGS. 3A to 3C and a characteristic of a signal flowing a signal pin in the connector structure according to the first embodiment of the present disclosure shown in FIGS. 4A to 4C is explained. Note that, the following FIGS. 6A to 6B, FIGS. 7A to 7B, FIGS. 8A to 8B, and FIGS. 9A to 9E each show a result of flowing a signal corresponding to pin arrangement in which data lines are newly added as shown in FIG. 2B.

First, with reference to FIGS. 6A to 6B and FIGS. 7A to 7B, difference in electric field distribution near signal pins between the general Type C HDMI connector and the connector according to the first embodiment is explained.

Figure 6A:
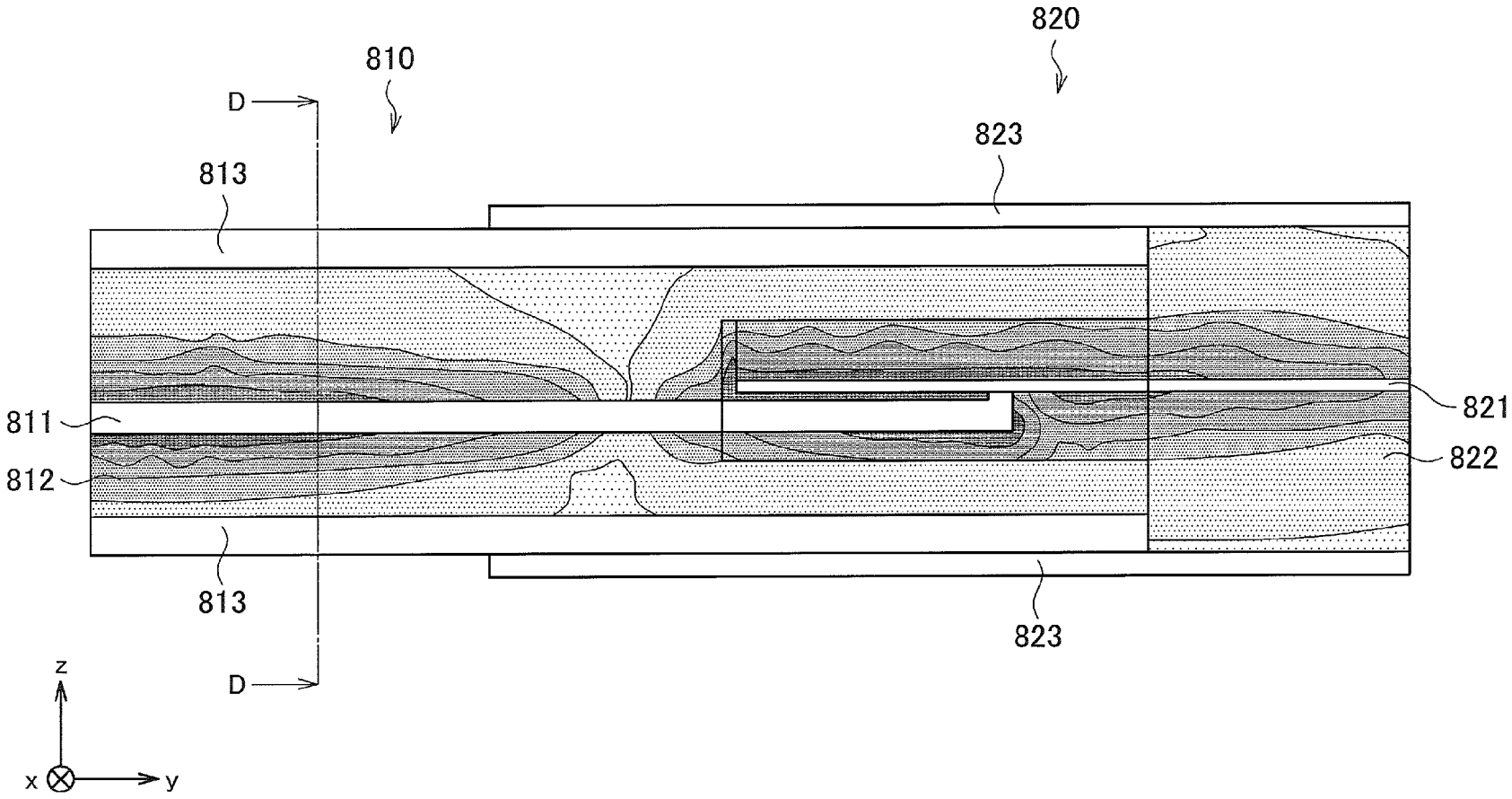
FIG. 6A is a contour map of an electric field showing electric field distribution in a general Type C HDMI connector structure.
Figure 6B:
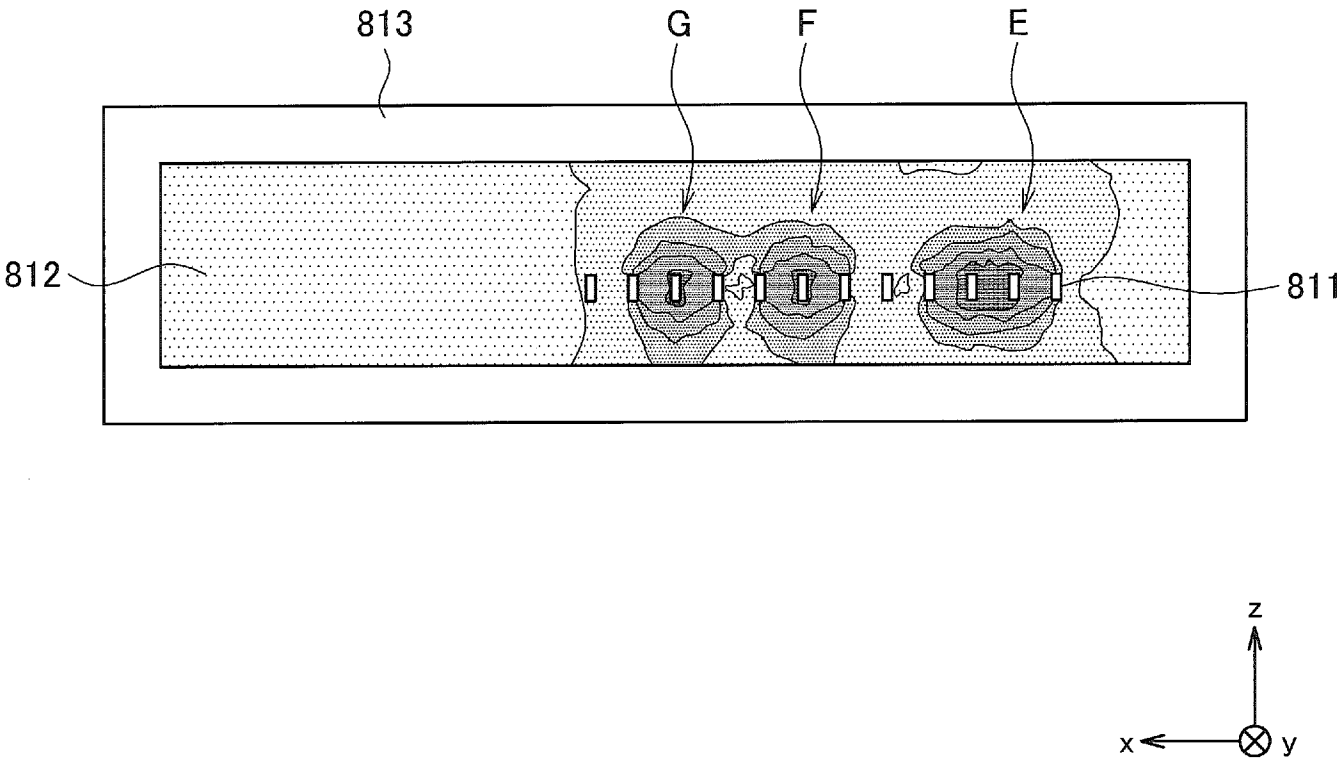
FIG. 6B is a contour map of an electric field showing electric field distribution in the general Type C HDMI connector structure.
Figure 7A:
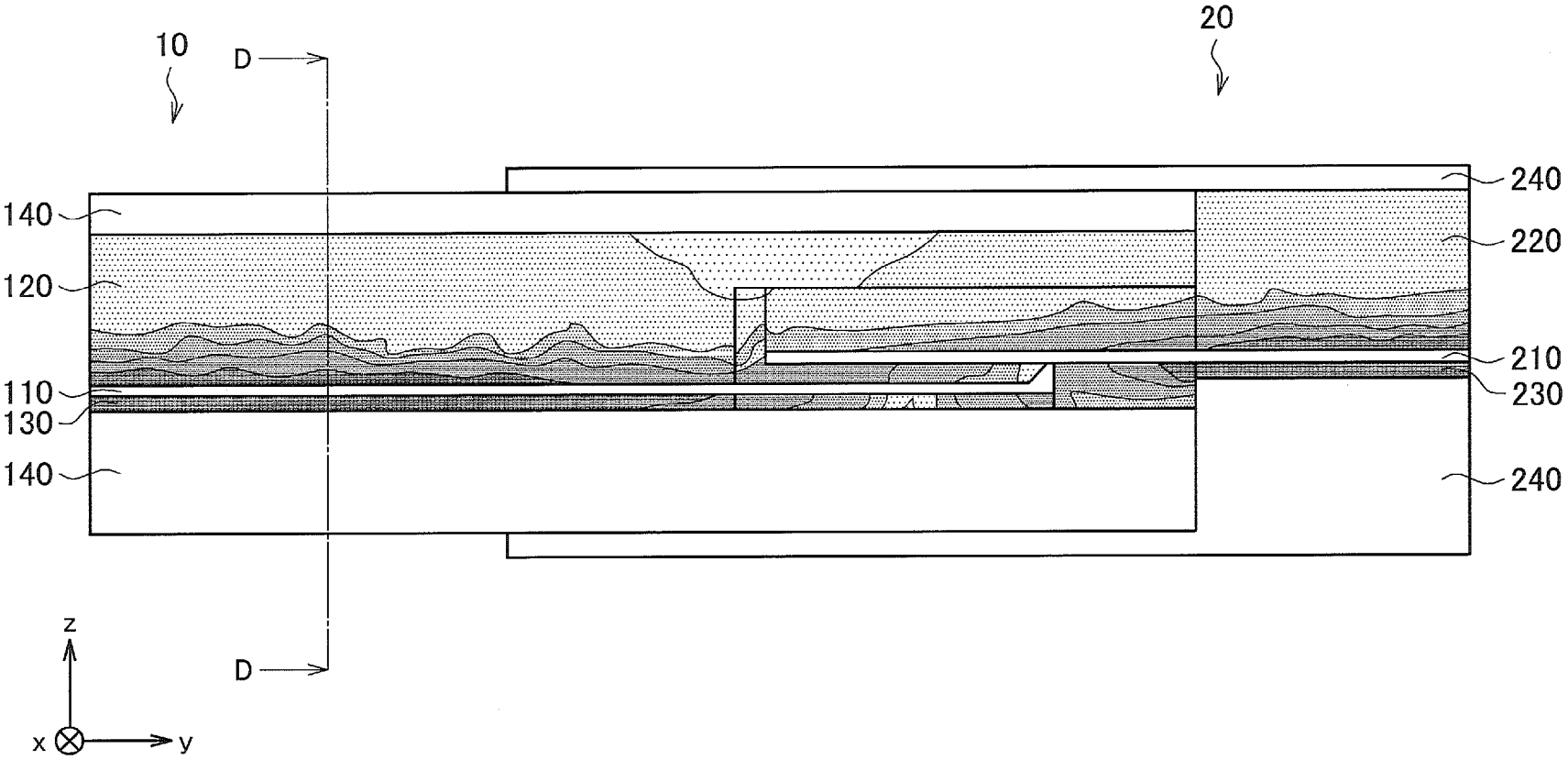
FIG. 7A is a contour map of an electric field showing electric field distribution in a connector structure according to the first embodiment.
Figure 7B:
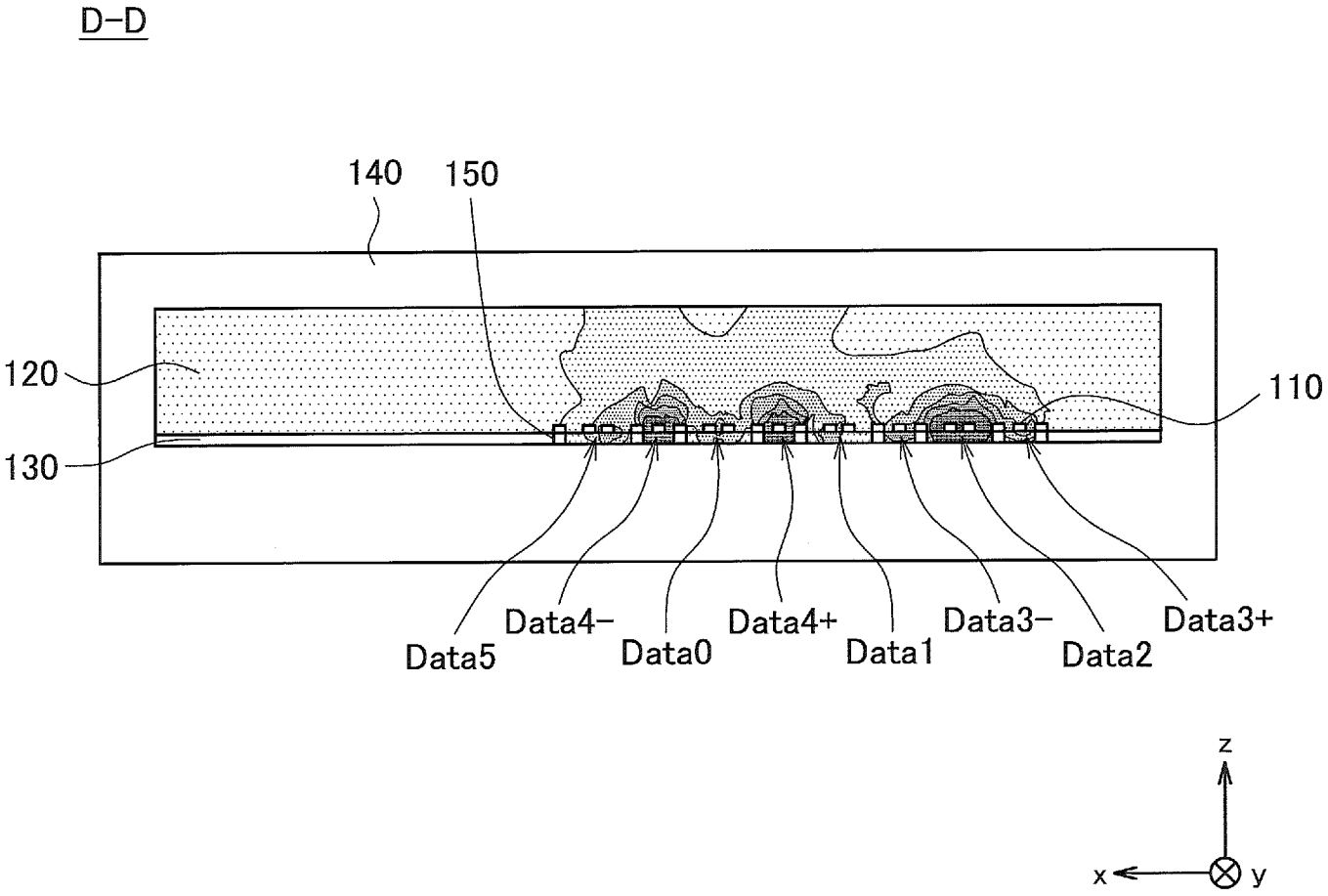
FIG. 7B is a contour map of an electric field showing electric field distribution in the connector structure according to the first embodiment.

FIGS. 6A to 6B and FIGS. 7A to 7B each show electric field distribution near signal pins in a case where a predetermined signal for transmitting a video signal decided by the HDMI standard is applied to each connector. FIGS. 6A and 6B are each a contour map of an electric field showing electric field distribution in the general Type C HDMI connector structure. FIGS. 7A and 7B are each a contour map of an electric field showing electric field distribution in the connector structure according to the first embodiment. In FIGS. 6A to 6B and FIGS. 7A to 7B, strength of the electric field distribution is schematically represented by shades of hatching. A dark hatched region represents a region in which the electric field is concentrated.

FIG. 6A is a contour map of an electric field at a cross-section corresponding to FIG. 3A, in the general Type C HDMI connector structure. FIG. 6B is a contour map of an electric field at a D-D cross-section shown in FIG. 6A.

FIG. 7A is a contour map of an electric field at a cross-section corresponding to FIG. 4A, in the connector structure according to the first embodiment. FIG. 7B is a contour map of an electric field at a D-D cross-section shown in FIG. 7A. Note that, the contour maps of the electric field shown in FIGS. 7A and 7B determine the electric field distribution of the connector structure according to the first embodiment in which the guard lines are further provided as shown in FIG. 5.

The contour maps of the electric fields in FIGS. 6A to 6B and FIGS. 7A to 7B each show a simulation result of an electric field distribution near the signal pins in a case where a model in which permittivity corresponding to each region (signal pin, substrate, outer shell, dielectric, or the like) at each cross-section described above is set is formed, and a predetermined signal when a video signal decided by the HDMI standard is transmitted is applied.

With reference to FIG. 6A, in the general Type C HDMI connector structure, there is few difference in the electric field distribution between a front surface (surface that stretches in the y axis direction and that is positioned in the positive direction of the z axis) and a rear surface (surface that stretches in the y axis direction and that is positioned in the negative direction of the z axis) of each of the signal pins 811 and 821. On the other hand, with reference to FIG. 6B, in the general Type C HDMI connector structure, electric field is concentrated and coupling occurs between a part of the signal pins 110 as shown in a region E for example. However, in a region F (region across "Data0−", "Data4−", and "Data5+") and a region G (region across "Data1−", "Data4+", and "Data0+"), electric fields are also concentrated in regions other than a differential signal pair, and current (signal) flowing through signal pins 811 affects other signal pins 811.

On the other hand, with reference to FIG. 7A, in the connector structure according to the first embodiment, electric field is concentrated between the signal pins 110 and 210 and the substrates 130 and 230, and the so-called microstripline is formed. In addition, with reference to FIG. 7B, in the connector structure according to the first embodiment, electric fields are concentrated between the adjacently disposed pairs of signal pins 110 and 210 "Data0", "Data1", "Data2", and "Data5", and the so-called differential striplines are formed. With regard to the signal pins 110 and 210 "Data3−

", "Data3+", "Data4−", and "Data4+", electric fields are concentrated in the substrate between the signal pins 110 and 210 and a GND conductor (shell 140), and a single-ended electric field is formed. Accordingly, effects of current (signal) flowing through signal pins 110 and 210 on other signal pins 110 and 210 are reduced.

Next, with reference to FIGS. 8A to 8B and FIGS. 9A to 9E, difference in signal transmission characteristics as represented by an eye pattern and crosstalk, between the general Type C HDMI connector and the connector according to the first embodiment is explained.

Figure 8A:
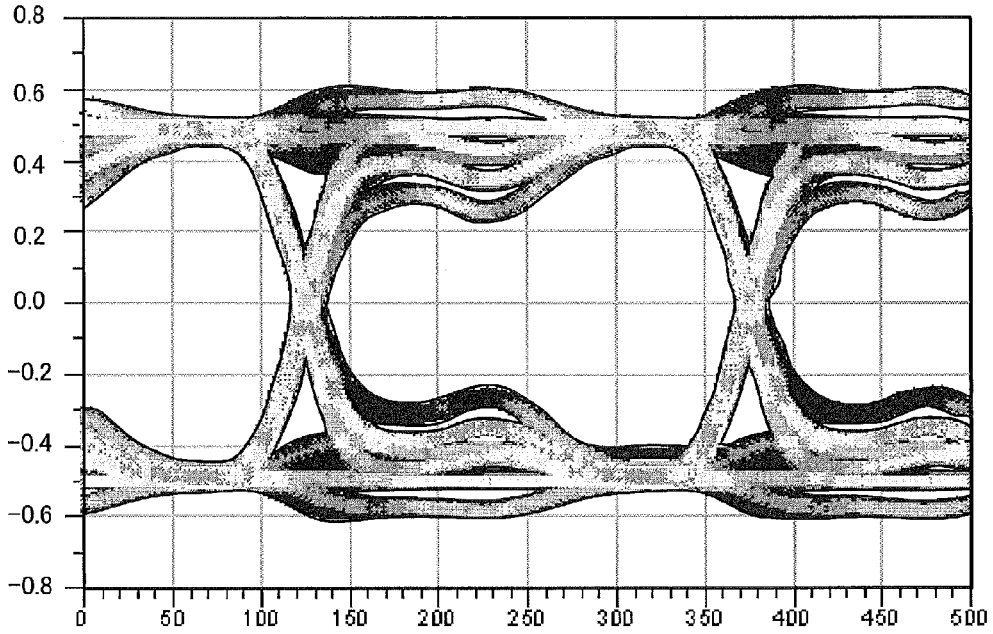
FIG. 8A is a voltage characteristic diagram showing an eye pattern of a general Type C HDMI connector structure.
Figure 8B:
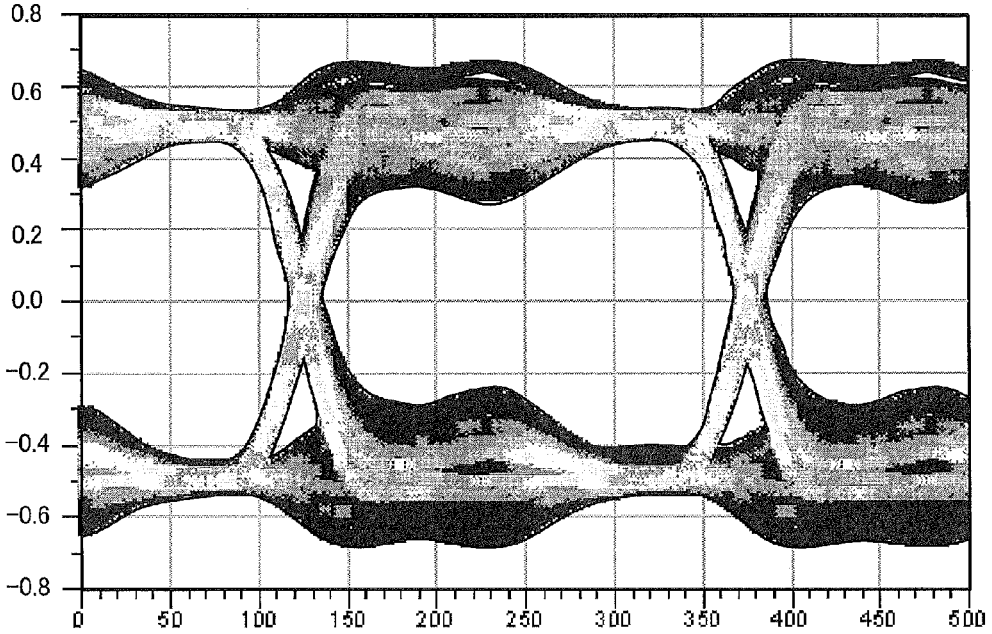
FIG. 8B is a voltage characteristic diagram showing an eye pattern of the general Type C HDMI connector structure.

FIGS. 8A and 8B are each a voltage characteristic diagram showing an eye pattern of the general Type C HDMI connector structure shown in FIGS. 3A to 3C. FIG. 8A shows an eye pattern of the "Data 2" line shown in FIG. 2B and FIG. 8B shows an eye pattern of the "Data 4" line shown in FIG. 2B.

Figure 9A:
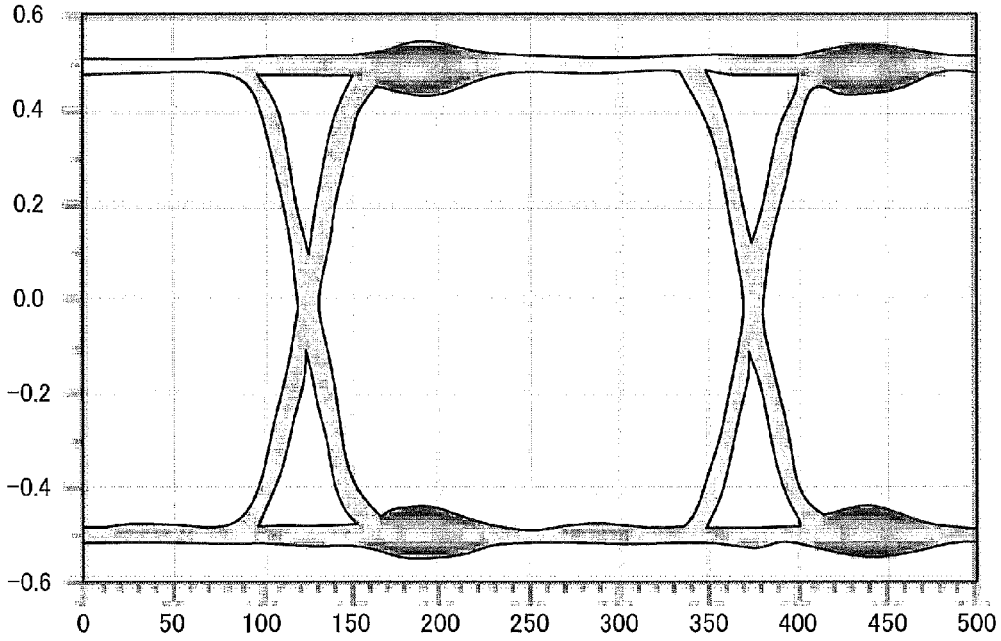
FIG. 9A is a voltage characteristic diagram showing an eye pattern of a connector structure according to the first embodiment.
Figure 9B:
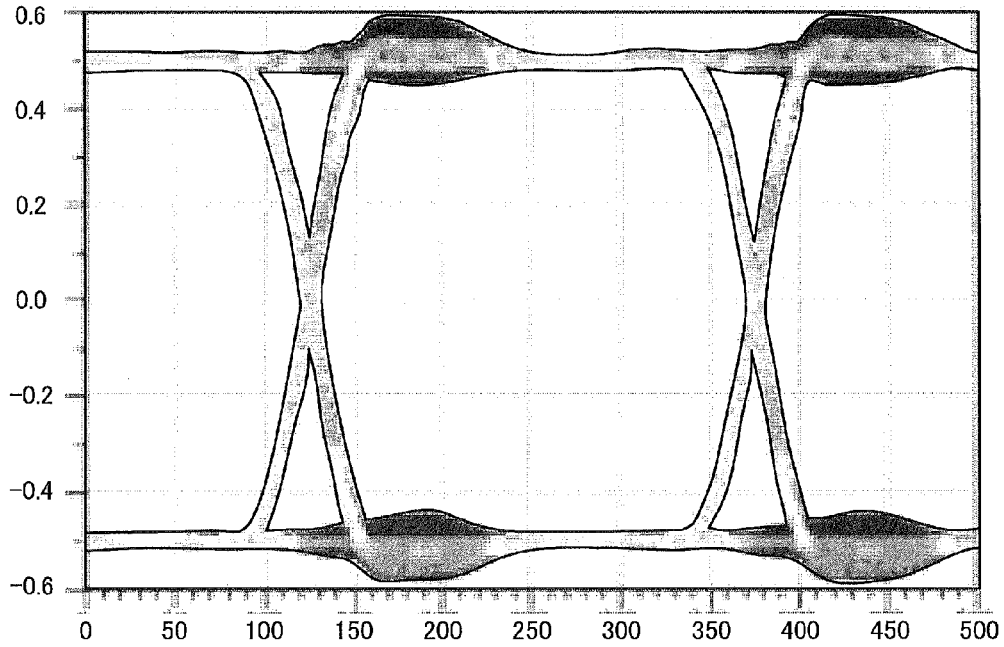
FIG. 9B is a voltage characteristic diagram showing an eye pattern of the connector structure according to the first embodiment.

FIGS. 9A and 9B are each a voltage characteristic diagram showing an eye pattern of the connector structure according to the first embodiment shown in FIGS. 4A to 4C. FIG. 9A shows an eye pattern of the "Data 2" line shown in FIG. 2B and FIG. 9B shows an eye pattern of the "Data 4" line shown in FIG. 2B.

Figure 9C:
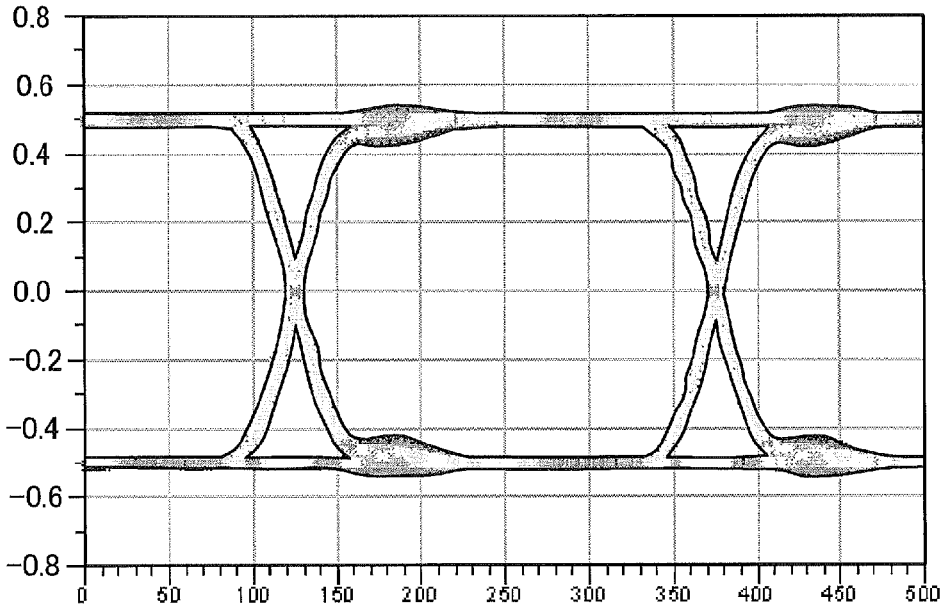
FIG. 9C is a voltage characteristic diagram showing an eye pattern of a connector structure according to the first embodiment in which guard lines are further arranged.
Figure 9D:
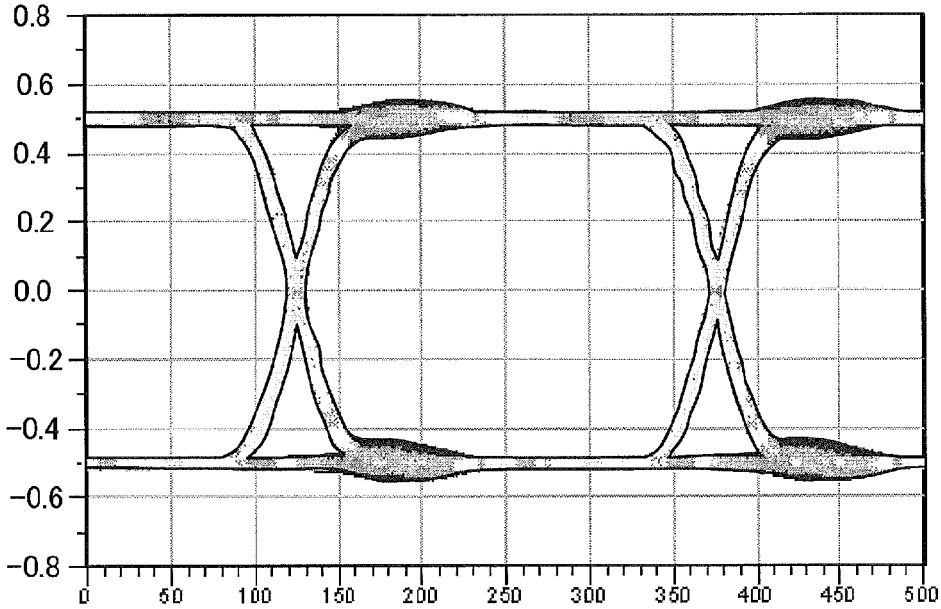
FIG. 9D is a voltage characteristic diagram showing an eye pattern of the connector structure according to the first embodiment in which guard lines are further arranged.
Figure 9E:
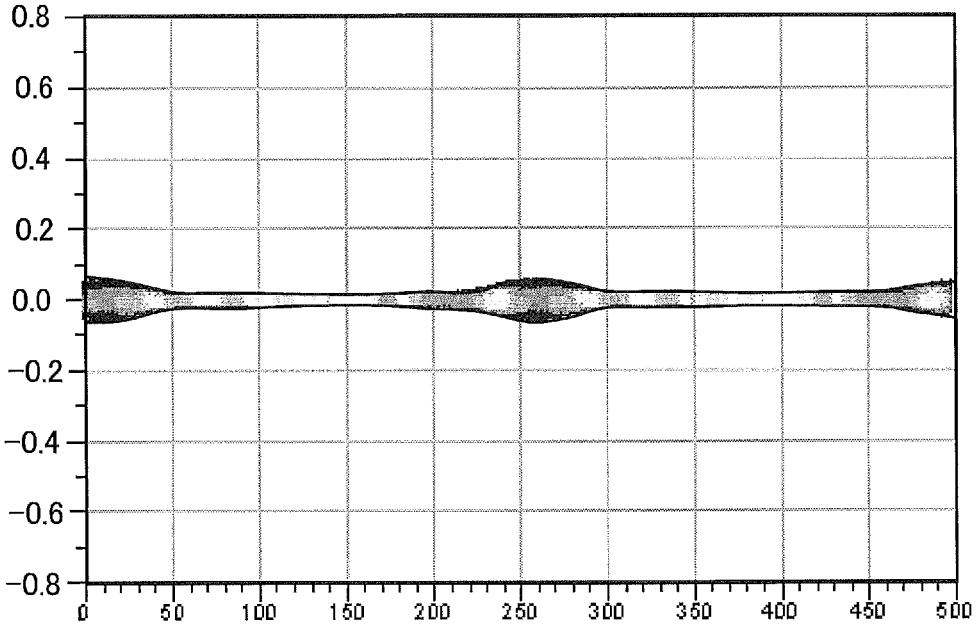
FIG. 9E is a voltage characteristic diagram showing a crosstalk characteristic of the connector structure according to the first embodiment in which guard lines are further arranged.

FIGS. 9C and 9D is each a voltage characteristic diagram showing an eye pattern of a connector structure according to the first embodiment in which guard lines are further arranged as shown in FIG. 5. FIG. 9C shows an eye pattern of the "Data 2" line shown in FIG. 2B and FIG. 9D shows an eye pattern of the "Data 4" line shown in FIG. 2B. FIG. 9E is a voltage characteristic diagram showing a crosstalk characteristic of a connector structure according to the first embodiment in which guard lines are further arranged as shown in FIG. 5.

In FIGS. 8A to 8B and FIGS. 9A to 9E, the eye pattern corresponding to "Data2" represents a transmission characteristic of data lines (existing data lines) that already exist in the general pin arrangement shown in FIG. 2A, and the eye pattern corresponding to "Data4" represents a transmission characteristic of data lines (new data lines) that are newly added in the pin arrangement in which data lines are newly added as shown in FIG. 2B.

When the FIGS. 8A and 8B are compared and FIGS. 9A and 9B are compared, the signal transmission characteristic is improved due to the connector structure according to the first embodiment, in addition to the existing data line "Data2" and the new data line "Data4". Thus, the deterioration in signals is reduced by the connector structure according to the first embodiment.

When the FIGS. 9A and 9B are compared and FIGS. 9C and 9D are compared, the signal transmission characteristic is further improved by providing the guard lines 150, in addition to the existing data line "Data2" and the new data line "Data4". Thus, the deterioration in signals is reduced by further providing the connector structure according to the first embodiment with the guard lines 150. In addition, with reference to FIG. 9E, a good crosstalk characteristic can be obtained in the connector structure according to the first embodiment.

3. Second Embodiment

Next, a structure of a connector according to a second embodiment of the present disclosure is explained. Note that, the connector according to the second embodiment corresponds to the Type D HDMI connector.

As explained with reference to FIGS. 1A and 1B, the Type D HDMI connector has pin arrangement shown in FIGS. 1A and 1B. Here, when the pin arrangement in which the data lines are newly added as shown in FIG. 1B is applied to the Type D HDMI connector, deterioration in signals occurs like the Type A HDMI connector explained in <1. Study on Increase in Transmission Data Amount>. On the other hand, a connector structure (to be described later) according to the second embodiment of the present disclosure can reduce the deterioration in signals even in a case of pin arrangement in which data lines are newly added as shown in FIG. 1B.

In order to clearly explain the structure of the connector according to the second embodiment, a structural example of the general Type D HDMI connector is firstly explained in [3.1. Structural Example of General Type D Connector]. Next, in [3.2. Structural Example of Connector according to Second Embodiment], a structural example of the connector according to the second embodiment of the present disclosure and differences from the general Type D HDMI connector are explained. Subsequently, characteristics of signals transmitted in the both structures are compared in [3.3. Comparison of Characteristic], and effect to reduce deterioration in signals in the connector according to the second embodiment is explained.

As shown in FIGS. 1A and 1B, signal pins are arranged along the x axis direction in two lines in the z axis direction in zigzag on the terminal surface, in the pin arrangement according to the general Type D HDMI connector. In addition, in a vertical direction of FIGS. 1A and 1B, signal pins formed on the upper line (upper direction in the z axis direction) and signal pins formed on the lower line (lower direction in the z axis direction) are horizontal line symmetry although disposition positions in the x axis are different. Accordingly, with regard to the following FIGS. 10A to 10C and FIGS. 11A to 11C, structures of signal pins at a lower side in the z axis direction (signal pins formed at the lower line in FIGS. 1A and 1B) are mainly explained. An explanation of the signal pins at the upper side in the z axis direction (signal pins formed at the upper line in FIGS. 1A and 1B) is omitted since the signal pins correspond to a structure obtained by folding the structure of the signal pins at the lower side.

[3.1. Structural Example of General Type D Connector]

Figure 10A:
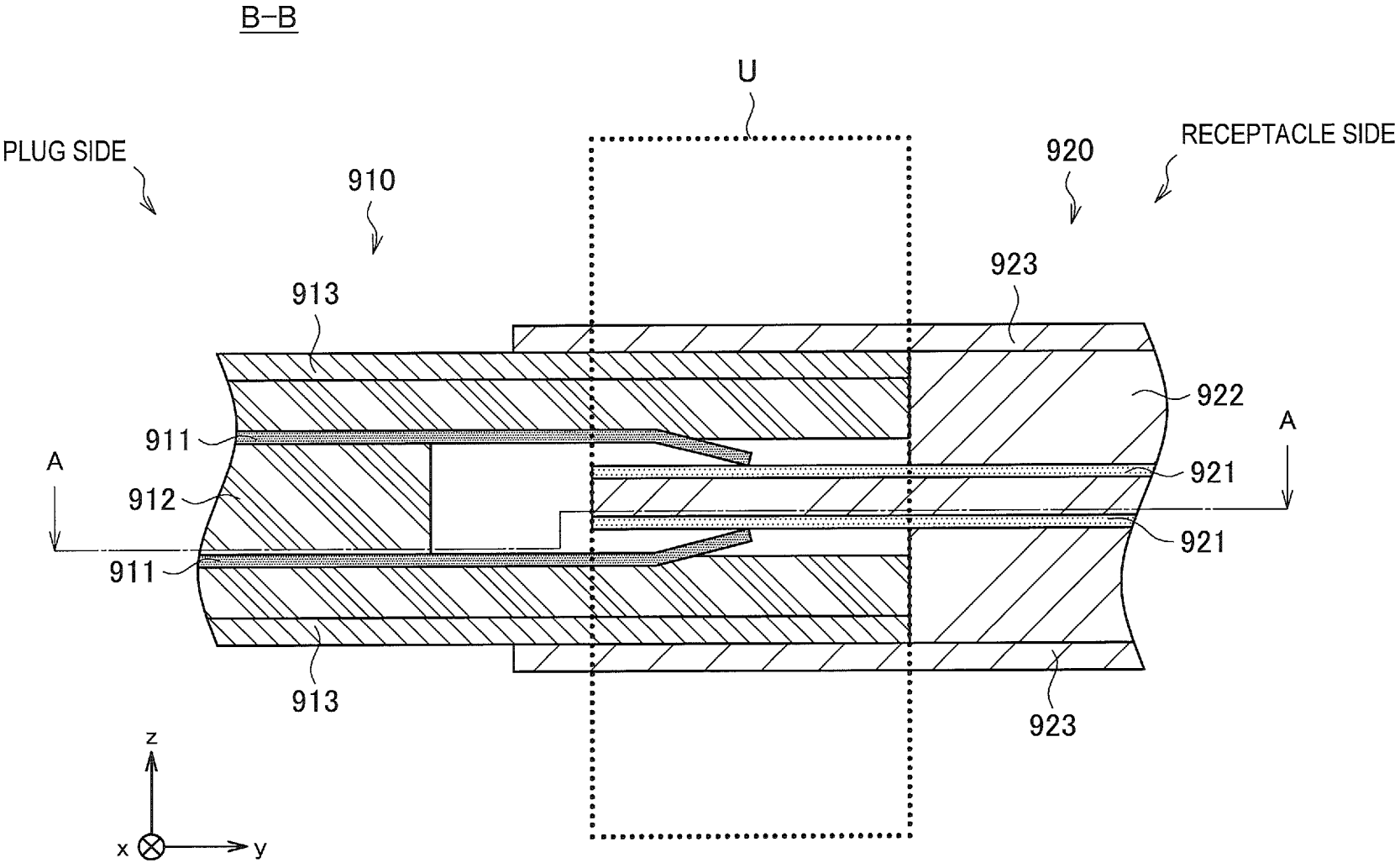
FIG. 10A is a cross-sectional view showing a structural example of general Type D HDMI connectors when being cut at a cross section constituted by a y axis and a z axis through signal pins.
Figure 10B:
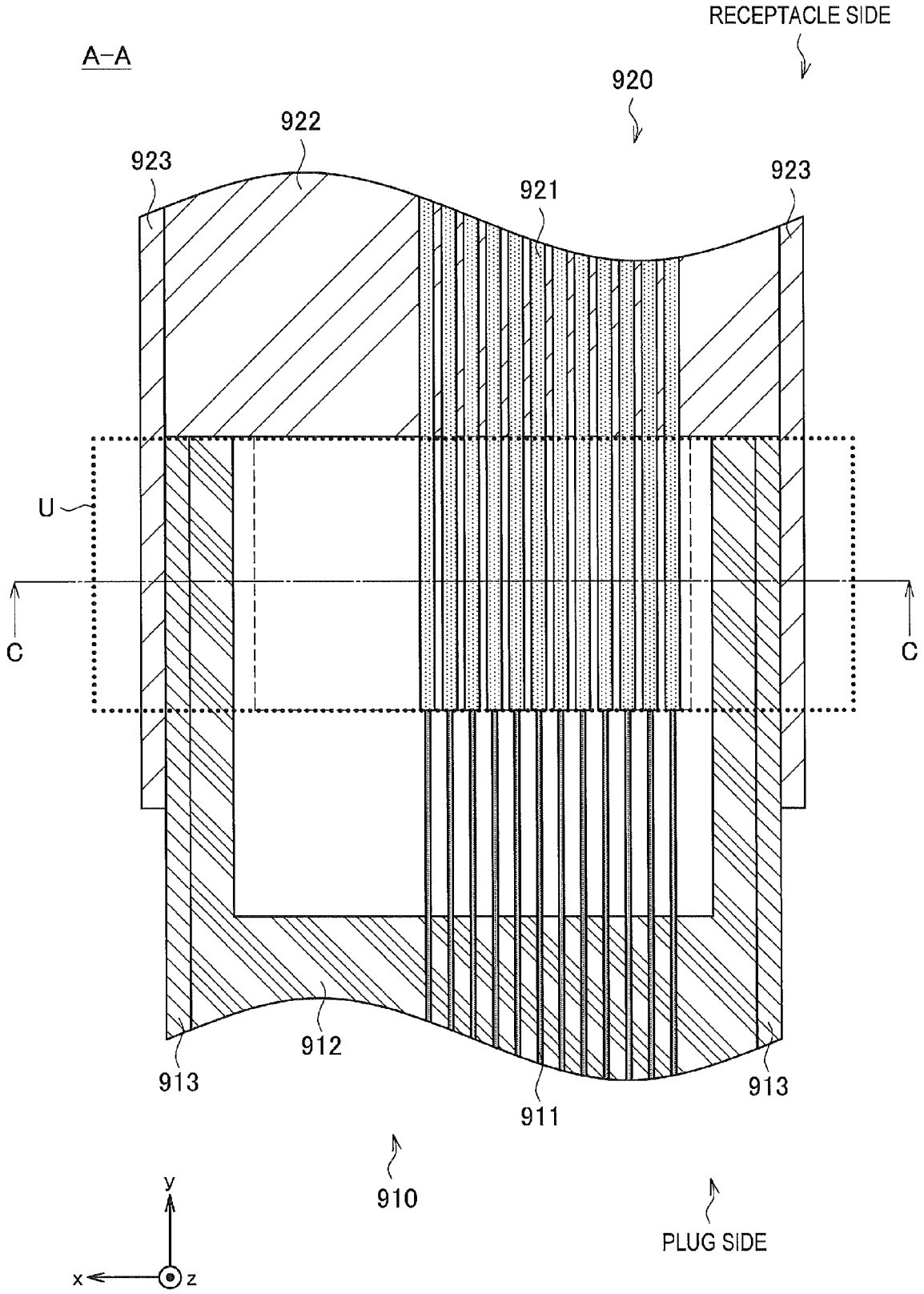
FIG. 10B is a cross-sectional view of the general Type D HDMI connectors corresponding to an A-A cross section in FIG. 10A, the A-A cross section being constituted by an x axis and the y axis.
Figure 10C:
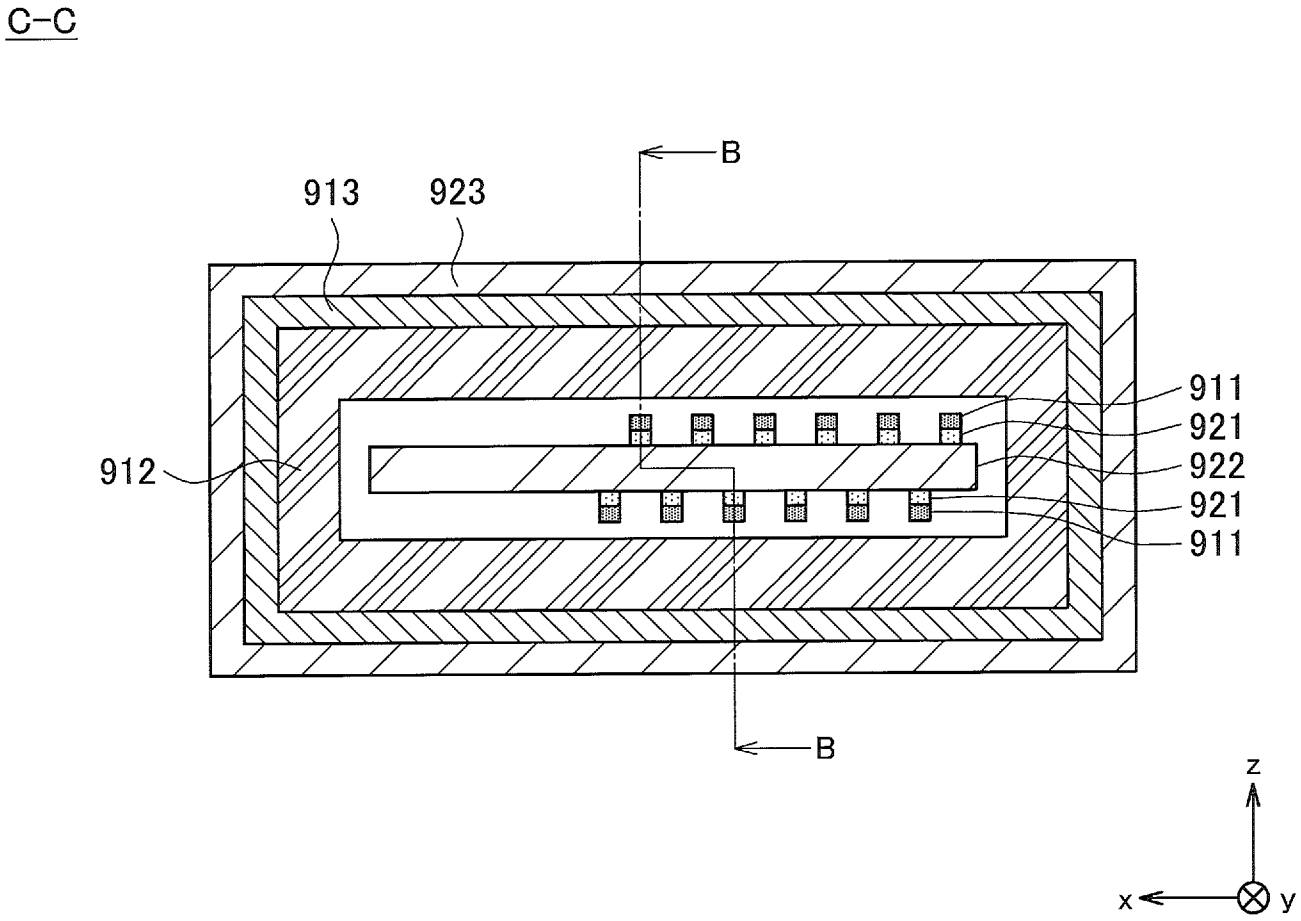
FIG. 10C is a cross-sectional view of the general Type D HDMI connectors corresponding to a C-C cross section in FIG. 10B, the C-C cross section being constituted by the x axis and the z axis.

First, with reference to FIGS. 10A to 10C, a structural example of a general Type D HDMI connectors is explained. FIG. 10A is a cross-sectional view showing a structural example of general Type D HDMI connectors when being cut at a cross section constituted by a y axis and a z axis through signal pins. FIG. 10B is a cross-sectional view of the general Type D HDMI connectors corresponding to an A-A cross section in FIG. 10A, the A-A cross section being constituted by an x axis and the y axis. FIG. 10C is a cross-sectional view of the general Type D HDMI connectors corresponding to a C-C cross section in FIG. 10B, the C-C cross section being constituted by the x axis and the z axis. Note that, in FIGS. 10A to 10C, a plug-side connector and a receptacle-side connector are fitted with each other.

First, a structure of the plug-side connector is explained. With reference to FIGS. 10A to 10C, a plug-side connector 910 of the general Type D HDMI connector includes signal pins 911, a dielectric 912, and an outer shell (shell) 913. The signal pins 911 extend in the first direction, in other words, the y axis direction. Parts of the signal pins 811 are embedded in the dielectric 912.

The shell 913 covers the signal pins 911 and the dielectric 912. One surface of the shell 913 in the positive direction of the y axis is an open surface open to an outside. As shown in FIGS. 10A to 10C, the plug-side connector 910 and a receptacle-side connector 920 (to be described later) are connected via the open surface of the shell 913. In addition, the shell 913 is formed of an electric conductor. Potential of the shell 813 is fixed to, for example, the ground potential via the receptacle-side connector 920 (to be described later).

In a predetermined region near the open surface of the shell 913, tips of the signal pins 911 are exposed from the dielectric 912. The exposed parts constitute bent parts bent toward the positive direction of the z axis at a predetermined angle. When the plug-side connector 910 and the receptacle-side connector 920 (to be described later) are fitted with each other, the bent parts of the signal pins 911 contact signal pins 921 of the receptacle side connector 920 (to be described later). Accordingly, the plug-side connector 910 and the receptacle-side connector 920 (to be described later) are electrically connected to each other.

Note that, the signal pins 921 at the upper side in the z axis direction have a structure that is horizontal line symmetrical to the signal pins at the lower side as described above. Accordingly, bent parts of the signal pins 921 are formed so as to be bent toward the negative direction of the z axis at the predetermined angle.

Next, a structure of the receptacle-side connector is explained. With reference to FIGS. 10A to 10C, the receptacle-side connector 920 of the general Type D HDMI connector includes the signal pins 921, a dielectric 922, and an outer shell (shell) 923. The signal pins 921 extend in the first direction, in other words, the y axis direction. Parts of the signal pins 921 are embedded in the dielectric 922.

The shell 923 covers the signal pins 921 and the dielectric 922. One surface of the shell 923 in the negative direction of the y axis is an open surface open to an outside. In addition, the shell 923 is formed of an electric conductor. Potential of the shell 923 is fixed to, for example, the ground potential.

An area of an opening of the open surface of the shell 923 is slightly larger than the cross-sectional area of the open surface of the shell 913 of the plug-side connector 910. As shown in FIGS. 10A to 10C, an end provided with the open surface of the shell 913 of the plug-side connector 910 is inserted into the opening of the open surface of the shell 923 of the receptacle-side connector 920, and the plug-side connector 910 and the receptacle-side connector 920 are fitted with each other. Note that, regions indicated by dotted lines in FIGS. 10A and 10B represent a fitting part U of the plug-side connector 910 and the receptacle-side connector 920.

In a predetermined region near the open surface of the shell 923, the signal pins 921 include exposed parts in which parts of regions of surfaces of the signal pins 921 are exposed from the dielectric 922. When the plug-side connector 910 and the receptacle-side connector 920 are fitted with each other, the exposed parts of the signal pins 921 contact the bent parts of the signal pins 911 of the plug-side connector 910.

Note that, as described above, in the general Type D connector, structural elements similar to the signal pins 911 and 921 and the dielectrics 912 and 922 are additionally and horizontal-line symmetrically provided inside the shells 913 and 923 as signal pins 911 and 921 and dielectrics 912 and 922 at the upper side in the z axis direction.

With reference to FIGS. 10A to 10C, a structure of the general Type D HDMI connector has been explained.

[3.2. Structural Example of Connector According to Second Embodiment]

Figure 11A:
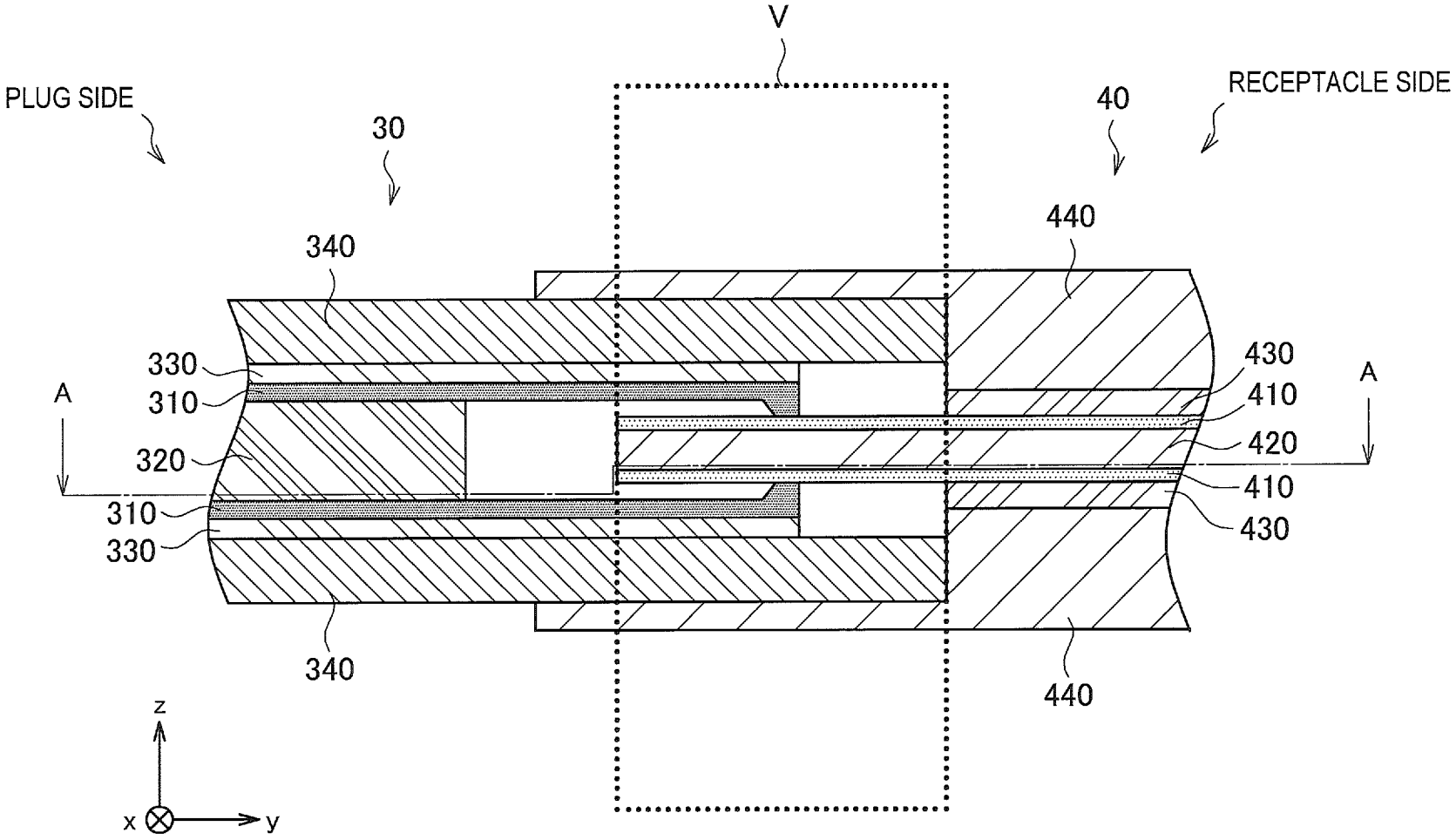
FIG. 11A is a cross-sectional view showing a structural example of connectors according to a second embodiment of the present disclosure when being cut at a cross section constituted by a y axis and a z axis through signal pins.
Figure 11B:
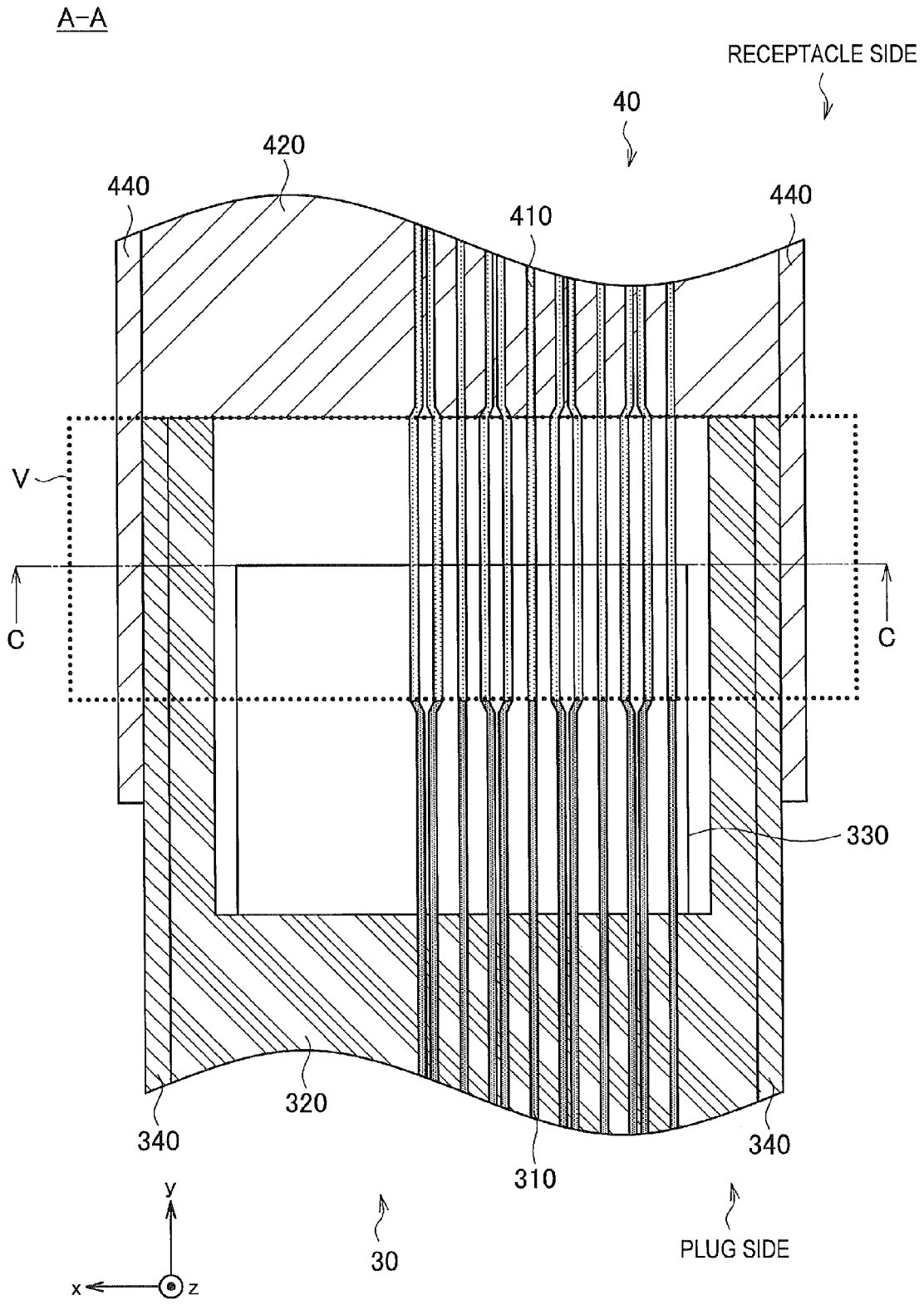
FIG. 11B is a cross-sectional view of the connectors according to the second embodiment corresponding to an A-A cross section in FIG. 11A, the A-A cross section being constituted by an x axis and the y axis.
Figure 11C:
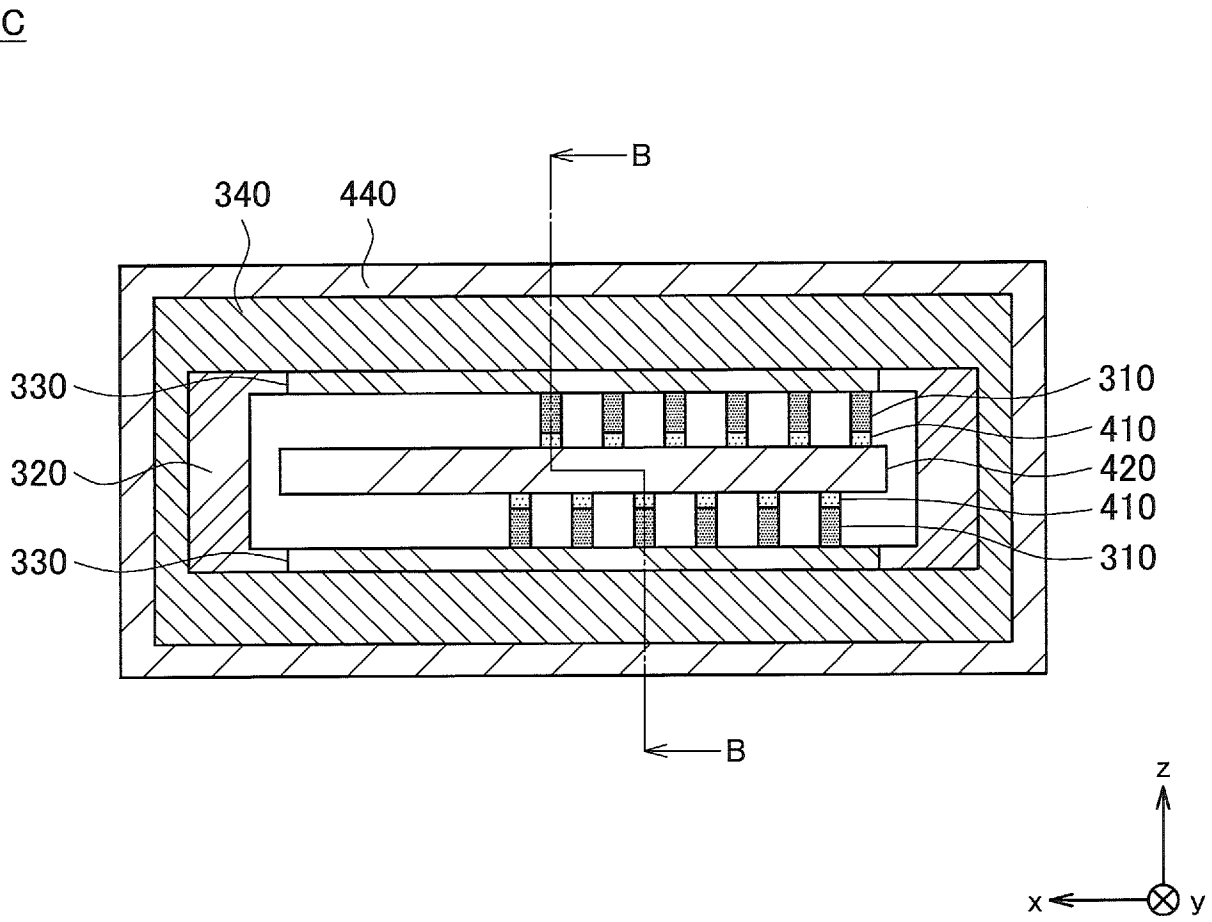
FIG. 11C is a cross-sectional view of the connectors according to the second embodiment corresponding to a C-C cross section in FIG. 11B, the C-C cross section being constituted by the x axis and the z axis.

Next, with reference to FIGS. 11A to 11C, a structural example of connectors according to the second embodiment of the present disclosure is explained. FIG. 11A is a cross-sectional view showing a structural example of connectors according to the second embodiment of the present disclosure when being cut at a cross section constituted by a y axis and a z axis through signal pins. FIG. 11B is a cross-sectional view of the connectors according to the second embodiment corresponding to an A-A cross section in FIG. 11A, the A-A cross section being constituted by an x axis and the y axis. FIG. 11C is a cross-sectional view of the connectors according to the second embodiment corresponding to a C-C cross section in FIG. 11B, the C-C cross section being constituted by the x axis and the z axis.

First, a structure of the plug-side connector is explained. With reference to FIGS. 11A to 11C, a plug-side connector 30 according to the second embodiment includes signal pins 310, dielectrics 320, substrates 330, and an outer shell (shell) 340.

The signal pins 310 extend in a first direction, in other words, a y axis direction. In addition, the signal pins 310 are formed as a wiring pattern on surfaces of the substrates 330 formed of dielectric.

The shell 340 covers the signal pins 310 and the substrates 330. One surface of the shell 340 in the positive direction of the y axis is an open surface open to an outside. As shown in FIGS. 11A to 11C, the plug-side connector 30 and a receptacle-side connector 40 (to be described later) are connected via the open surface of the shell 340. In addition, the shell 340 is formed of an electric conductor. Potential of the shell 340 is fixed to, for example, the ground potential via the receptacle-side connector 40 (to be described later).

Electric conductor layers having ground potential are formed on rear surfaces of the substrates 330, in other words, opposite surfaces of surfaces on which the signal pins 310 are formed. With reference to FIGS. 11A to 11C, according to the present embodiment, a surface of a shell 340 that faces the rear surfaces of the substrates 330 is thicker than other surfaces, and is in contact with the rear surfaces of the substrates 330. Thus, the electric conductor layers formed on the rear surfaces of the substrates 330 are integrated with the shell 340. Note that, in the present embodiment, it is only necessary to form the electric conductor layers having ground potential on the rear surfaces of the substrates 330. The structures of the electric conductor layers are not limited to the above example. Accordingly, the surface of the shell 340 is not necessarily thickened. For example, the electric conductor layers formed on the rear surfaces of the substrates 330 may be electrically connected to the shell 340 through via holes or the like.

In addition, the dielectrics 320 may be stacked above (in positive direction of the z axis) the signal pins 310 formed on the substrate 330. Note that, when the dielectrics 320 are formed, the dielectrics 320 do not cover the entire surfaces of the signal pins 310. Parts of regions of surfaces of the signal pins 310 are exposed in a predetermined region near the open surface of the shell 340. When the plug-side connector 30 and the receptacle-side connector 40 (to be described later) are fitted with each other, the exposed parts of the signal pins 310 of the plug-side connector contact signal pin 410*s* of the receptacle side connector 40. Accordingly, the plug-side connector 30 and the receptacle-side connector 40 (to be described later) are electrically connected to each other. Note that, contact parts may be provided on parts of regions of the exposed parts of the signal pins 310, the contact part protruding toward the signal pins 410 of the receptacle-side connector 40. Thus, the signal pins 410 of the plug-side connector 30 and the signal pins 410 of the receptacle-side connector 40 may contact to each other via the contact parts.

Next, a structure of the receptacle-side connector is explained. With reference to FIGS. 11A to 11C, the receptacle-side connector 40 according to the second embodiment includes a signal pins 410, a dielectric 420, substrates 430, and an outer shell (shell) 440.

The signal pins 410 extend in a first direction, in other words, a y axis direction. In addition, the signal pins 410 are formed as a wiring pattern on surfaces of the substrates 430 formed of dielectric.

The shell 440 covers the signal pins 410 and the substrates 430. One surface of the shell 440 in the negative direction of the y axis is an open surface open to an outside. In addition, the shell 440 is formed of an electric conductor. Potential of the shell 440 is fixed to, for example, the ground potential.

An area of an opening of the open surface of the shell 440 is slightly larger than the cross-sectional area of the open surface of the shell 340 of the plug-side connector 30. As shown in FIGS. 11A to 11C, an end provided with the open surface of the shell 340 of the plug-side connector 30 is inserted into the opening of the open surface of the shell 440 of the receptacle-side connector 40, and the plug-side connector 30 and the receptacle-side connector 40 are fitted with each other. Note that, regions indicated by dotted lines in FIGS. 11A and 11B represent a fitting part V of the plug-side connector 30 and the receptacle-side connector 40.

Electric conductor layers having ground potential are formed on rear surfaces of the substrates 430, in other words, opposite surfaces of surfaces on which the signal pins 410 are formed. With reference to FIGS. 11A to 11C, according to the present embodiment, a surface of a shell 440 that faces the rear surfaces of the substrates 430 is thicker than other surfaces, and is in contact with the rear surfaces of the substrates 430. Thus, the electric conductor layers formed on the rear surfaces of the substrates 430 are integrated with the shell 440. Note that, in the present embodiment, it is only necessary to form the electric conductor layers having ground potential on the rear surfaces of the substrates 430. The structure of the electric conductor layers is not limited to the above example. Accordingly, the surface of the shell 440 is not necessarily thickened. For example, the electric conductor layers formed on the rear surfaces of the substrates 430 may be electrically connected to the shell 440 through via holes or the like.

In addition, the dielectric 420 may be stacked above (in positive direction of the z axis) the signal pins 410 formed on the substrate 430. Note that, when the dielectric 420 is formed, parts of regions of the signal pins 410 are exposed in a predetermined region near the open surface of the shell 440. The exposed parts of the signal pins 410 of the receptacle-side connector 40 contact the exposed parts and/or the contact parts of the signal pins 310 of the receptacle side connector 30. Accordingly, the plug-side connector 30 and the receptacle-side connector 40 are electrically connected to each other.

Note that, as described above, structural elements similar to the signal pins 310 and 410, the dielectrics 320 and 420, the substrates 330 and 430, and the electric conductor layers are additionally and horizontal-line symmetrically provided inside the shells 340 and 440 as signal pins 310 and 410, dielectrics 320 and 420, substrates 330 and 430, and an electric conductor layers at the upper side in the z axis direction, in the connectors according to the second embodiment. Thus, the connector structure according to the second embodiment corresponds to a structure having two sets of the signal pins 110 and 210, the dielectrics 120 and 220, the substrates 130 and 230, and the electric conductor layers that are in the connector structure according to the above-explained first embodiment.

With reference to FIG. 11B, among the signal pins 310 of the plug-side connector 30 and the signal pins 410 of the receptacle-side connector 40, intervals between pairs of the signal pins 310 and 410 that transmit differential signals and adjacently extend may be shorter than intervals from other signal pins 310 and 410 adjacent to the pairs of the signal pins 310 and 410. Note that, the intervals between the signal pins 310 and the intervals between the signal pins 410 may be identical in the fitting part V. On the other hand, in a region other than the fitting part V, the intervals between pairs of the signal pins 310 and 410 that transmit differential signals and adjacently extend may be shorter than the intervals from other signal pins 310 and 410 adjacent to the pairs of the signal pins 310 and 410.

The wiring intervals between the signal pins 310 and the wiring intervals between the signal pins 410 in the fitting part V may be similar to the wiring intervals of the signal pins 911 and the wiring intervals of the signal pins 921 in the fitting part U shown in FIGS. 10A to 10C. Thus, the signal pins of the connector according to the second embodiment and the signal pins of the general Type D HDMI connector may have identical wiring intervals in the fitting parts.

As explained with reference to FIGS. 11A to 11C, the structure of the connector according to the second embodiment and the structure of the general Type D HDMI connector are different as follows: The connector according to the second embodiment includes the substrates that are formed of the dielectric and that include signal pins (wiring pattern corresponding to the signal pins) on one surfaces and include the electric conductor layers having the ground potential on the other surfaces. In addition, among the signal pins in the connector according to the second embodiment, the intervals between the pairs of the signal pins that transmit differential signals and adjacently extend are shorter than the intervals from other signal pins adjacent to the pairs of the signal pins. In a way similar to the connector according to the first embodiment, the connector according to the second embodiments has such configuration and achieves the following effects.

As explained above, in the connectors 30 and 40 according to the second embodiment, signal pins 310 and 410 are formed on the substrates 330 and 430 formed of the dielectric, and the electric conductor layers having the ground potential are formed on the opposite sides of the surfaces of the substrates 330 and 430 on which the signal pins 310 and 410 are formed. Accordingly, the connectors according to the second embodiment have configurations in which ground planes (electric conductor layers), dielectric layers (substrate 330 and 430), and wirings (signal pins 310 and 410) are stacked in this order. According to such configurations, an electromagnetic field due to current (signal) flowing through the signal pins 310 and 410 is trapped between the substrates 330 and 430, and the so-called microstripline (microstrip structure) is formed. Thus, in the connectors according to the second embodiment, it is possible to reduce effects of the current (signal) flowing through the signal pins 310 and 410 on other signal pins 310 and 410, and the deterioration in signals can be reduced.

In addition, as explained above, among the signal pins 310 and 410 in the connectors 30 and 40 according to the second embodiment, the intervals between pairs of the signal pins 310 and 410 that transmit differential signals and adjacently extend may be shorter than the intervals from other signal pins 310 and 410 adjacent to the pairs of the signal pins 110 and 410. Since the intervals between the pair of signal pins 310 and 410 that transmit differential signals to be paired are narrowed more, an electromagnetic field due to current (signal) flowing through the pair of signal pins 310 and 410 is trapped between the pairs of signal pins 310 and 410 and between the substrates 330 and 430, and so-called differential stripline (differential strip structure) is formed. Note that, a return path of the differential coupling is secured on the ground plane at a rear surface of the wiring surface. Accordingly, since the coupling is generated between the differential data lines, it is possible to narrow the wiring width and the wiring intervals between the signal pins, while the differential impedance is maintained. Thus, intervals from a different kind of adjacent signal wirings can be widened. Accordingly, the crosstalk can be reduced and signal quality can be improved. Thus, in the connectors according to the second embodiment, it is possible to further reduce effects of the current (signal) flowing through the pair of the signal pins 310 and 410 that transmit a differential signal, on other signal pins 310 and 410. In addition, the deterioration in signals can be reduced.

Note that, in a case where the pin arrangement shown in FIG. 1B in which the data lines are newly added is applied to the connector according to the second embodiment, signal pins to which a pair of differential signals "Data3+" and "Data3−", and a pair of differential signals "Data4+" and "Data4−" are allocated are not arranged at a positions where the pairs of the differential signals are next to each other, among the newly added pairs of the differential signals. Thus, in the connectors according to the second embodiment, pairs of adjacent signal pins to which a "Data0" and "Data0−" pair, a "Data1+" and "Data1−" pair, a "Data2+" and "Data2−" pair, and a "Data5+" and "Data5−" pair are applied transmit signals using the differential striplines. On the other hand, pairs of nonadjacent signal pins to which a "Data3+" and "Data3− pair and a "Data4+" and "Data4−" pair are applied may transmit signals using single-ended microstrip lines.

In addition, as explained above, the connector according to the second embodiment of the present disclosure can be more effective in the case of the pin arrangement as shown in FIG. 1B in which the data lines are newly added. However, the connector according to the first embodiment also can be applied to the general pin arrangement as shown in FIG. 1A. Even if the connector according to the second embodiment of the present disclosure is applied to the general pin arrangement shown in FIG. 1A, effects of current (signals) flowing through the signal pins 310 and 410 on other signals 310 and 410 and deterioration in the signals can be reduced by forming a microstripline and a differential stripline with regard to each signal pin.

Note that, as explained with reference to FIG. 11B, the intervals between the signal pins 310 and the intervals between the signal pins 410 in the fitting part V of the connectors according to the second embodiment of the present disclosure may be identical to the intervals between the signal pins 911 and the intervals between the signal pins 921 in the fitting part U of the general Type D HDMI connectors. According to such configuration, it is possible to ensure compatibility between the connector according to the second embodiment and the general Type D HDMI connector. Thus, when the connector according to the second embodiment and the general Type D HDMI connector are fitted with each other, predetermined signal pins defined by the HDMI standard are electrically connected. Accordingly, the connector according to the second embodiment also can be applied to a case where signals transmission corresponding to the general pin arrangement shown in FIG. 1A are performed.

In a way similar to the modification of the connector according to the first embodiment, guard lines having ground potential may further extend at positions for sandwiching a signal pin in a manner that the guard lines are substantially parallel to the signal pin, in the connector according to the second embodiment of the present disclosure. In addition, the guard lines may be disposed so as to sandwich a signal pin that transmits a signal with single end. Note that, as described above, the connector according to the second embodiment shown in FIGS. 11A to 11C corresponds to a structure having two sets of the signal pins, the substrate, and the electric conductor layer that are in the connector structure according to the first embodiment shown in FIGS. 4A to 4C. Accordingly, in a case where the guard lines are provided in the connector according to the second embodiment, the configuration of the signal pins (wiring pattern) on the substrate is similar to the connector according to the first embodiment. Thus, as shown in FIG. 5, in both the plug-side connector and the receptacle-side connector according to the second embodiment, guard lines may be disposed so as to sandwich a signal pin that transmits a signal with single end. In addition, potential of the guard lines is set to the ground potential. Since the guard lines are provided, it is possible to reduce effects of the current (signal) flowing through the signal pins 310 and 410 on other signal pins 310 and 410, and the deterioration in signals can be reduced.

The effects of the connector according to the second embodiment have been explained. As explained above, even if the connector includes a plurality of sets of the signal pins, the substrate and the electric conductor layer (microstrip structure), the connector can achieve the effects similar to the first embodiment.

[3.3. Comparison of Characteristic]

Next, a result of comparison between a characteristic of a signal flowing through a signal pin in the general Type D HDMI connector structure shown in FIGS. 10A to 10C and a characteristic of a signal flowing through a signal pin in the connector structure according to the second embodiment of the present disclosure shown in FIGS. 11A to 11C is explained. Note that, the following FIGS. 12A to 12B, FIGS. 13A to 13B, FIGS. 14A to 14B, and FIGS. 15A to 15C each show a result of flowing a signal corresponding to pin arrangement in which data lines are newly added as shown in FIG. 2B.

First, with reference to FIGS. 12A to 12B and FIGS. 13A to 13B, difference in electric field distribution near signal pins between a general Type D HDMI connector and the connector according to the second embodiment is explained.

Figure 12A:
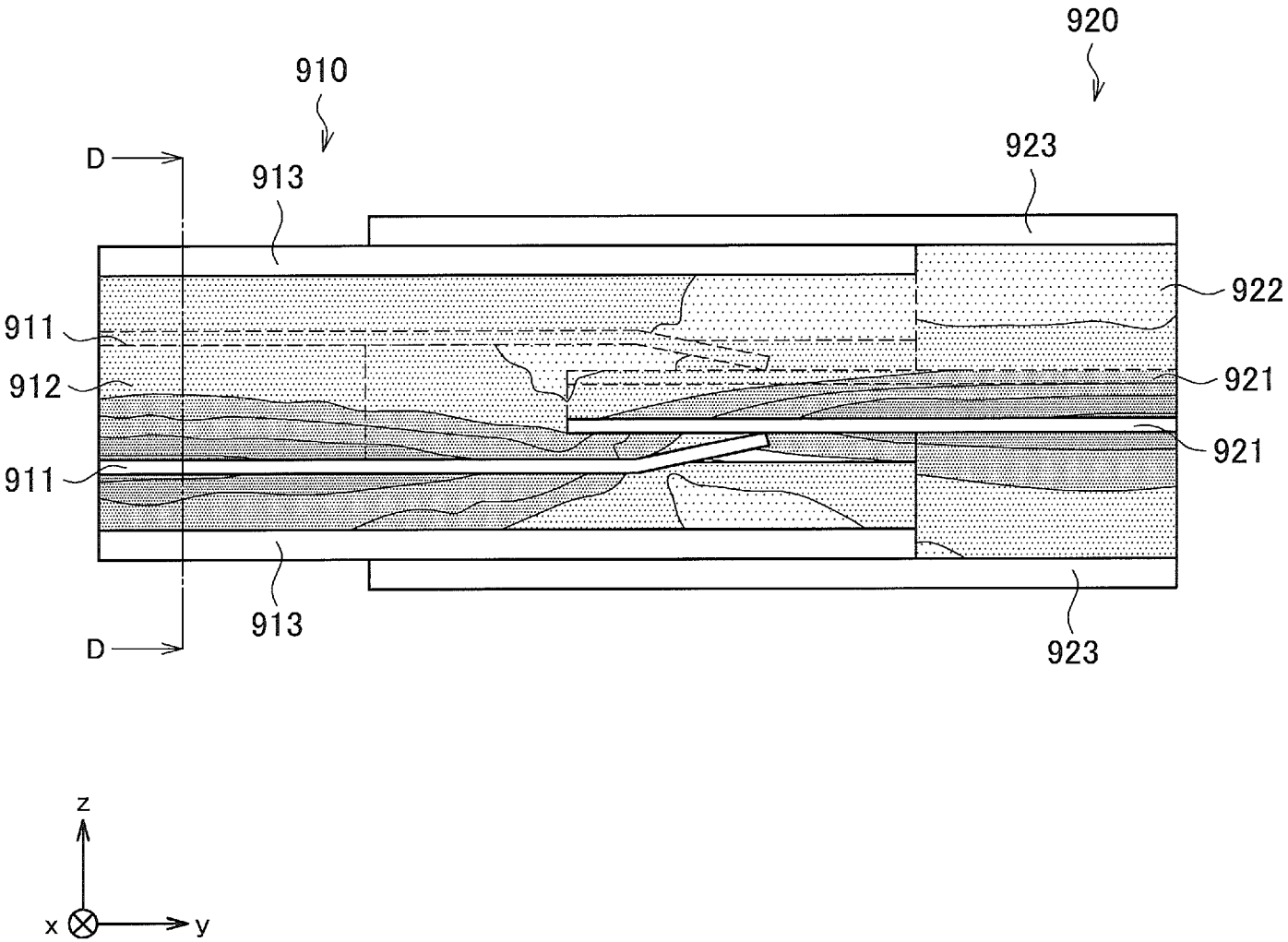
FIG. 12A is a contour map of an electric field showing electric field distribution in a general Type D HDMI connector structure.
Figure 12B:
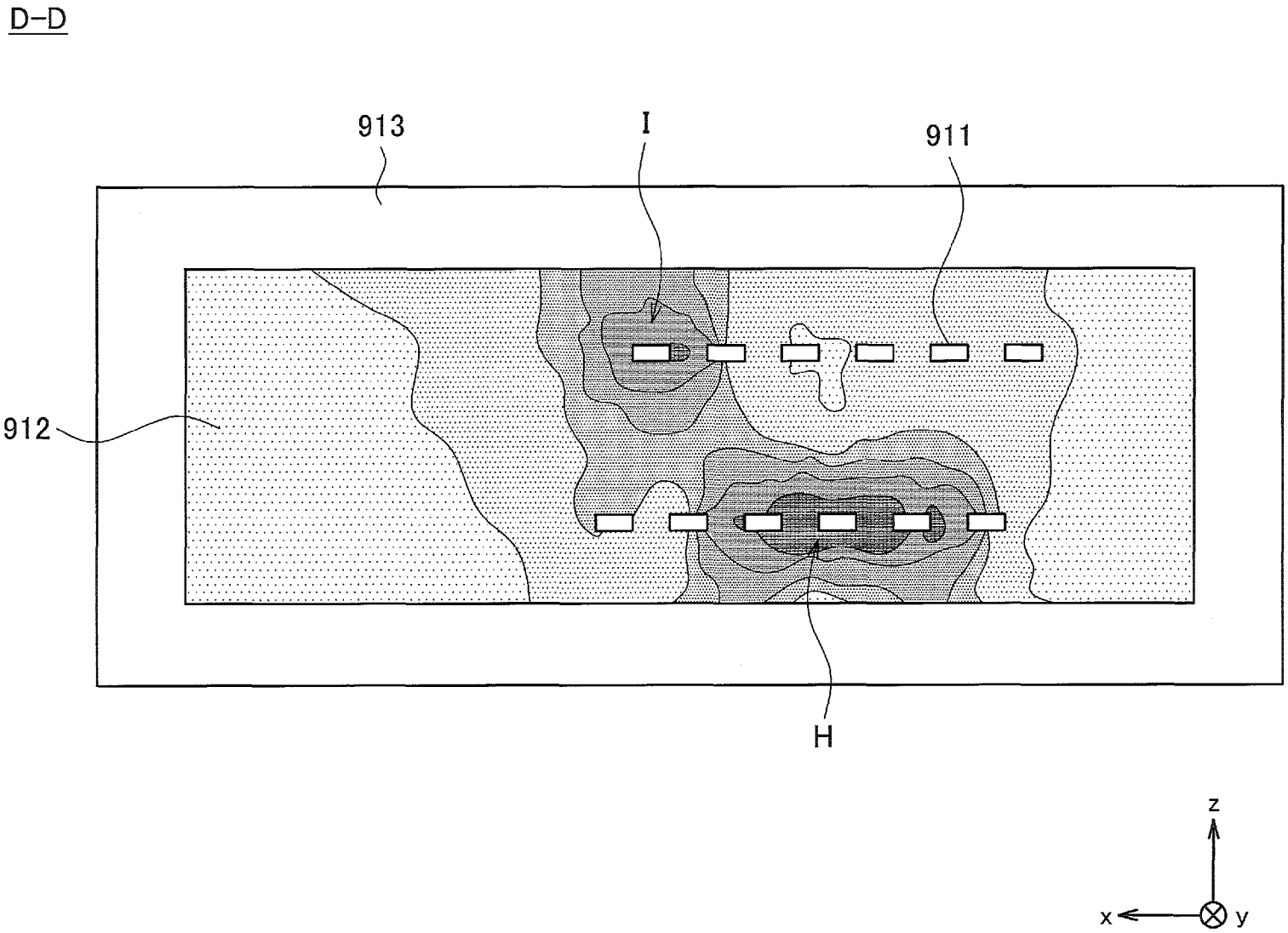
FIG. 12B is a contour map of an electric field showing electric field distribution in the general Type D HDMI connector structure.
Figure 13A:
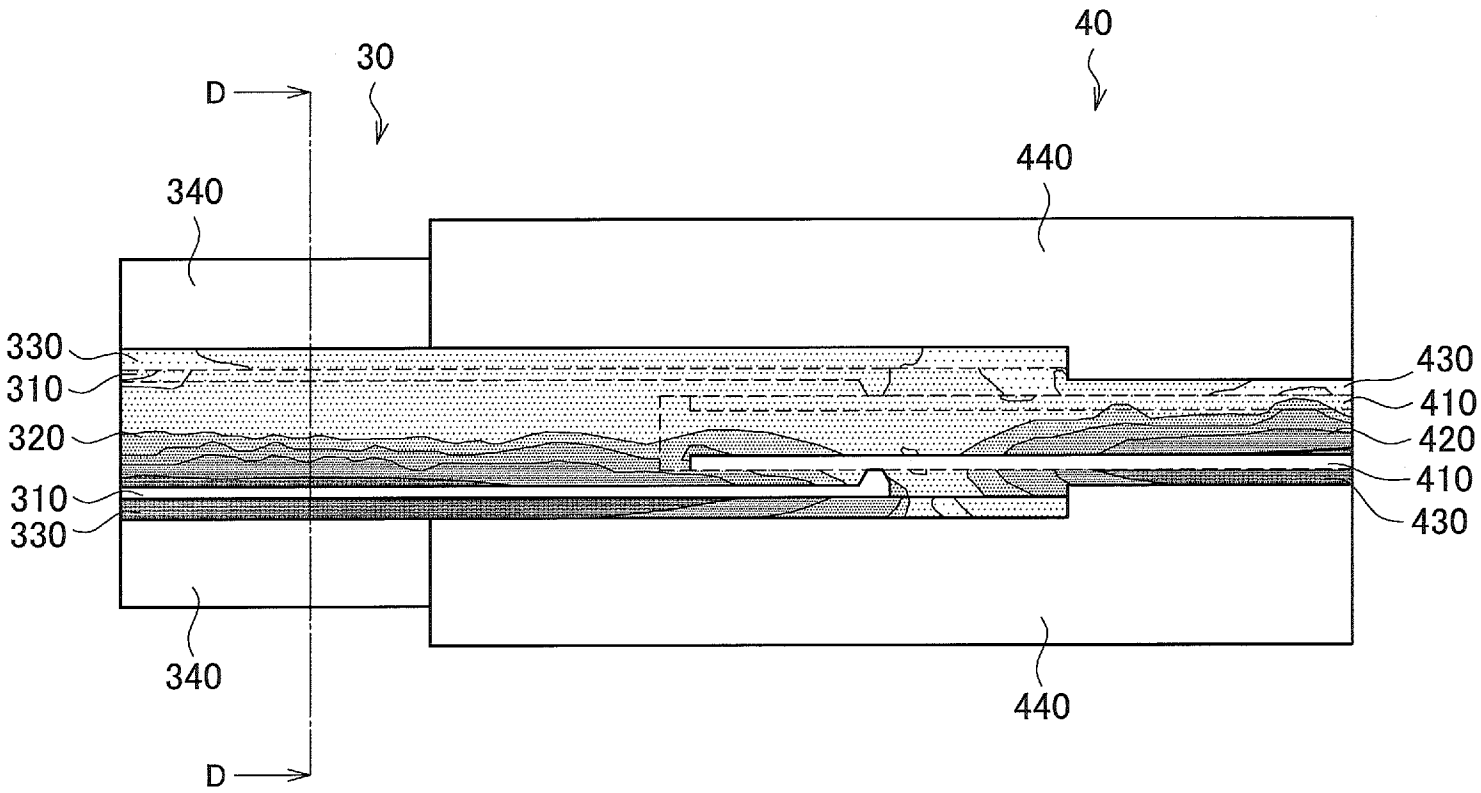
FIG. 13A is a contour map of an electric field showing electric field distribution in a connector structure according to the second embodiment.
Figure 13B:
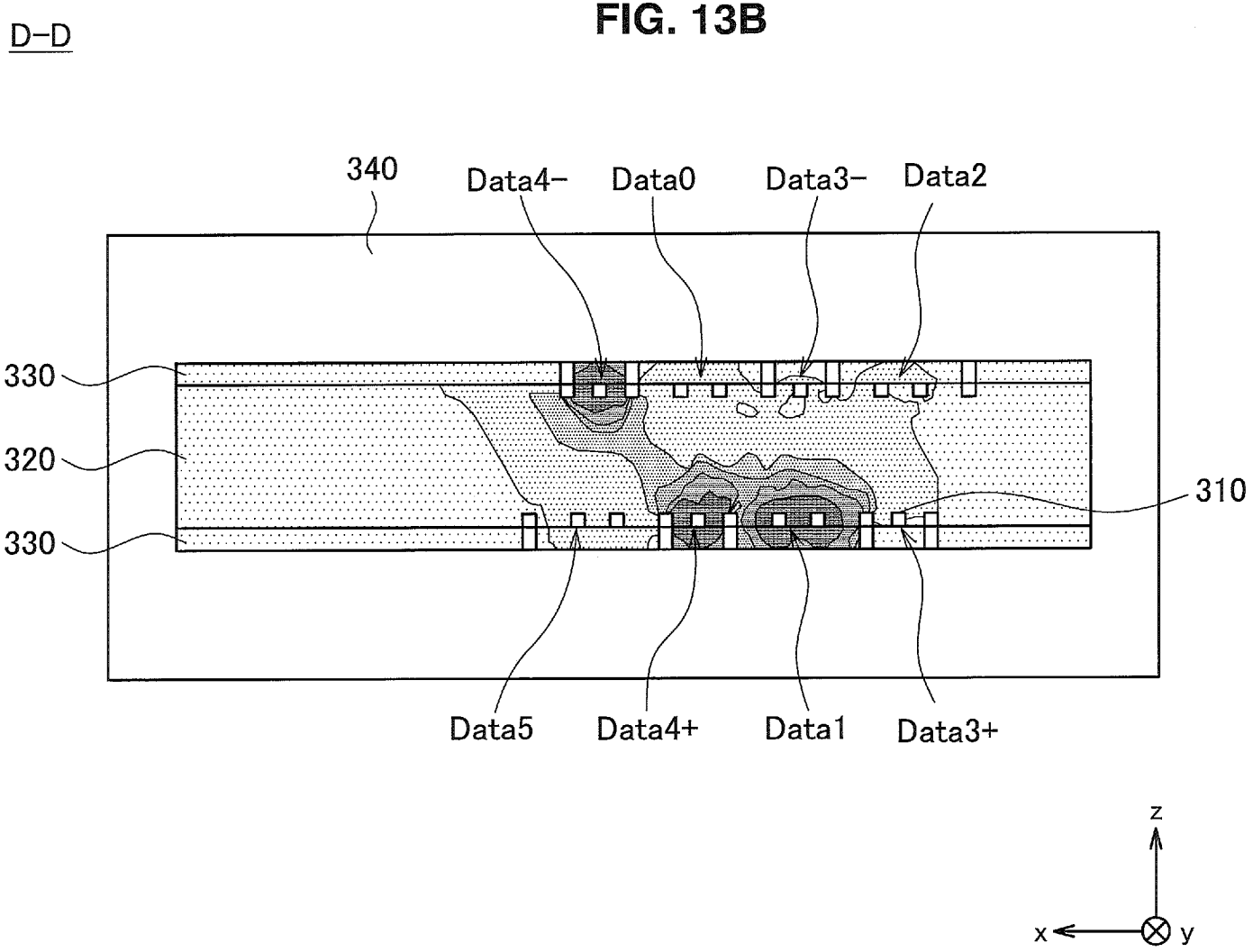
FIG. 13B is a contour map of an electric field showing electric field distribution in the connector structure according to the second embodiment.

FIGS. 12A to 12B and FIGS. 13A to 13B each show electric field distribution near signal pins in a case where a predetermined signal for transmitting a video signal decided by the HDMI standard is applied to each connector. FIGS. 12A and 12B are each a contour map of an electric field showing electric field distribution in the general Type D HDMI connector structure. FIGS. 13A and 13B are each a contour map of an electric field showing electric field distribution in the connector structure according to the second embodiment. In FIGS. 12A to 12B and FIGS. 13A to 13B, strength of the electric field distribution is schematically represented by shades of hatching. A dark hatched region represents a region in which the electric field is concentrated.

FIG. 12A is a contour map of an electric field at a cross-section corresponding to FIG. 10A, in the general Type D HDMI connector structure. FIG. 12B is a contour map of an electric field at a D-D cross-section shown in FIG. 12A.

FIG. 13A is a contour map of an electric field at a cross-section corresponding to FIG. 11A, in the connector structure according to the second embodiment. FIG. 13B is a contour map of an electric field at a D-D cross-section shown in FIG. 13A. Note that, the contour maps of the electric fields shown in FIGS. 13A and 13B determine the electric field distribution of the connector structure according to the second embodiment in which the guard lines are further provided as shown in FIG. 5.

The contour maps of the electric fields in FIGS. 12A to 12B and FIGS. 13A to 13B each show a simulation result of an electric field distribution near the signal pins in a case where a model in which permittivity corresponding to each region (signal pin, substrate, outer shell, dielectric, or the like) at each cross-section described above is set is formed, and a predetermined signal when a video signal decided by the HDMI standard is transmitted is applied.

With reference to FIG. 12A, in the general Type D HDMI connector structure, there is few difference in the electric field distribution between a front surface (surface that stretches in the y axis direction and that is positioned in the positive direction of the z axis) and a rear surface (surface that stretches in the y axis direction and that is positioned in the negative direction of the z axis) of each of the signal pins 310 and 410. On the other hand, with reference to FIG. 12B, in the general Type D HDMI connector structure, as shown in a region H (region across "Data1+", "Data1−", and "Data4+") and a region I (region near Data4−), electric fields are also concentrated in regions other than a differential signal pair, and current (signal) flowing through signal pins 310 affects other signal pins 310.

On the other hand, with reference to FIG. 13A, in the connector structure according to the second embodiment, electric field is concentrated between the signal pins 310 and 410 and the shells 340 and 440, in other words, electric field is concentrated in the substrates 330 and 430. Accordingly, the so-called microstripline is formed. In addition, with reference to FIG. 13B, in the connector structure according to the second embodiment, electric fields are concentrated between an actuation signal pair of the adjacently disposed signal pins 310 and 410 of "Data1", and the so-called differential stripline is formed. In the signal pins 310 and 410 of "Data4−" and "Data4+", electric fields are concentrated between the signal pins 310 and 410 and the shells 340 and 440, in other words, electric fields are concentrated in the substrate 330 and 430, and single-ended electric field distribution is formed. Accordingly, effect of current (signal) flowing through signal pins 310 and 410 on other signal pins 310 and 410 is reduced.

Next, with reference to FIGS. 14A to 14B and FIGS. 15A to 15C, difference in signal transmission characteristics as represented by an eye pattern and crosstalk, between the general Type D HDMI connector and the connector according to the second embodiment is explained.

Figure 14A:
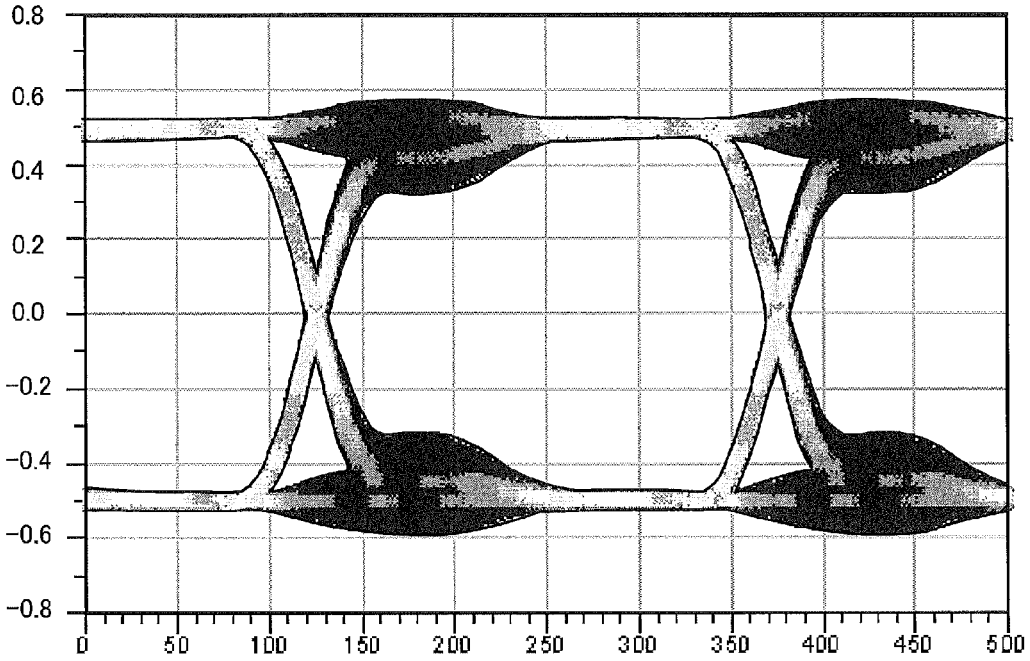
FIG. 14A is a voltage characteristic diagram showing an eye pattern of a general Type D HDMI connector structure.
Figure 14B:
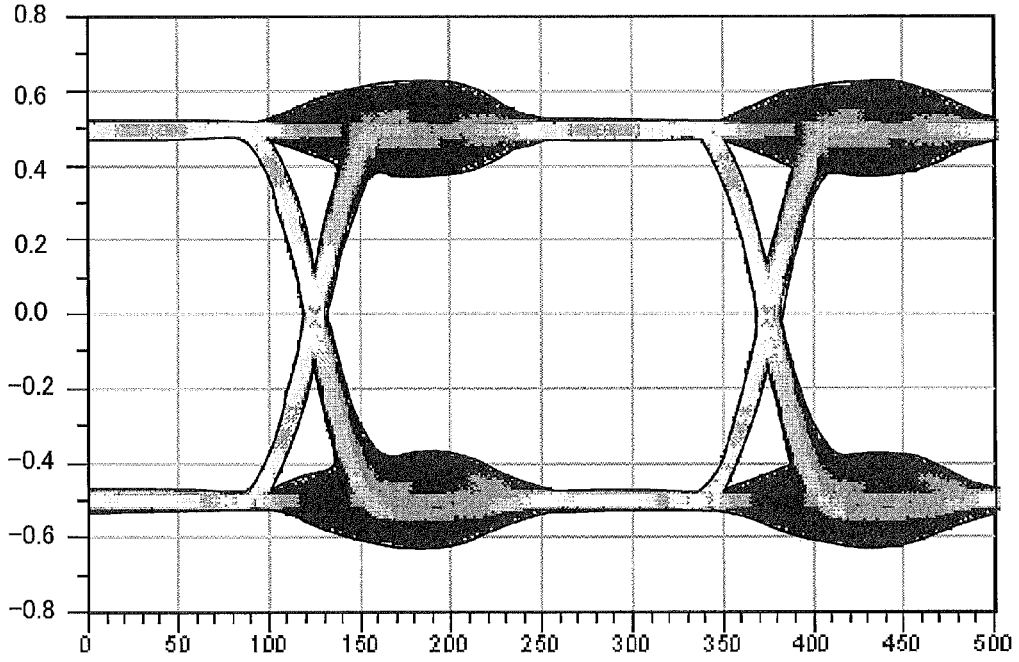
FIG. 14B is a voltage characteristic diagram showing an eye pattern of a general Type D HDMI connector structure.

FIGS. 14A and 14B are each a voltage characteristic diagram showing an eye pattern of the general Type D HDMI connector structure shown in FIGS. 10A to 10C. FIG. 14A shows an eye pattern of the "Data 1" line shown in FIG. 1B and FIG. 14B shows an eye pattern of the "Data 4" line shown in FIG. 1B.

Figure 15A:
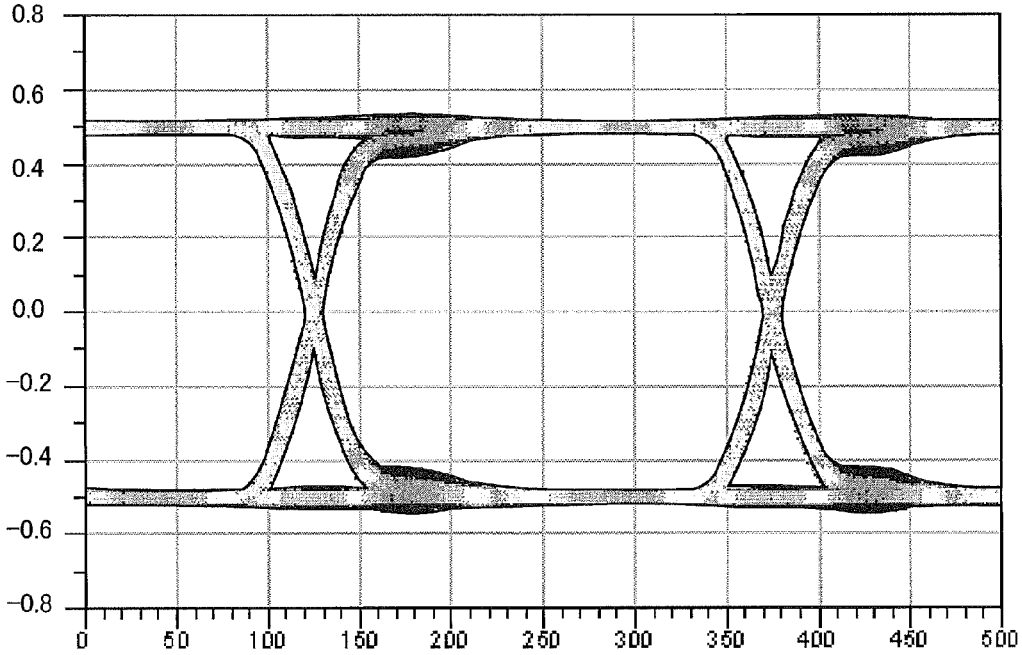
FIG. 15A is a voltage characteristic diagram showing an eye pattern of a connector structure according to the second embodiment in which guard lines are further arranged.
Figure 15B:
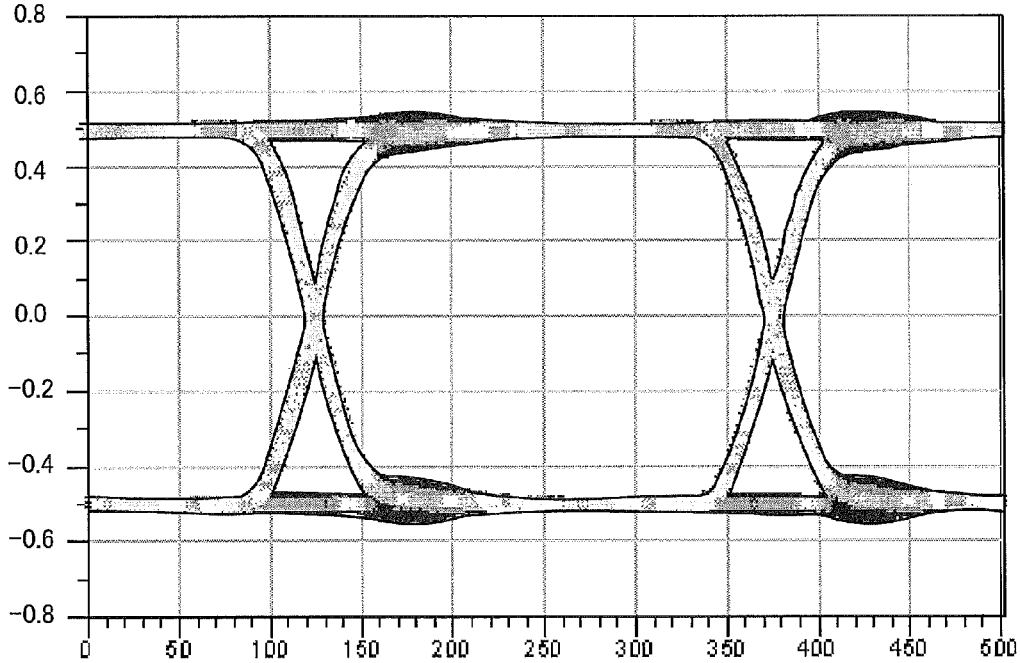
FIG. 15B is a voltage characteristic diagram showing an eye pattern of the connector structure according to the second embodiment in which guard lines are further arranged.
Figure 15C:
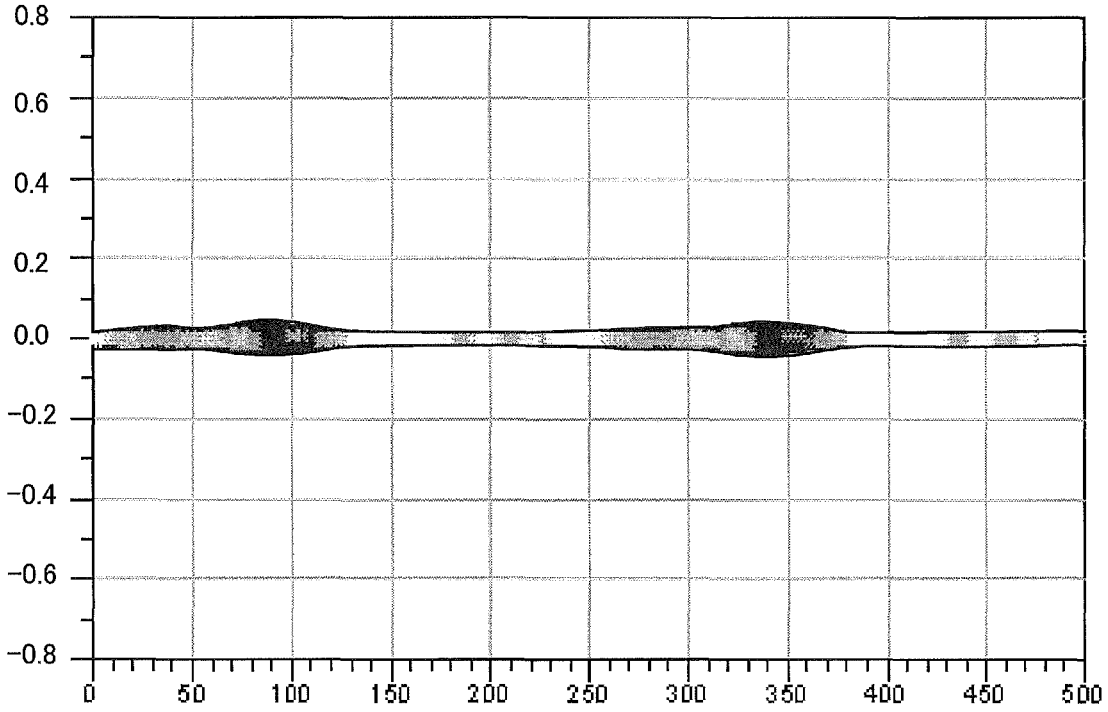
FIG. 15C is a voltage characteristic diagram showing a crosstalk characteristic of the connector structure according to the second embodiment in which guard lines are further arranged.

FIGS. 15AC and 15B is each a voltage characteristic diagram showing an eye pattern of a connector structure according to the second embodiment in which guard lines are further arranged as shown in FIG. 5. FIG. 15A shows an eye pattern of the "Data 1" line shown in FIG. 1B and FIG. 15B shows an eye pattern of the "Data 4" line shown in FIG. 1B. FIG. 15C is a voltage characteristic diagram showing crosstalk of a connector structure according to the second embodiment in which guard lines are further arranged as shown in FIG. 5, for example.

In FIGS. 14A to 14B and FIGS. 15A to 15C, the eye pattern corresponding to "Data1" represents a transmission characteristic of data lines (existing data lines) that already exist in the general pin arrangement shown in FIG. 1A, and the eye pattern corresponding to "Data4" represents a transmission characteristic of data lines (new data lines) that is newly added in the pin arrangement in which data lines are newly added as shown in FIG. 1B.

When the FIGS. 14A and 14B, and FIGS. 15A and 15B are compared, the signal transmission characteristic is improved due to the connector structure according to the second embodiment, in addition to the existing data line "Data1" and the new data line "Data4". Thus, the deterioration in signals is reduced by the connector structure according to the second embodiment. In addition, with reference to FIG. 15C, a good crosstalk characteristic can be obtained in the connector structure according to the second embodiment.

4. Modification

Next, modifications of connectors according to the first embodiment and the second embodiment of the present disclosure are explained.

[4.1. Expansion of Cross-Sectional Area of Signal Pin]

With regard to the connectors according to the first embodiment and the second embodiment of the present disclosure, a cross-sectional area of a signal pin may be expanded. With reference to FIGS. 16A to 16D, a modification in which a cross-sectional area of a signal pin is expanded is explained. Note that, in the following explanation with reference to FIGS. 16A to 16D, the connector according to the first embodiment of the present disclosure is used as an example. However, the present modification also can be applied to the connector according to the second embodiment of the present disclosure.

Figure 16A:
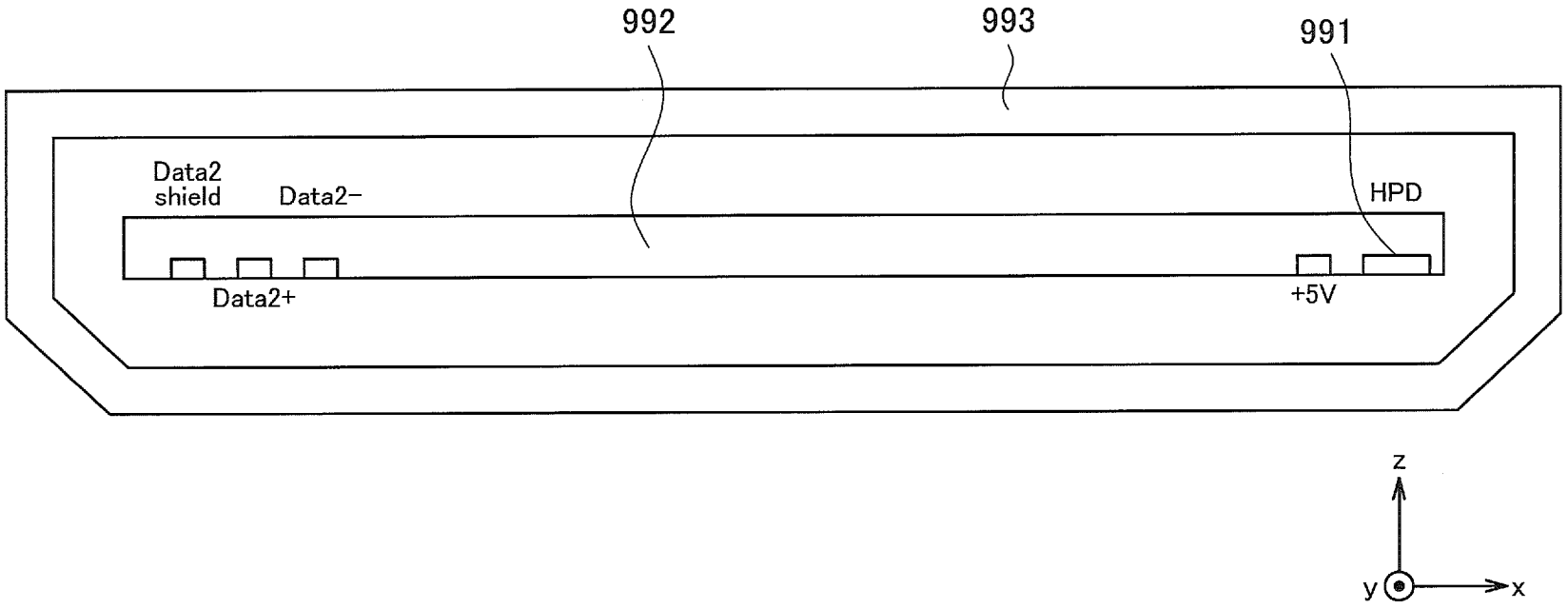
FIG. 16A is a schematic view showing an example of signal pin arrangement in a modification of the connector according to the first embodiment.

FIG. 16A is a schematic view showing an example of related signal pin arrangement in a modification of the connector according to the first embodiment. Note that, FIG. 16A shows only signal pins arranged at and near the most end part of the terminal surface of the connector, the signal pins being necessary for explaining the present modification. The other signal pins are not shown in FIG. 16A. In addition, FIG. 16A shows the terminal surfaces of the plug-side connector.

For example, with reference to FIG. 16A, wiring width of an HPD signal pin positioned at the most end part of the terminal surface is larger than wiring width of other signal pins 991. The wiring width of the signal pin 991 arranged at the most end part of the terminal surface is expanded toward the outer shell (shell) 993 in the positive direction of the x axis. Accordingly, the wiring width can be expanded without changing wiring intervals between the signal pins 991.

Note that, as described above, the connector according to the first embodiment of the present disclosure (connector corresponding to Type C HDMI connector) is used as an example in FIG. 16A. Thus, the signal pins are arranged in one line in the x axis direction. Accordingly, FIG. 16A shows the HPD signal pin as the signal pin that is positioned at the most end part of the terminal surface and whose wiring width may be expanded. Alternatively, with regard to another kind of connector, the signal pin that is positioned at the most end part of the terminal surface and whose cross-sectional area is expanded may be a signal pin to which any kind of signal is applied. For example, in Type A, Type D and Type E HDMI connectors, signal pins are arranged in two lines in the x axis direction in zigzag. Therefore, cross-sectional areas of power signal pins (+5V power pins) may be expanded in addition to the HPD signal pins.

Figure 16B:
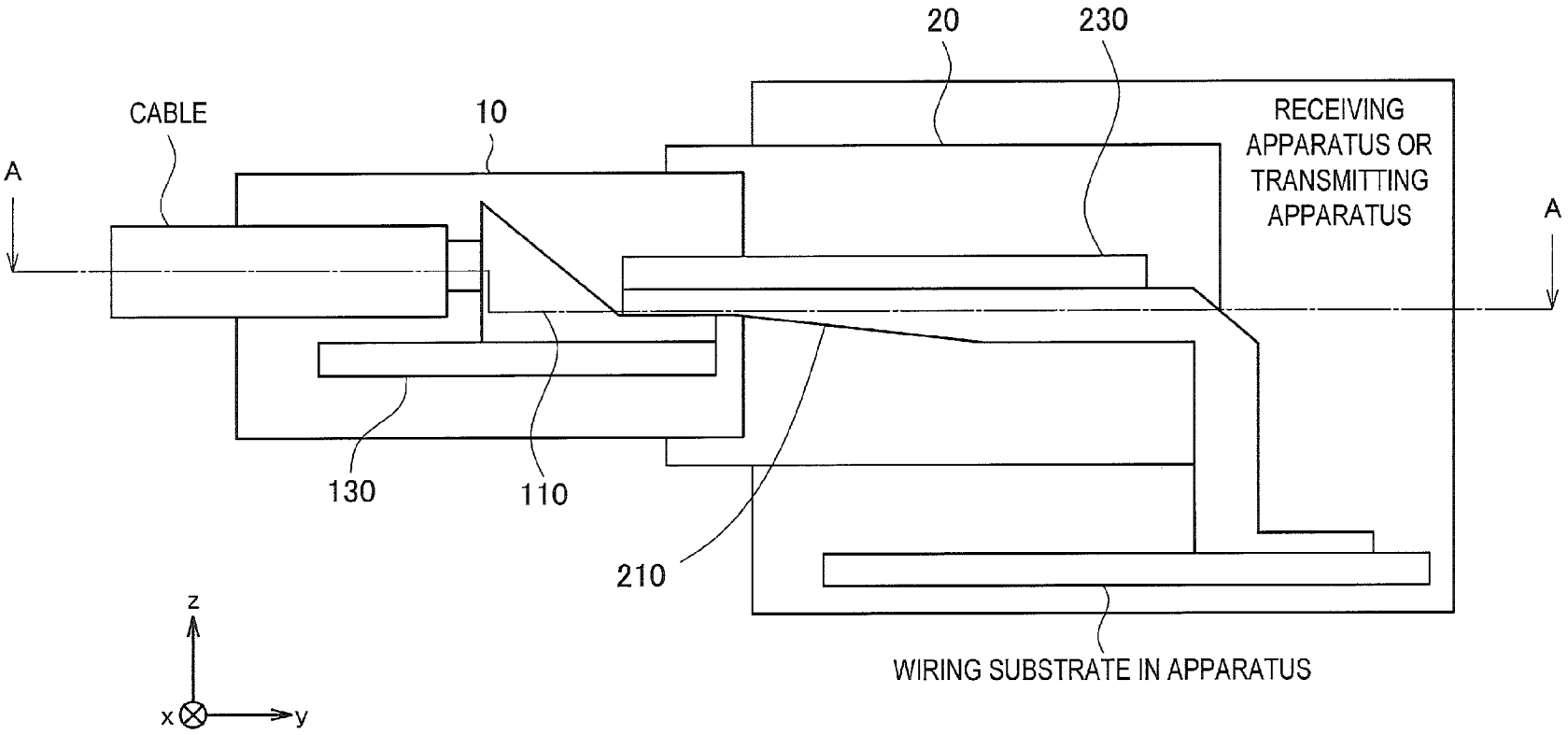
FIG. 16B is a schematic view showing a structural example of the connectors shown in FIG. 16A when being cut at a cross section constituted by a y axis and a z axis through signal pins.
Figure 16C:
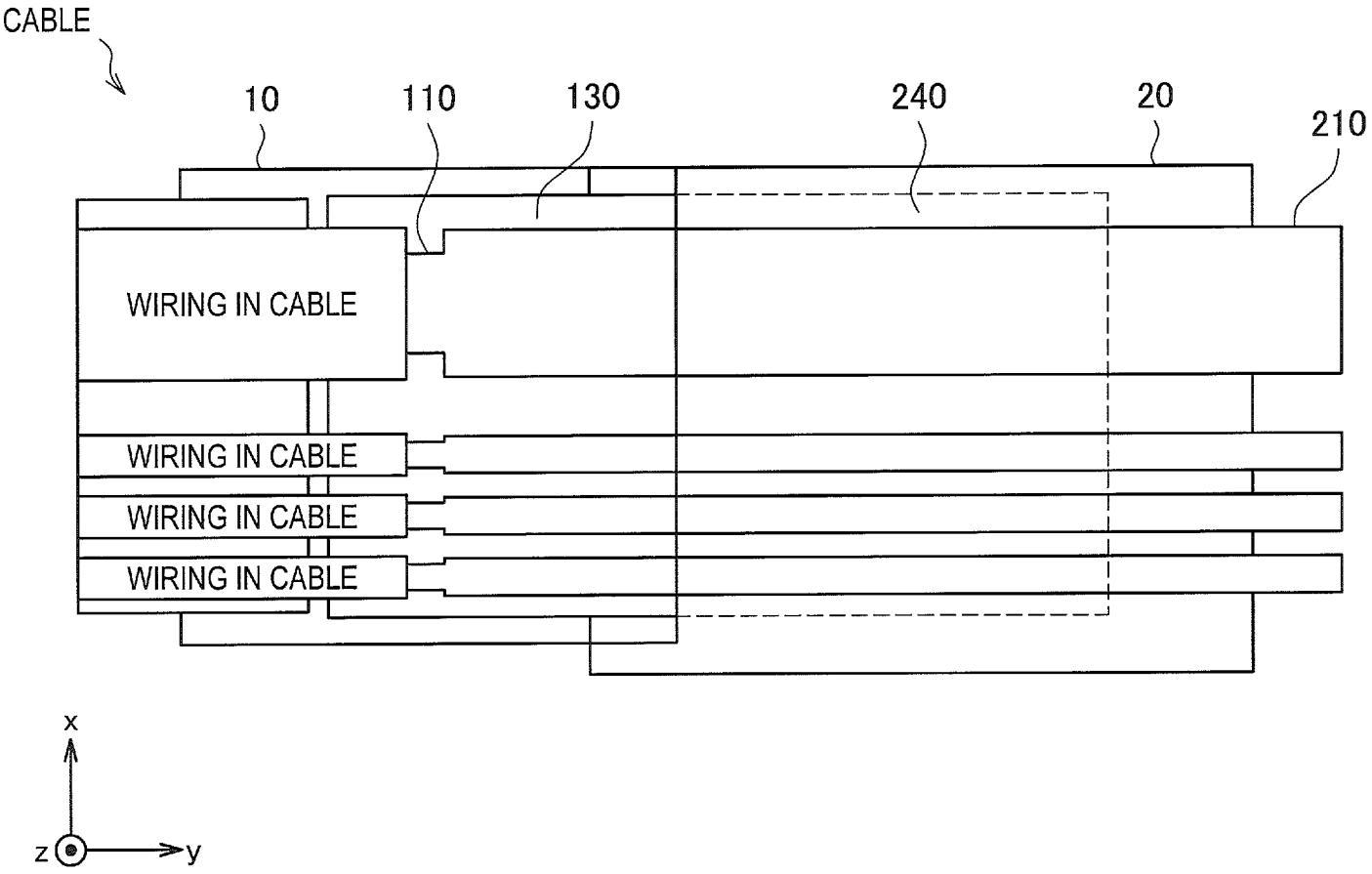
FIG. 16C is a schematic view of the connectors shown in FIG. 16A corresponding to an A-A cross section in FIG. 16B, the A-A cross section being constituted by an x axis and the y axis.

FIG. 16B is a schematic view showing a structural example of the connectors shown in FIG. 16A when being cut at a cross section constituted by a y axis and a z axis through signal pins. FIG. 16C is a schematic view of the connectors shown in FIG. 16A corresponding to an A-A cross section in FIG. 16B, the A-A cross section being constituted by an x axis and the y axis. FIGS. 16B and 16C correspond to the above-explained FIGS. 11A and 11B. Accordingly, a detailed explanation of the configuration already explained with reference to FIGS. 11A and 11B is omitted. In FIGS. 16 B and 16C, respective structural elements of the connector are schematically shown so as to simplify the explanation of the present modification.

In FIGS. 16B and 16C, outer shells of a plug-side connector and a receptacle-side connector are not shown so as to simplify the explanation. In addition, so as to simplify the explanation, FIG. 16C shows only the signal pins arranged at and near the signal pin that is positioned at the end part in the connector and whose cross-sectional area is expanded. Other signal pins are not shown in FIG. 16C.

With reference to FIGS. 16B and 16C, cross-sectional areas of signal pins 110 and 210 to which the HPD signals are applied are expanded in the plug-side connector 10 and the receptacle-side connector 20. The direction in which the cross-sectional areas of the signal pins 110 and 210 are expanded may be a direction toward the outer shell in the positive direction of the x axis as shown in FIGS. 16A and 16C, or may be the z axis direction as shown in FIG. 16B.

However, as shown in FIG. 16B, when the plug-side connector 10 and the receptacle-side connector 20 are fitted with each other, the width (height) of the signal pins 110 and 210 in the z axis direction is not changed at the fitting part, so as to keep the contact of the signal pin 110 of the plug-side connector and the signal pin 210 of the receptacle-side connector 20. Since the width (height) of the signal pins 110 and 210 in the z axis direction is not changed in the fitting part, connection between the connector to which the present modification is applied and a connector to which the present modification is not applied can be ensured.

With reference to FIG. 16B, the signal pin 110 of the plug-side connector 10 stretches in the negative direction of the y axis, and is connected to wiring in a cable. On the other hand, the signal pin 210 of the receptacle-side connector 20 stretches in the positive direction of the y axis, and is connected to a predetermined substrate in the receiving apparatus or the transmitting apparatus.

Thus, in the present modification, the cross-sectional area of the signal pin 110 is expanded in the plug-side connector 10, and the signal pin 110 is directly connected to the wiring in the cable. In addition, the cross-sectional area of the signal pin 210 is expanded in the plug-side connector 20, and the signal pin 210 is connected to the substrate in the apparatus.

As explained above, the cross-sectional area of the signal pin 110 is expanded in the present modification. Accordingly, it is possible to flow larger current through the signal pin while attenuation is suppressed more, and reliability of the connector is improved. Here, the HPD signal pin and the power signal pin are power-supply-voltage application pins to which +5V power-supply voltage is applied. As explained above, more effect of the present modification can be obtained by applying the present modification to the power-supply-voltage application pin to which relatively high voltage is applied, such as the HPD signal pin and/or the power signal pin.

In addition, as described in the following <5. Application Example>, apparatuses connected via an HDMI connector are able to have a function of supplying power to each other by using the signal pins. The present modification can be appropriately applied to signal pins serving as a power supply path during power supply between such apparatuses.

Figure 16D:
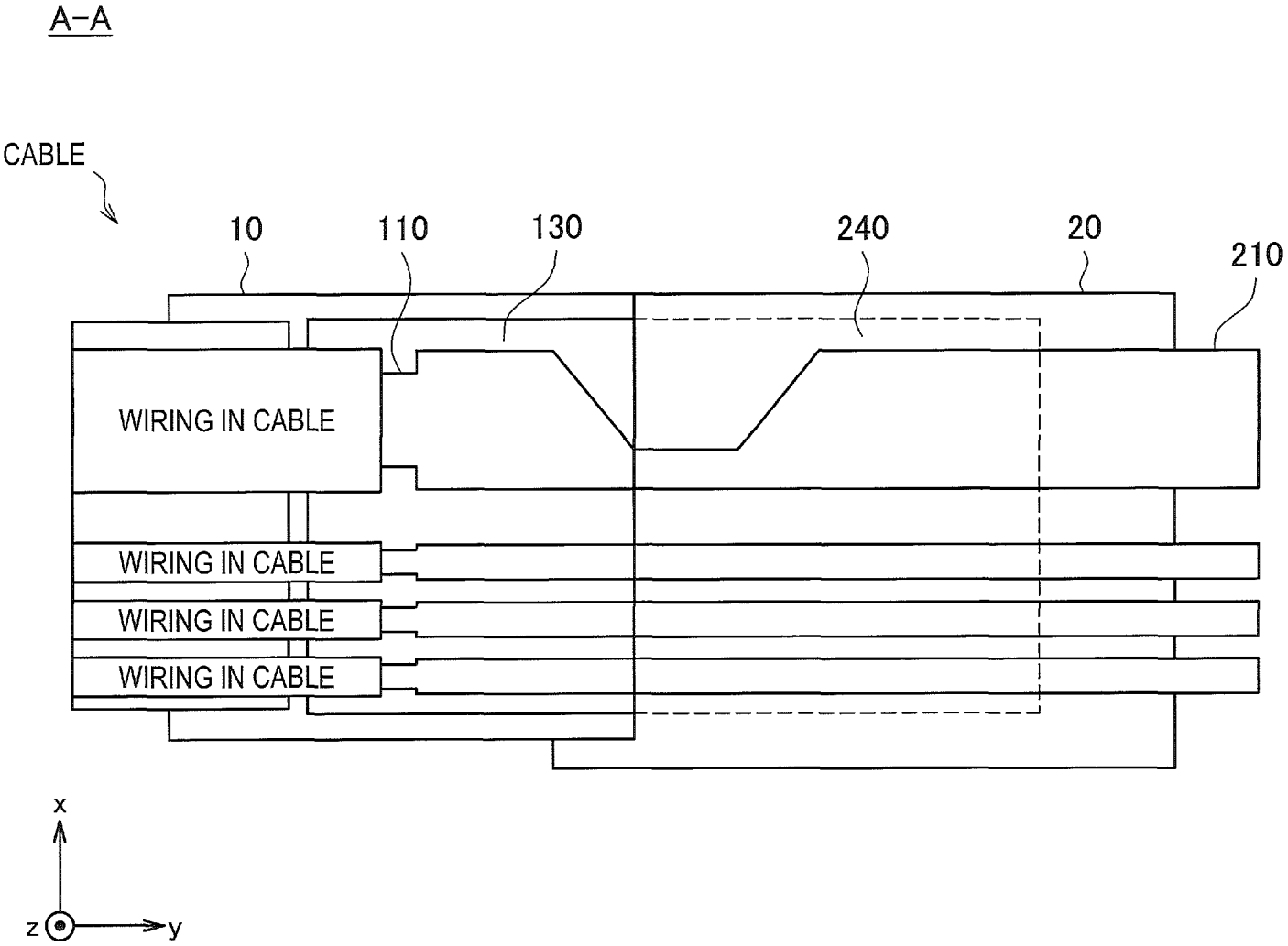
FIG. 16D is a schematic view showing a modification of the connectors corresponding to FIG. 16C, in which a cross-sectional area of a signal pin is expanded only in a region other than a fitting part.

Moreover, with regard to the modification of the connector according to the first embodiment of the present disclosure, cross-sectional areas of signal pins may be expanded only in a region other than the fitting part of the plug-side connector and the receptacle-side connector. FIG. 16D shows a modification in which wiring width of signal pins are expanded only in a region other than a fitting part of a plug-side connector and a receptacle-side connector. FIG. 16D is a schematic view showing a modification, in which cross-sectional areas of a signal pins are expanded only in a region other than the fitting part, of the connectors corresponding to FIG. 16C.

With reference to FIG. 16D, in a fitting part, cross-sectional areas of a signal pin 110 of the plug-side connector 10 and a signal pin 210 of the receptacle-side connector 20 is not changed also in the x axis direction. Thus, the fitting part secures dimension and shape of the signal pins according to the standard to which the connectors belong, and connection to a general connector conforming to the same standard is also secured.

[4.2. Mounting of Device on Substrate]

As shown in FIGS. 4A to 4C and FIGS. 11A to 11C, the connectors according to the first embodiment and the second embodiment of the present disclosure include substrates 130, 230, 330, and 430 in the connectors. As described above, the signal pins 110, 210, 310, and 410 are formed on front surfaces of the substrate 130, 230, 330, and 430. However, free regions in which the signal pins 110, 210,310, and 410 are not formed also exist. With regard to the connectors according to the first embodiment and the second embodiment of the present disclosure, various kinds of devices (circuits) that act on transmission of signals in the signal pins may be mounted in the free regions in the front surfaces of the substrates 130, 230, 330. 430.

With reference to FIGS. 17 and 18A to 18C, a modification in which various kinds of devices are mounted on substrates is explained. Note that, in the following explanation with reference to FIGS. 17 and 18A to 18C, the connectors according to the first embodiment of the present disclosure are used as an example. However, the present modification can also be applied to the connectors according to the second embodiment of the present disclosure.

Figure 17:
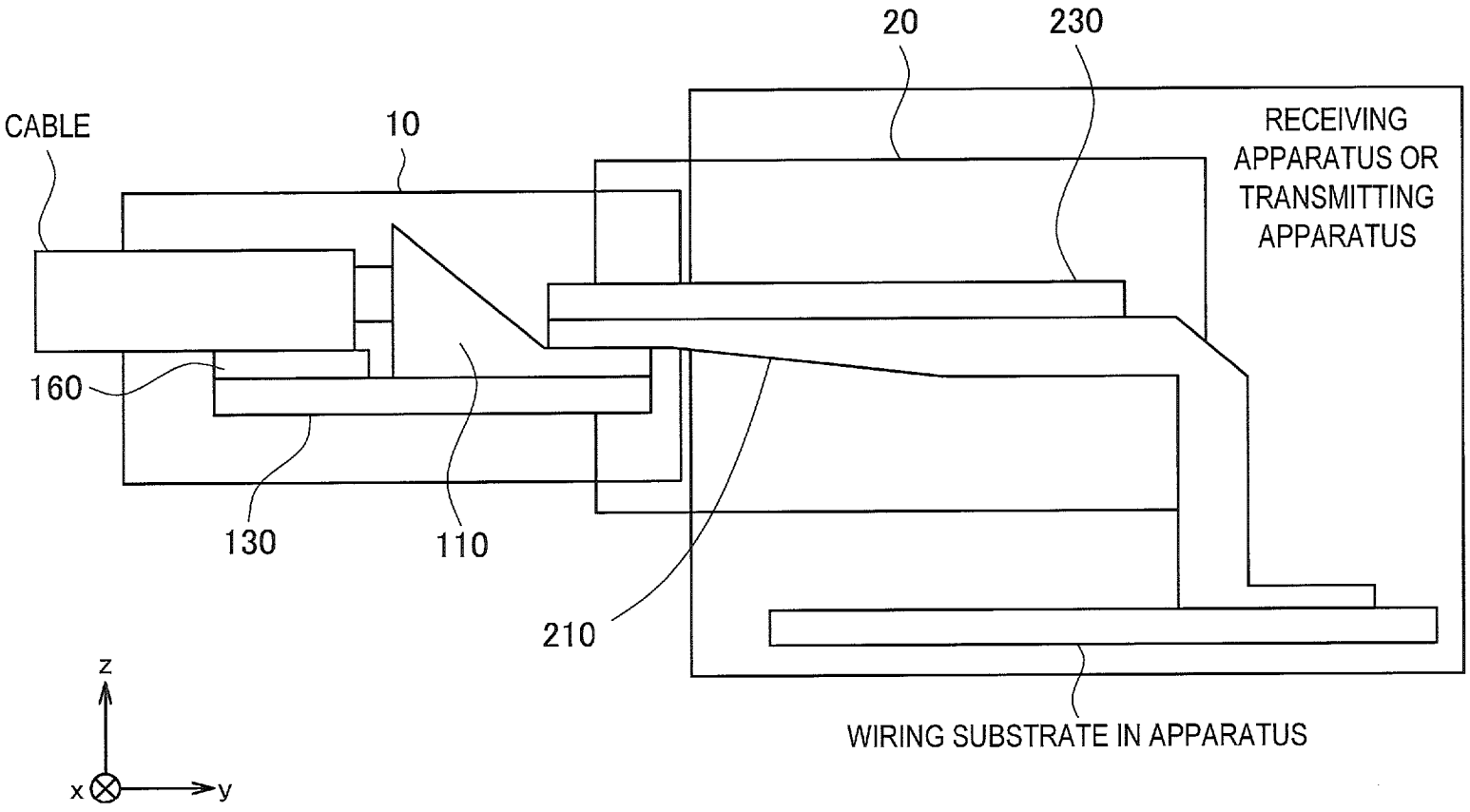
FIG. 17 is a schematic view in which devices are provided on substrates in the connectors according to the first embodiment.

In FIG. 17, various kinds of devices (circuits) are mounted in free regions of front surfaces of the substrates of the connectors according to the first embodiment of the present disclosure. FIG. 17 is a schematic view in which a device is provided on a substrate in the connector according to the first embodiment of the present disclosure.

As shown in FIG. 17, a device 160 that acts on transmission of signals in the signal pins 110 may be mounted in the region in which the signal pins 110 are not formed (free region) in the front surfaces of the substrate 130 in the plug-side connector 10. On the other hand, a device that acts on transmission of signals in the signal pins 210 may be mounted in the region in which the signal pins 210 are not formed (free region) in the front surfaces of the substrate 230 in the receptacle-side connector 20, although the device is not shown in FIG. 17.

Hereinafter, a specific configuration example of the devices provided in the free regions of the substrates 130 and 230 according to the present modification is explained with reference to FIGS. 18A to 18C.

For example, an AC/DC conversion circuit that converts AC transmission into DC transmission of signals to be transmitted by the signal pins may be provided in the free regions of the front surfaces pf the substrates 130 and 230. FIG. 18A shows an example of a circuit configuration of such AC/DC conversion circuit. FIG. 18A is a schematic view showing an example of a circuit configuration of an AC/DC conversion circuit that is a device according to modifications of the first embodiment and the first embodiment of the present disclosure.

Figure 18A:
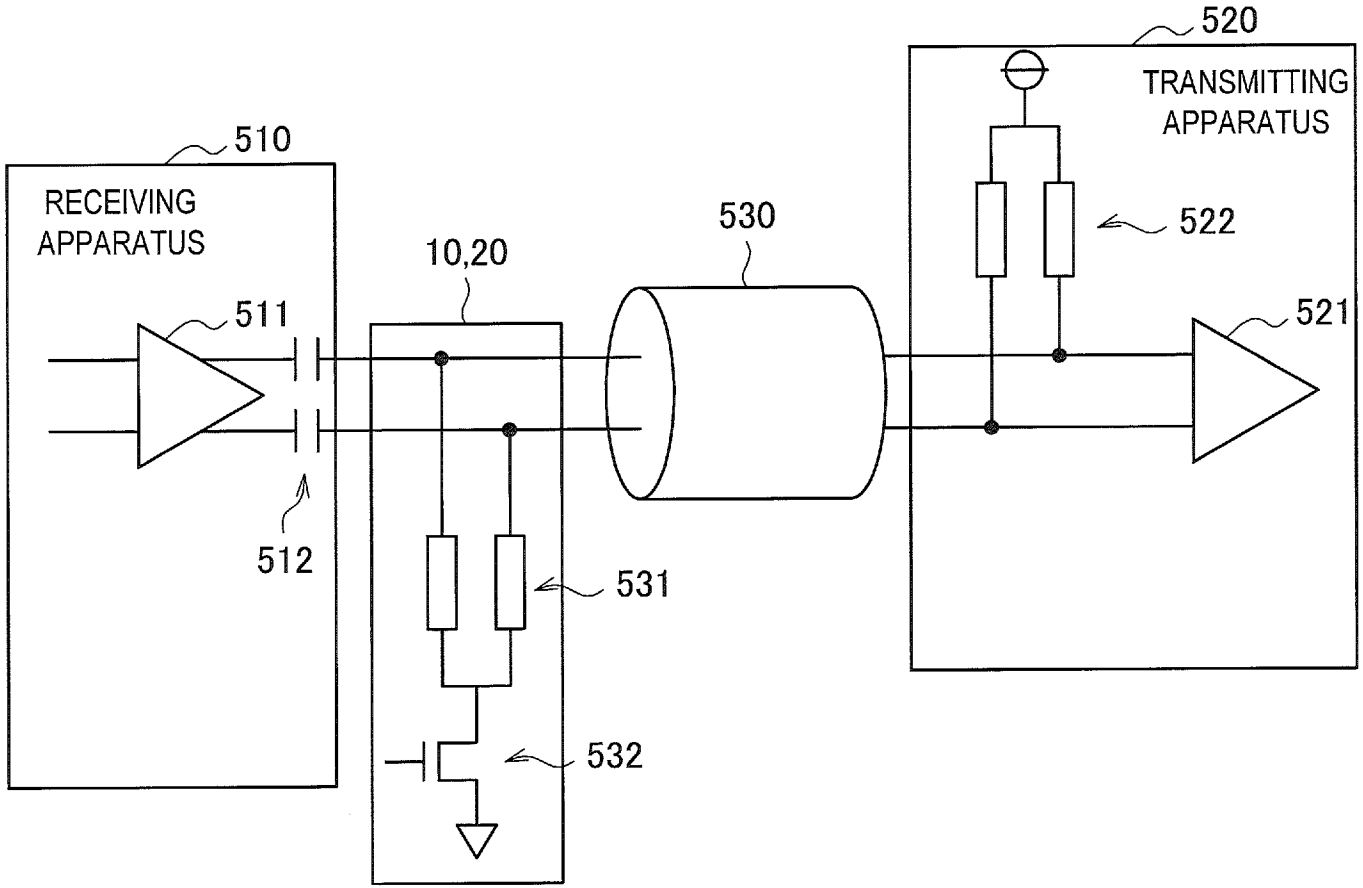
FIG. 18A is a schematic view showing an example of a circuit configuration of an AC/DC conversion circuit that is a device according to modifications of the first embodiment and the second embodiment.

With reference to FIG. 18A, for example, a data transmitting apparatus 510 that performs AC coupling transmission and a data receiving apparatus 520 that performs DC coupling transmission are connected via a cable 530. The data transmitting apparatus 150 includes a differential driver 511 and a DC component removal filter (capacitor) 512, and can transmit a predetermined DC signal generated by the differential driver 511 to the data receiving apparatus 520 that is a connection partner, via the DC component removal filter 512.

The data receiving apparatus 520 includes a differential receiver 521 and a pull-up register 522 for DC bias, and can receive the DC signal transmitted from the data receiving apparatus 520.

Here, connectors 10 and 20 are provided between the data transmitting apparatus 510 and the cable 530. In addition, registers 531 for generating common-mode voltages and a switch 532 are provided in free regions of substrates 130 and 230 of the connector 10 and 20.

The registers 531 for generating common-mode voltages are voltage shift registers for removing, by using the AC coupling transmission, a common-mode component which occurs in bias voltage applied by the pull-up register 522 for DC bias of the receiving device. The switch 532 causes the registers 531 for generating common-mode voltages to operate as terminators for reducing output voltage to 0 level, while the signal transmission is not performed.

As explained above, since a circuit such as a level shift register is provided in the free regions of the substrates 130 and 230 of the connectors 10 and 20, a function of ensuring the compatibility for performing the AC coupling transmission with regard to a DC coupling interface in the cable is achieved, necessity for mode conversion in the transmitting apparatus and the receiving apparatus is removed, and connection of the transmitting apparatus and the receiving apparatus is facilitated.

Alternatively, for example, a register holding information on characteristics of signals to be transmitted by signal pins and a communication circuit may be provided in the free regions of the front surfaces of the substrates 130 and 230, the communication circuit notifying any apparatus connected via the connector of the information held by the register. An example of configurations of such register and communication circuit is shown in FIG. 18B. FIG. 18B is a schematic view showing an example of configurations of the register and the communication circuit that are devices according to modifications of the first embodiment and the second embodiment of the present disclosure.

Figure 18B:
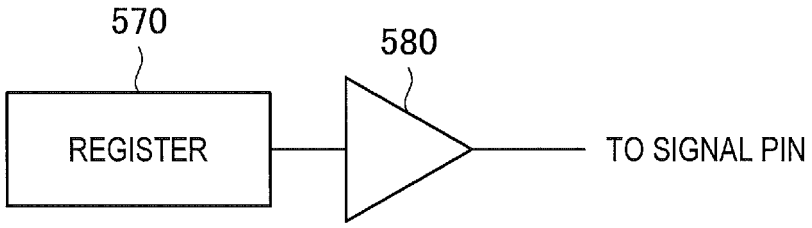
FIG. 18B is a schematic view showing an example of configurations of a register and a communication circuit that are devices according to modifications of the first embodiment and the second embodiment.

With reference to FIG. 18B, a capability register 570 and a communication circuit 580 may be provided in the free regions of the front surface of the substrates 130 and 230. The capability register 570 has information on characteristics of signals transmitted by the signal pins 110 and 210. The information on characteristics of signals transmitted by the signal pins 110 and 210 may be information on bands of the signals, for example. Thus, the capability register 570 can hold information on performance and characteristics of the connector (cable) in which the capability register 570 is mounted.

Via the signal pins 110 and 210, the communication circuit 580 can notify a connection partner apparatus of the information on the characteristic of the signal that the capability register 570 holds. The communication circuit 580 may be an I2C circuit, for example. However, a kind of the communication circuit 580 is not specifically limited, and every known communication circuit may be used.

As described above, since the register and the communication circuit are provided in the connectors, the connection partner apparatus can be notified of the information on performance and characteristics of the connectors (cable) via the communication circuits, the information being held by the register. Accordingly, it is possible to decide a data transmission method in accordance with the characteristics of the cable between the apparatuses connected via the connectors, and more secure data transmission with less transmission deterioration is achieved.

In addition, the capability register 570 may hold authentication data of the connector (cable) in which the capability register 570 is mounted. By using the authentication data, it can be determined whether the connector and the cable are official products between apparatuses connected via the connector.

In addition, memory may be mounted in the free regions of the front surface of the substrates 130 and 230. The memory may temporarily store various kinds of information on data transmission. Since the memory is mounted in the connector, temporal communication using the information stored in the memory is possible between the apparatuses connected via the connector.

For example, a battery for supplying a power signal may be provided in the free regions of the surfaces of the substrates 130 and 230. An example of a configuration of such battery is shown in FIG. 18C. FIG. 18C is a schematic view showing an example of a configuration of a battery that is a device according to modifications of the first embodiment and the second embodiment of the present disclosure.

Figure 18C:
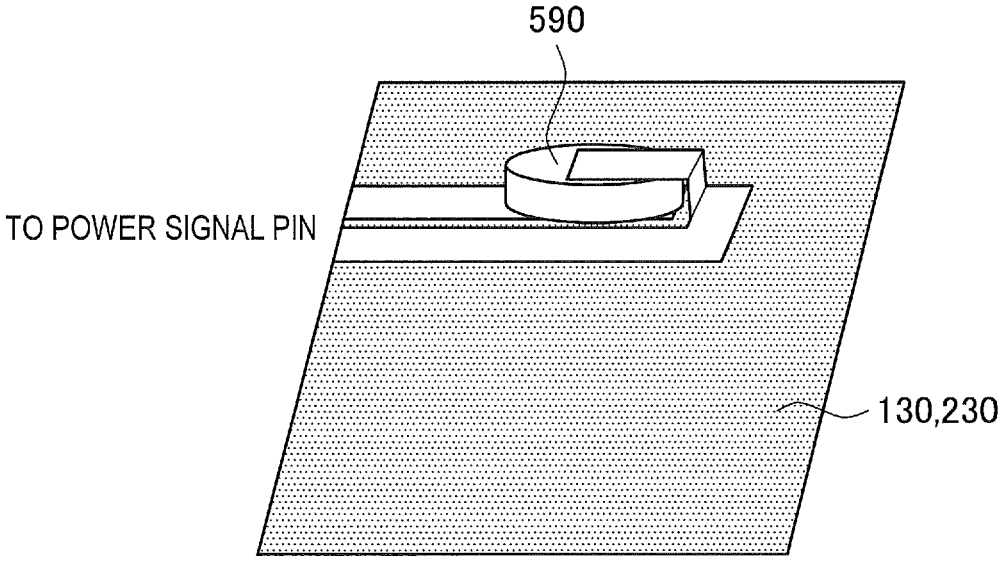
FIG. 18C is a schematic view showing an example of a configuration of a battery that is a device according to modifications of the first embodiment and the second embodiment.

As shown in FIG. 18C, a battery 590 is mounted in the free region of the front surfaces of the substrates 130 and 230. Voltage corresponding to power-supply voltage may be supplied from the battery 590 to at least any one of the signal pins 110 and 210. Since the battery 590 is mounted in the free region of the front surface of the substrates 130 and 230 and supplies power, the apparatus connected via the connector in which the battery 590 is mounted can execute only a minimal function, for example, in a case where the power supply from the apparatus is stopped due to some kind of trouble.

The battery 590 may be a rechargeable secondary battery. In the case where the battery 590 is a secondary battery, the battery 590 may be charged by power supply from the apparatus connected via the connector in which the battery 590 is mounted.

Note that, an equalizer corresponding to the characteristics of the connector (cable) may be provided in the free region of the front surface of the substrates 130 and 230.

Since the equalizer is provided in the free region of the front surfaces of the substrates 130 and 230, more stable data transmission can be achieved.

The modification in which various kinds of devices are mounted on the substrates in the connectors according to the first embodiment and the second embodiment of the present disclosure has been described. By mounting the various kinds of devices in the free regions of the substrates, the connectors themselves can perform various kinds of signal processing. Accordingly, it is possible to simplify the signal processing in the transmitting apparatus and the receiving apparatus that are connected via the connectors.

Note that, the above-explained device is an example of devices to be mounted on the substrates. The connectors according to the first embodiment and the second embodiment of the present disclosure are not limited thereto, and any device can be mounted.

5. Application Example

Next, an application example of the connectors according to the first embodiment and the second embodiment of the present disclosure to a data receiving apparatus and/or a data transmitting apparatus is explained.

Diverse applications have been developed with regard to communication between apparatuses that use HDMI interfaces. The connectors according to the first embodiment and the second embodiment of the present disclosure can be suitably applied to various kinds of applications with regard to communication between apparatuses that use the HDMI interfaces. In the following, "CEC control" and "power supply control" are used as examples of the applications in the communication between the apparatuses that use the HDMI interfaces. Note that, the connectors according to the first embodiment and the second embodiment of the present disclosure are not limited thereto, and can be applied to all other applications with regard to communication between the apparatuses that use the HDMI interfaces.

[5.1. CEC Control]

First, the CEC control is explained. In a transmission line of the HDMI standard, a line that is capable of bi-directionally transmitting control data and that is referred to as a Consumer Electrics Control (CEC) line is prepared for control between a source device and a sink device, in addition to a video data transmission line. By using the CEC line, it is possible to control a partner's device. In addition, when executing the CEC control, it is possible to automatically perform whether control using a CEC line of a HDMI cable can be executed, in a device on the basis of processing performed at connection authentication using a DDC line.

In the following explanation of the CEC control, a case where the source device is a disk recorder and the sink device is a television receiver is used as a specific example. The disk recorder and the television receiver include the connectors according to the first embodiment or the second embodiment of the present disclosure, as receptacle-side connectors. In addition, an HDMI cable for connecting the disk recorder and the television receiver includes the connector according to the first embodiment or the second embodiment of the present disclosure, as a plug-side connector.

Figure 19:
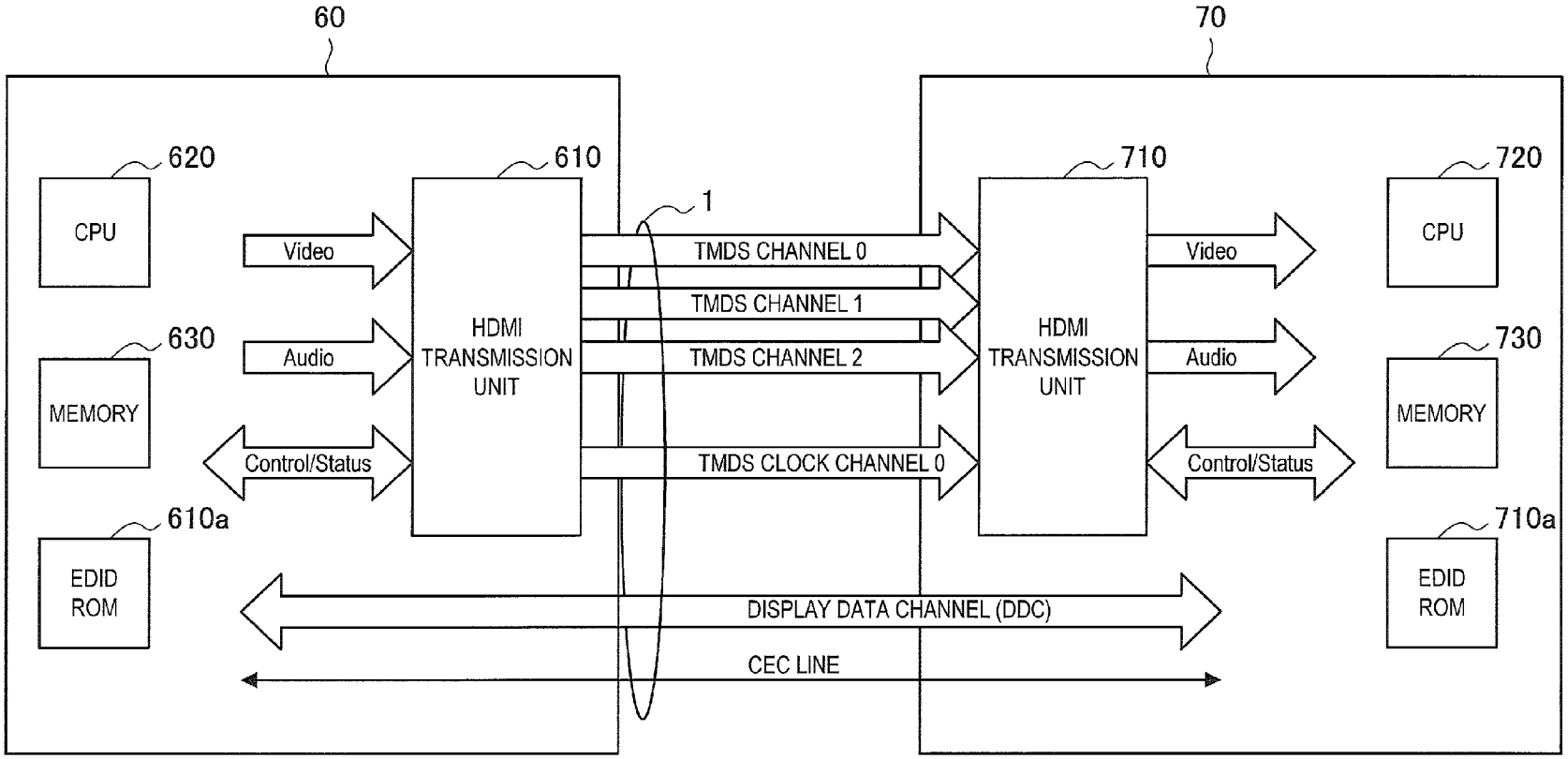
FIG. 19 is an explanatory diagram illustrating a data configuration example of each channel transmitted between a disk recorder and a television receiver by an HDMI cable.

First, with reference to FIG. 19, a data configuration example of each channel transmitted between a disk recorder 60 and a television receiver 70 via an HDMI cable 1 is explained. In the HDMI standard, three channels including a channel 0 (Data0), a channel 1 (Data1), and a channel 2 (Data2) are prepared as channels for transmitting video data, and a clock channel (clock) for transmitting pixel clock is further prepared. In addition, a DDC and CEC are prepared as a power transmission line and a control-data transmission channel. The Display Data Channel (DDC) is mainly a data channel for display control, and Consumer Electrics Control (CEC) is mainly a data channel for transmitting control data used for controlling a partner's device connected via the cable.

Configurations of respective channels are explained. The channel 0 transmits pixel data of B data (blue data), vertical synchronization data, horizontal synchronization data, and auxiliary data. The channel 1 transmits pixel data of G data (green data), two kinds of control data (CTL0 and CTL1), and auxiliary data. The channel 2 transmits pixel data of R data (red data), two kinds of control data (CTL2 and CTL3), and auxiliary data. Note that, under the HDMI standard, primary color data that is subtractive mixture of cyan, magenta and yellow can be transmitted instead of the blue data, the green data, and the red data.

The CEC serving as the control data transmission channel is a channel in which data transmission is bi-directionally performed at a clock frequency lower than the channels (channels 0, 1, and 2) for transmitting the video data.

A configuration of data to be transmitted by channels (channel 0, channel 1, channel 2, clock channel, and DDC) other than the CEC is identical to a configuration of data to be transmitted through an HDMI scheme in practical use.

The source device 60 and the sink device 70 include HDMI transmission units 610 and 710 for performing data transmission, and EDID ROM 610*a* and 710 a serving as storage units for storing Enhanced Extended Display Identification Data (E-EDID) information. The E-EDID information stored in the EDID ROM 610*a* and 710*a* is information in which a format of video data (that is, displayable or recordable data) treated by devices is written. However, in the present example, the E-EDID information is expanded, and information on details of the devices, specifically, control function corresponding information is stored. In a case where connection via the HDMI cable 1 is detected in the present example, storage information of E-EDID ROM 610*a* or 710*a* of the partner's devices is read out, and collation of the E-EDID information is performed.

The source device 60 and the sink device 70 include CPUs 620 and 720 that are control units for performing operation control of the entire source device 60 and the entire sink device 70. In addition, the source device 60 and the sink device 70 include memory 630 and 730 for temporarily storing programs to be executed by the CPUs 620 and 720 and various kinds of information to be processed by the CPUs 620 and 720. Data to be transmitted via the DDC line and the CEC line of the HDMI cable 1 is transmitted and received under control of the CPUs 620 and 720.

Figure 20:
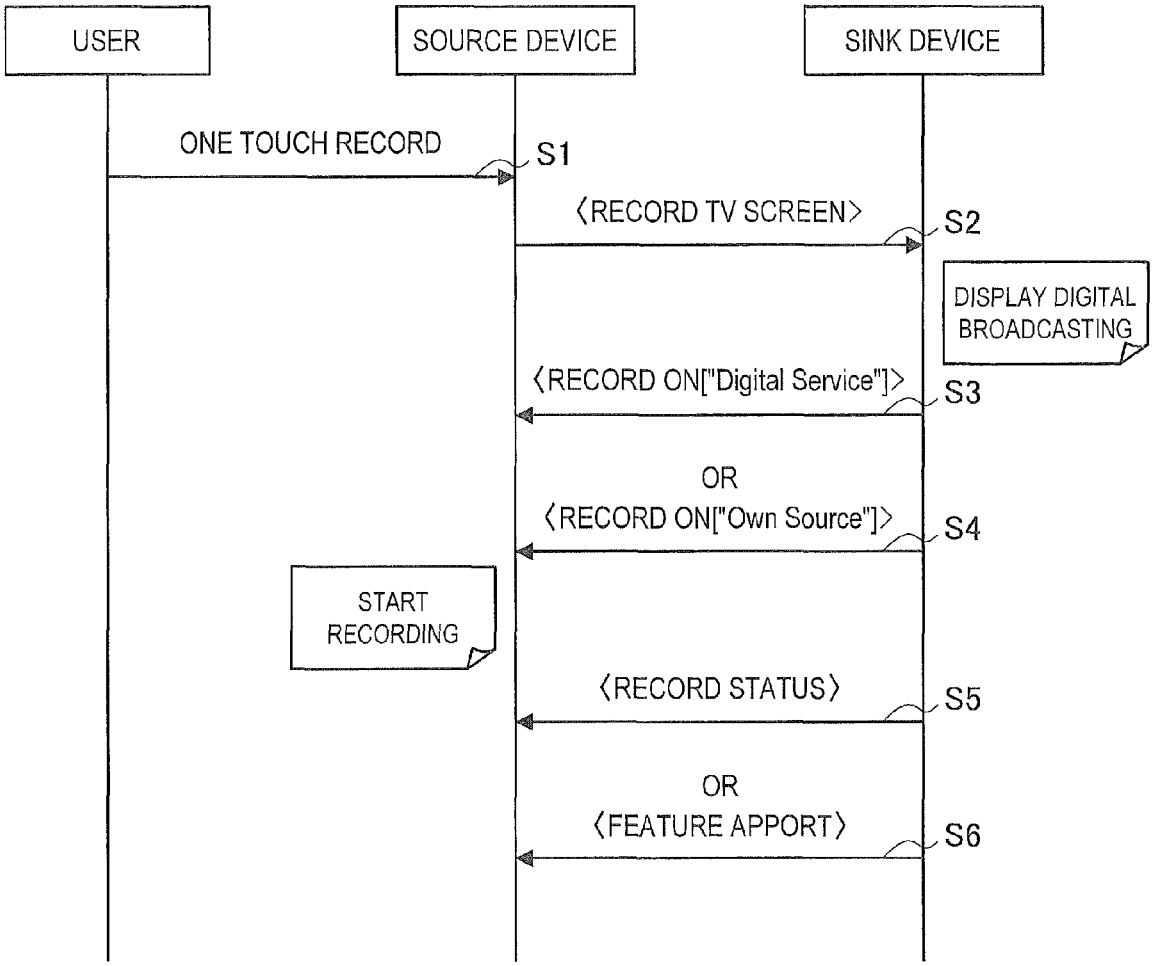
FIG. 20 is a sequence diagram showing a sequence example of CEC control in a case where a source device and a sink device are connected.

Next, FIG. 20 shows a sequence example of the CEC control in a case where the source device and the sink device are connected. Here, "Record TV Screen" that is an optional function based on the CEC standard is used for an explanation.

When a user's operation gives an instruction of content for executing program recording of a same channel as a screen of the television receiver, to the disk recorder that is the source device connected via the HDMI cable 1 (Step S1), the source device transmits a "Record TV Screen" command to the sink device via the CEC line, and gives a request to the sink device (Step S2).

In response to the request in Step S2, the sink device replies service information of currently displayed digital broadcasting program (Step S3). Alternatively, the sink device replies information indicating that the source device is a video source (Step S4) in a case where the program that is being displayed by the sink device is input from the source device via the HDMI cable 1. In response to the reply in Step S3 or S4, the source device returns a status of recording execution to the sink device (Step S5), or returns a massage that the function is not executed to the sink device (Step S6). Note that, it is also possible to perform the user operation in Step S1 on the sink device (television receiver).

Figure 21:
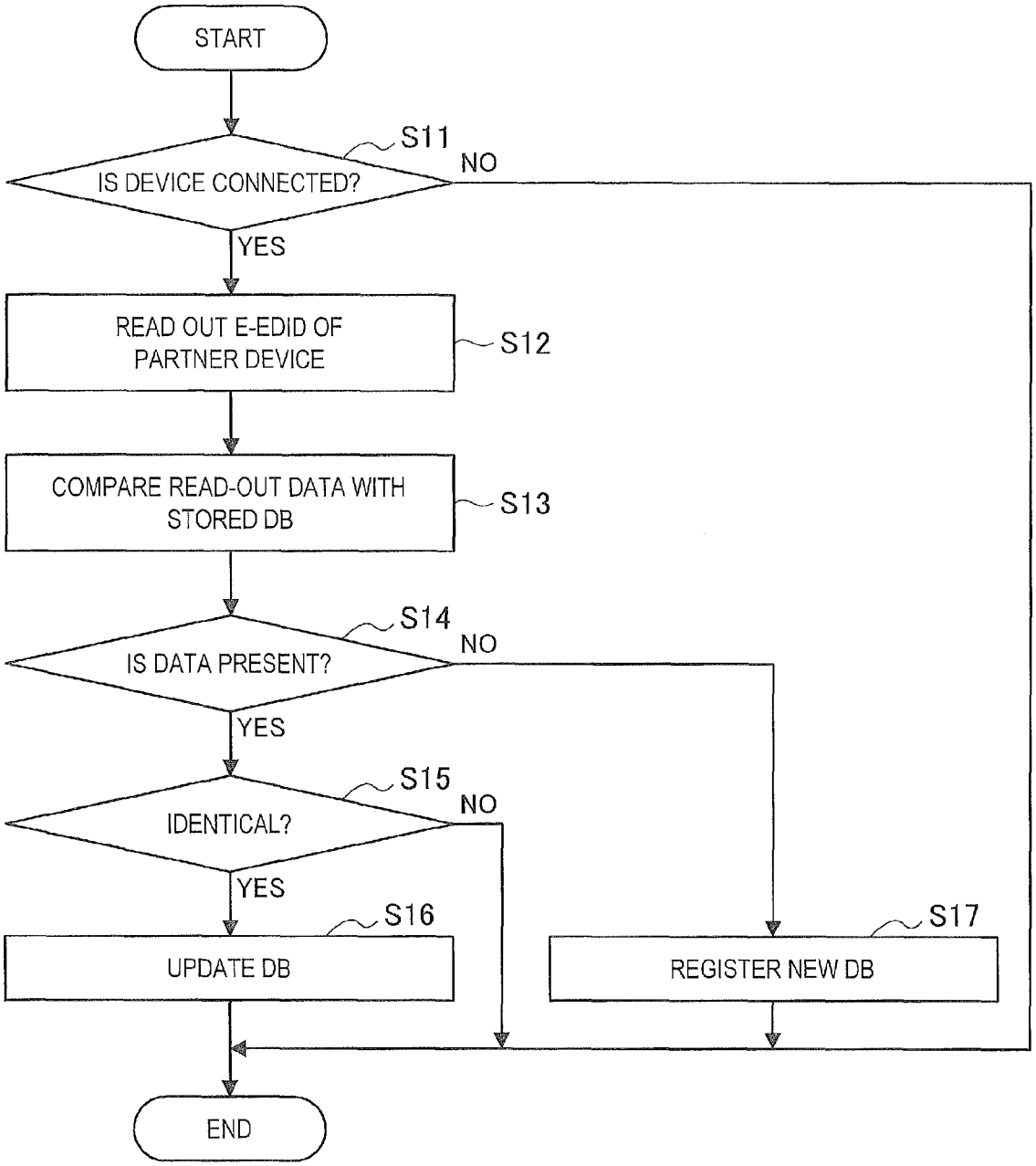
FIG. 21 is a flowchart showing a CEC compliance check procedure in each device in a case where devices connected via an HDMI cable are detected.

Next, with reference to the flowchart in FIG. 21, a process example when devices are connected via the HDMI cable 1 is explained.

FIG. 21 shows a CEC compliance check process procedure in each device in a case where the device connected via an HDMI cable is detected. In the present example, the check process is performed by both the source device and the sink device.

The process of the flowchart in FIG. 21 is explained. As a function decided by the HDMI status, there is a function referred to as hot plug detect. The function detects connection between the source device and the sink device since the source device observes voltage of an HPD terminal pulled up to a power source of +5V in the sink device, the voltage being transmitted from the source device, and the voltage becomes "H" voltage when the source device is connected to the HDMI connector.

By using the function, it is determined whether a device is connected via the HDMI cable 1 (Step S11). In a case where the device connection has not been detected, the process ends. In a case where the device connection has been detected, E-EDID data stored in EDID ROM of a partner device is read out using the DDC line (Step S12). Subsequently, the read-out data is compared with E-EDID database stored in the own device (Step S13).

On the basis of the comparison, it is determined whether (Step S14). In a case where the data is not present, the device is determined to be a newly connected device, and the newly read-out E-EDID data is registered in the database (Step S17). In a case where the data is present, it is subsequently determined whether the data are identical to each other (Step S15). In a case where the data are identical to each other, it is determined that a CEC compliance of the partner device is not changed. Accordingly, the process ends. In a case where the data are different, a new data is overwritten and updated in the database storing the read-out data (Step S16), and the process ends. As described above, it is possible to recognize the latest CEC compliance status since each device reads out E-EDID data of each connected device.

With reference to FIGS. 19 to 21, the example of the CEC control of communication between the devices using the HDMI interface has been explained. When the connectors according to the first embodiment and the second embodiment of the present disclosure are used for connectors of the source device 60, the sink device 70 and the HDMI cable 1, it is possible to reduce the deterioration in signals even if larger amounts of data are transmitted at higher speed. Thus, more reliable CEC control can be performed.

Note that, details of the CEC control can be referred to by JP 4182997B.

[5.2. Power Supply Control]

Next, the power supply control is explained. In the HDMI standard, power-supply voltage and electric current are prescribed so as to supply power to a device connected via an HDMI connector. For example, under the HDMI standard, +5V power can be supplied from the source device to the sink device by 55 mA at a minimum and by 500 mA at a maximum. In addition, with regard to the receiving apparatus and the transmitting apparatus that are connected via the HDMI connector, the transmitting apparatus transmits, to the receiving apparatus, request information for requesting power supply. According to the transmitting of the request information, the receiving device can supply power to an internal circuit in the transmitting apparatus via the HDMI cable.

Note that, in the following explanation of power supply, the source device and the sink device include the connectors according to the first embodiment or the second embodiment of the present disclosure, as receptacle-side connectors. In addition, the HDMI cable for connecting the source device and the sink device includes the connectors according to the first embodiment or the second embodiment of the present disclosure, as plug-side connectors.

Figure 22:
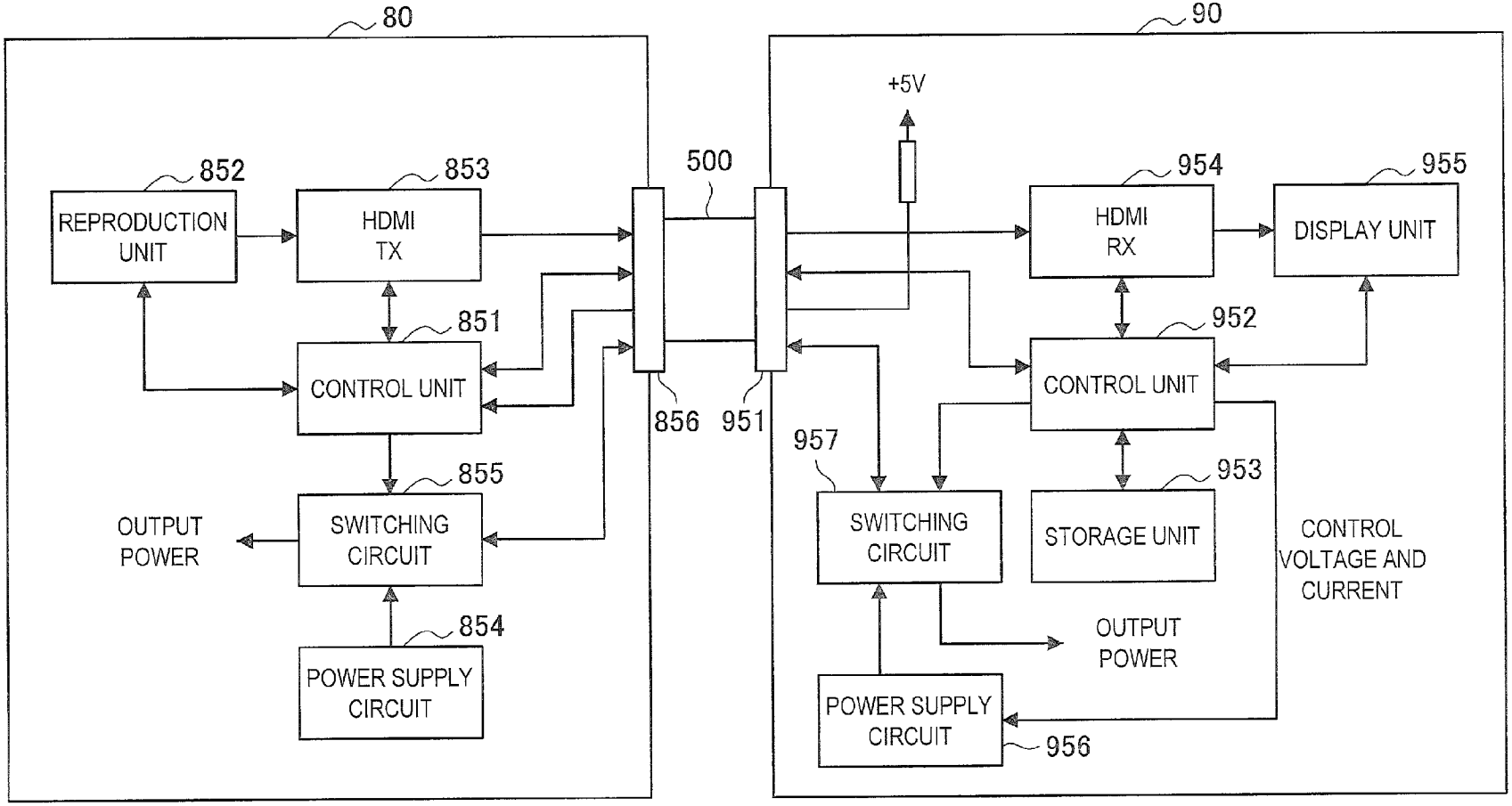
FIG. 22 is a functional block diagram showing a configuration example of a communication system including a source device and a sink device, in power supply control.
Figure 23:
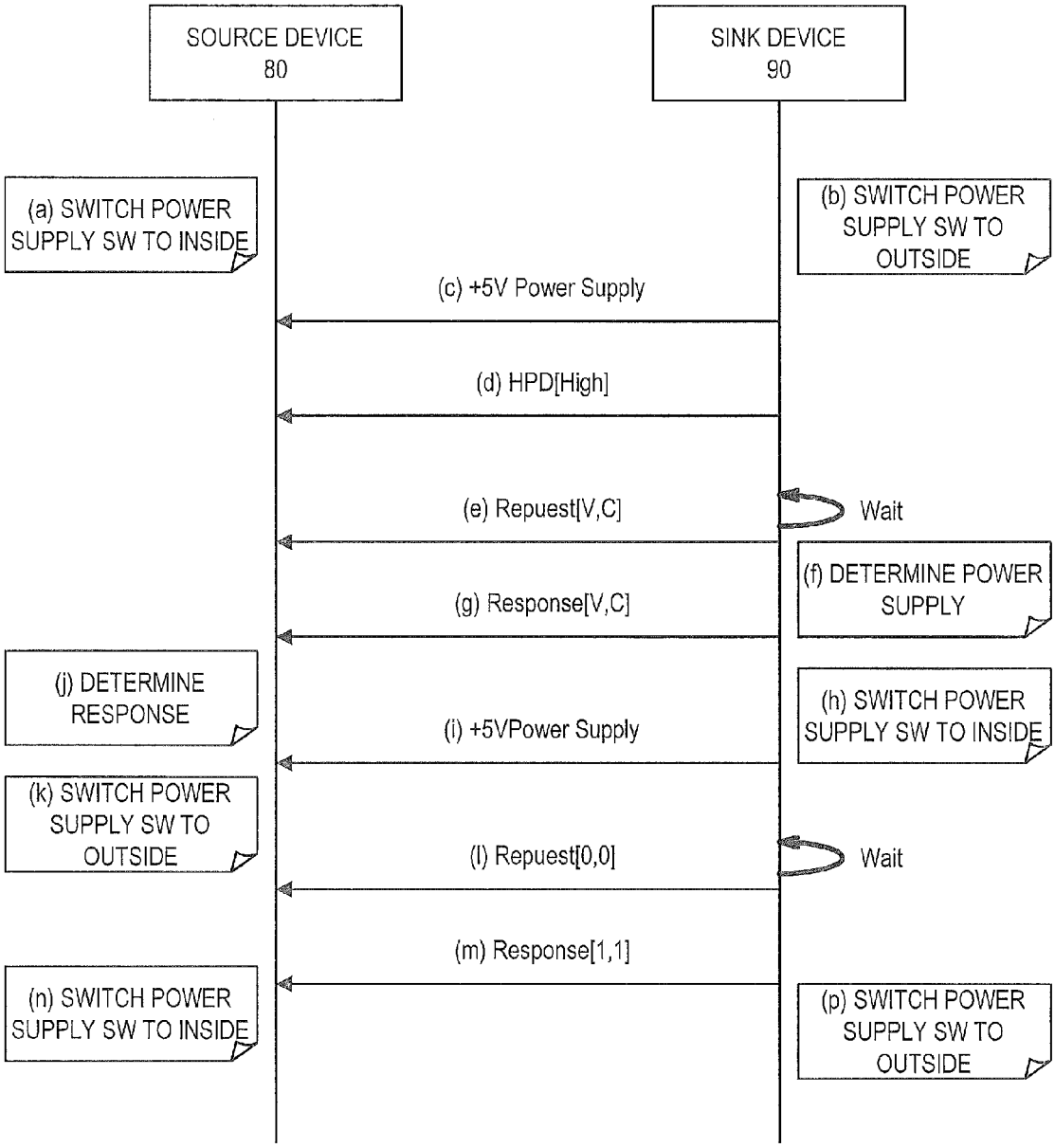
FIG. 23 is a sequence diagram showing a control sequence in power supply control.

Here, with reference to FIGS. 22 and 23, an embodiment of power supply control is explained. FIG. 22 shows a configuration example of a communication system as an embodiment.

The communication system includes a source device 80 and a sink device 90. The source device 80 and the sink device 90 are connected via an HDMI cable 500. For example, although an imaging unit and a recoding unit are not shown in FIG. 22, the source device 80 is a battery-powered mobile device such as a digital camera recorder or a digital still camera, and the sink device 90 is a television including a power supply circuit with sufficient performance.

The source device 80 includes a control unit 851, a reproduction unit 852, an HDMI transmitter (HDMI source) 853, a power supply circuit 854, a switching circuit 855, and HDMI connector 856. The control unit 851 controls operation of the reproduction unit 852, the HDMI transmitter 853, and the switching circuit 855. From a recording medium (not shown), the reproduction unit 852 reproduces a baseband image data (uncompressed video signals) of predetermined content and audio data (audio signals) attached to the image data, and supplies to the HDMI transmitter 853. The control unit 851 controls selection of reproduction content in the reproduction unit 852 on the basis of a user's operation.

Through communication compliant with the HDMI, the HDMI transmitter (HDMI source) 853 transmits the baseband image and audio data that are supplied from the reproduction unit 852 from the HDMI connector 856 to the sink device 90 in one direction via the HDMI cable 500.

The power supply circuit 854 generates power to be supplied to the internal circuit of the source device 80 and the sink device 90. The power supply circuit 854 is, for example, a battery circuit that generates power from a battery. The switching circuit 855 selectively supplies the power generated by the power supply circuit 854 to the internal circuit and the sink device 90, and selectively supplies the power supplied from the sink device 90 to the internal circuit. The switching circuit 855 constitutes a power supply unit and a power switching unit.

The sink device 90 includes an HDMI connector 951, a control unit 952, a storage unit 953, an HDMI receiver (HDMI sink) 954, a display unit 955, a power supply circuit 956, and a switching circuit 957. The control unit 952 controls operation of the HDMI receiver 954, the display unit 955, the power supply circuit 956, and the switching circuit 957. The storage unit 953 is connected to the control unit 952. The storage unit 953 stores information necessary for control performed by the control unit 952, such as Enhanced extended display identification (E-EDID).

Through communication compliant with the HDMI, the HDMI receiver (HDMI sink) 954 receives the baseband image and audio data that are supplied to the HDMI connector 951 via the HDMI cable. The HDMI receiver 954 supplies the received image data to the display unit 955. In addition, the HDMI receiver 954 supplies the received audio data, for example, to a speaker (not shown). Details of the HDMI receiver 954 are described later.

The power supply circuit 956 generates power to be supplied to the internal circuit of the sink device 90 and the source device 80. The power supply circuit 956 is, for example, a power supply circuit with sufficient performance for generating power (AC power) from an AC power. The switching circuit 957 selectively supplies power generated in the power supply circuit 956 to the internal circuit and the source device 80, and selectively supplies power to be supplied from the source device 80 to the sink device 90 to the internal circuit. The switching circuit 957 constitutes a power supply unit.

Next, with reference to FIG. 23, a control sequence in power supply control is explained.

With reference to FIG. 23, first, (a) the switching circuit 855 of the source device 80 is switched to a state in which power from the power supply circuit 854 of the source device 80 is supplied to the internal circuit and the HDMI connector 856 of the source device 80. In addition, (b) the switching circuit 957 of the sink device 90 is switched to a state in which power from the power supply circuit 854 of the source device 80 is supplied to the internal circuit of the sink device 90 via the HDMI cable 500. When the sink device 90 is connected to the source device 80 via the HDMI cable 500 in the state of (a) and (b), (c) +5V power is supplied from the power supply circuit 854 of the source device 80 to the internal circuit of the sink device 90 via the HDMI cable 500. Note that, to the internal circuit of the source device 80, +5V power is supplied from the power supply circuit 854 of the source device 80.

(d) In this case, voltage of a pin 19 (HPID) of the HDMI connector of the sink device 90 becomes high, and correspondingly voltage of a pin 19 (HPD) of the HDMI connector 856 of the source device 80 becomes high. Thus, the control unit 851 of the source device 80 can recognize the connection to the sink device 90.

(e) Subsequently, on the basis of a user operation, information on remaining amount of battery constituting the power supply circuit 854, or the like, the source device 80 transmits a <Request Power Supply> command that is a power supply request, to the sink device 90 via the CEC line.

(f) The sink device 90 determines whether it is possible to supply a voltage value and a current value that are requested by the <Request Power Supply> command, and (g) transmits a <Response Power Supply> command that is a power supply response including a result of the determination to the source device 80 via the CEC line.

(h) In a case where it is possible to supply the requested voltage value and current value, the sink device 90 controls the voltage value and the current value of the power supply from the power supply circuit 956 in a manner that the voltage value and the current value of the power supply from the power supply circuit 956 correspond to the voltage value and the current value that have been requested by the source device 80, and switches the switching circuit 957 to a state in which the power from the power supply circuit 956 of the sink device 90 is supplied to the internal circuit and the HDMI connector 951 of the sink device 90. (i) Accordingly, power from the power supply circuit 956 of the sink device 90 is supplied to the source device 80 via the HDMI cable.

(j) The source device 80 determines the <Response Power Supply> command transmitted from the sink device 90. (k) In a case where a response indicates that supply is possible, the source device 80 switches the switching circuit 855 to a state in which power from the power supply circuit 956 of the sink device 90 is supplied to the internal circuit of the source device 80 via the HDMI cable 500. Thus, the power supplied from the sink device 90 is supplied to the internal circuit of the source device 80.

(l) Subsequently, when the power in the source device 80 becomes not necessary, the source device 80 transmits, to the sink device 90, a <Request Power Supply> command indicating that the power supply is not necessary. (m) The sink device 90 detects the <Request Power Supply> command, and returns a <Response Power Supply> command to the source device 80. (n) Correspondingly, the source device 80 puts the switching circuit 855 back to the state of (a), and (q) the sink device 90 puts the switching circuit 957 back to the state of (b). Accordingly, the power supply states of the source device 80 and the sink device 90 are put back to the initial states.

With reference to FIGS. 22 to 23, the power supply control in the communication between the devices using the HDMI interfaces has been explained. When the connector according to the first embodiment and the second embodiment of the present disclosure is used for connectors of the source device 80, the sink device 90 and the HDMI cable 500, it is possible to reduce the deterioration in signals even if larger amounts of data are transmitted at higher speed. Thus, more reliable power supply control can be performed. In addition, the reliability can be improved more by applying the modification explained in [4.1. Expansion of Cross-sectional Area of Signal Pin] to the signal pins used as the power supply path during the power supply control.

Note that, details of the power supply control can be referred to by JP 2009-44706A for example.

6. Conclusion

As explained above, in the connectors according to the first embodiment and the second embodiment of the present disclosure, signal pins are formed on the substrates formed of the dielectric, and the electric conductor layers having the ground potential are formed on the opposite sides of the substrate surfaces on which the signal pins are formed. According to such configuration, the microstripline is formed by the signal pins, the substrates and the electric conductor layers. Thus, it is possible to reduce effects of the current (signal) flowing through the signal pins, on other signal pins. In addition, the deterioration in signals can be reduced.

In addition, among the signal pins in the connectors according to the first embodiment and the second embodiment of the present disclosure, the intervals between the pairs of the signal pins that transmit differential signals and adjacently extend are shorter than the intervals from other signal pins adjacent to the pairs of the signal pins. According to such configuration, the differential stripline (differential strip structure) is formed by the pair of the signal pins having the short intervals. Thus, it is possible to reduce effects of the current (signal) flowing through the pair of the signal pins, on other signal pins. In addition, the deterioration in signals can be reduced. Moreover, since the intervals between the pairs of the signal pins are short, intervals from a different kind of adjacent signal wirings can be widen. Accordingly, the crosstalk can be reduced and signal quality can be improved.

Thus, the connectors according to the first embodiment and the second embodiment of the present disclosure can transmit data without deterioration in signals, even in the case of the pin arrangement in which data lines are newly added such as a pin arrangement in which data lines are newly allocated to a signal pin used as a shield and a signal pin used as a clock.

In addition, in the connectors according to the first embodiment and the second embodiment of the present disclosure, guard lines having ground potential may further extend at positions for sandwiching a signal pin in a manner that the guard lines are substantially parallel to the signal pin. According to such configuration, it is possible to reduce effects of the current (signal) flowing through the signal pins on other signal pins, and the deterioration in signals can be reduced.

Meanwhile, in the connector according to the first embodiment and the second embodiment of the present disclosure, the wiring intervals between the signal pins in the fitting part of the plug-side connector and the receptacle-side connector may be identical to the wiring intervals between the signal pins in the fitting part of the general HDMI connector. According to such configuration, it is possible to ensure compatibility between the connectors according to the first embodiment and the second embodiment of the present disclosure and the general HDMI connector. Thus, the user can connect apparatuses without considering types of connectors, and convenience of the user can be improved.

In addition, with regard to the connectors according to the first embodiment and the second embodiment of the present disclosure, cross-sectional areas of the signal pins may be expanded. According to such configuration, it is possible to flow larger current through the signal pins while attenuation is suppressed more, and reliability of the connectors is improved. With regard to the HDMI connector, more effect can be obtained by expanding cross-sectional areas of a HPD signal pin and a power supply signal pin to which power-supply voltage is applied.

In addition, substrates are provided inside the connectors according to the first embodiment and the second embodiment of the present disclosure. Accordingly, various kinds of devices (circuits) that act on transmission of signals in the signal pins can be mounted on the substrates. According to such configuration, the connectors themselves can perform various kinds of signal processing. Accordingly, it is possible to simplify the signal processing in the transmitting apparatus and the receiving apparatus that are connected via the connectors.

In addition, the connectors according to the first embodiment and the second embodiment of the present disclosure can be suitably applied to various kinds of applications with regard to communication between apparatuses that use the HDMI interfaces.

Although preferred embodiments of the present disclosure have been described in detail above with reference to the appended drawings, the technical scope of the embodiments of the present disclosure is not limited to the above example. It is obvious to those with a general knowledge of the technical field of the embodiments of the present disclosure that various modifications and alterations may occur within the technical scope defined in the claims, and that these modifications and alterations are encompassed within the technical scope of the embodiments of the present disclosure.

For example, according to the embodiments described above, the Type C HDMI connector and the Type D HDMI connector have been explained as an example of connectors. However, the present technology is not limited thereto. For example, the connector according to the present embodiments may be another type of HDMI connector. In addition, the connector according to the present embodiments is not limited to the HDMI connector. For example, a connector based on standard other than the HDMI standard may be used.

Additionally, the present technology may also be configured as below.

(1)

A connector including:

a signal pin that stretches in a first direction and transmits a signal;

a substrate that has one surface on which the signal pin is formed; and an electric conductor layer that has ground potential, the electric conductor layer being formed on an opposite surface of the surface of the substrate on which the signal pin is formed.

(2)

The connector according to (1), including:

a plurality of the signal pins, wherein, among the plurality of signal pins, an interval between a pair of the signal pins that transmit a differential signal and adjacently extend is shorter than an interval from another signal pin adjacent to the pair of signal pins.

(3)

The connector according to (1) or (2), further including:

an outer shell that covers the signal pin and the substrate, the outer shell including an open surface open to an outside in the first direction, wherein the outer shell is formed of an electric conductor that has ground potential, and wherein the electric conductor layer is electrically connected to the outer shell.

(4)

The connector according to (3), wherein the electric conductor layer constitutes at least a part of the outer shell.

(5)

The connector according to any one of (1) to (4), wherein guard lines that have ground potential further extend at positions for sandwiching the signal pin on the substrate in a manner that the guard lines are substantially parallel to the signal pin.

(6)

The connector according to any one of (1) to (5), wherein the signal pin extends with a substantially equal wiring interval in a fitting part of the connector that fits another connector to be paired with the connector.

(7)

The connector according to any one of (1) to (6), including:

a plurality of the signal pins, wherein, among the plurality of signal pins, a cross-sectional area of a cross section of a power signal pin to which a power signal is applied is larger than a cross-sectional area of the signal pin other than the power signal pin, the cross section being substantially perpendicular to the first direction.

(8)

The connector according to (7), wherein the cross-sectional area of the power signal pin is larger than the cross-sectional area of the signal pin other than the power signal pin, in a region other than a fitting part of the connector that fits another connector to be paired with the connector.

(9)

The connector according to any one of (1) to (8), wherein a device that acts on transmission of a signal in the signal pin is mounted on the substrate.

(10)

The connector according to (9), wherein the device is an AC/DC conversion circuit that converts AC transmission into DC transmission of a signal to be transmitted by the signal pin.

(11)

The connector according to (9), wherein the device is a register that holds information on a characteristic of a signal to be transmitted by the signal pin, and a communication circuit that notifies any apparatus connected via the connector of the information held by the register.

(12)

The connector according to (9), wherein the device is a battery that supplies at least any of the signal pins with power-supply voltage.

(13)

A data transmitting apparatus including:

a connector including a signal pin that stretches in a first direction and transmits a signal, a substrate that is formed of a dielectric and has a surface on which the signal pin is formed, and an electric conductor layer that has ground potential, the electric conductor layer being formed on an opposite surface of the surface of the substrate on which the signal pin is formed, wherein a signal is transmitted to any apparatus via the connector.

(14)

A data receiving apparatus including:

a connector including a signal pin that stretches in a first direction and transmits a signal, a substrate that is formed of a dielectric and has a surface on which the signal pin is formed, and an electric conductor layer that has ground potential, the electric conductor layer being formed on an opposite surface of the surface of the substrate on which the signal pin is formed, wherein a signal transmitted from any apparatus is received via the connector.

(15)

A data transmitting and receiving system including:

a data transmitting apparatus that transmits a signal to any device via a connector including a signal pin that stretches in a first direction and transmits a signal, a substrate that is formed of a dielectric and has a surface on which the signal pin is formed, and an electric conductor layer that has ground potential, the electric conductor layer being formed on an opposite surface of the surface of the substrate on which the signal pin is formed; and a data receiving apparatus that receives a signal transmitted from any apparatus via the connector.

REFERENCE SIGNS LIST

10, 20, 30, 40 connector
110, 210, 310, 410 signal pin
120, 220, 320, 420 dielectric
130, 230, 330, 430 substrate
140, 240, 340, 440 outer shell (shell)
150, 250 guard line
160 device

The invention claimed is:

1. A first connector, comprising:

a plurality of signal pins, wherein each signal pin of the plurality of signal pins extends in a first direction, wherein the plurality of signal pins comprise a pair of adjacent signal pins and a first signal pin, wherein the pair of adjacent signal pins transmit a differential signal to a second connector, wherein the first signal pin is adjacent to the pair of adjacent signal pins, wherein the first signal pin transmits a data signal to the second connector, and wherein a first distance between the pair of adjacent signal pins is shorter than a second distance between the first signal pin and the pair of adjacent signal pins;

a substrate, wherein the plurality of signal pins are on a first surface of the substrate;

an electric conductor layer, wherein the electric conductor layer is connected to a ground potential, wherein the electric conductor layer is on a second surface of the substrate, and wherein the second surface is opposite to the first surface;

a dielectric region, wherein the dielectric region is on the plurality of signal pins, and wherein a portion of the plurality of signal pins is in the dielectric region; and an outer shell, wherein the outer shell covers the plurality of signal pins, the substrate and the dielectric region, wherein the outer shell is connected to the ground potential, and wherein the first connector is connectable with the second connector.

2. The first connector according to claim 1, wherein the outer shell includes an open surface uncovered in the first direction, and wherein the electric conductor layer is electrically connected to the outer shell.

3. The first connector according to claim 2, wherein an end of at least one signal pin of the plurality of signal pins protrudes from the dielectric region towards the open surface of the outer shell.

4. The first connector according to claim 1, wherein the electric conductor layer is a part of the outer shell.

5. The first connector according to claim 1, further comprising guard lines, wherein the guard lines are connected to the ground potential, wherein the guard lines extend at least on one surface of a second signal pin of the plurality of signal pins, and wherein the guard lines are parallel to the second signal pin.

6. The first connector according to claim 1, wherein the plurality of signal pins extend with an equal wiring interval in a fitting part, and wherein the fitting part corresponds to a first region where the first connector fits the second connector.

7. The first connector according to claim 1, wherein the plurality of signal pins comprise at least a power signal pin, wherein a power signal is applied to the power signal pin, and wherein a first cross-sectional area of the power signal pin is larger than a second cross-sectional area of a second signal pin of the plurality of signal pins, and at least one of the first cross-sectional area or the second cross-sectional area corresponds to a direction perpendicular to the first direction.

8. The first connector according to claim 7, wherein the first cross-sectional area of the power signal pin is larger than the second cross-sectional area of the second signal pin in a second region different from a fitting part, and wherein the fitting part corresponds to a first region where the first connector fits the second connector.

9. The first connector according to claim 1, further comprising a device, wherein the device is configured to at least control or modify the transmission of the data signal, and wherein the device is mounted on the substrate.

10. The first connector according to claim 9, wherein the device comprises an AC/DC conversion circuit, and wherein the AC/DC conversion circuit is configured to convert AC transmission into DC transmission of the data signal.

11. The first connector according to claim 9, wherein the device comprises a register, wherein the register is configured to hold information on a characteristic of the data signal, wherein the device further comprises a communication circuit, and wherein the communication circuit is configured to notify the information to an apparatus connected via the first connector.

12. The first connector according to claim 9, wherein the device comprises a battery, and wherein the battery is configured to supply a power-supply voltage to a power signal pin of the plurality of signal pins.

13. The first connector according to claim 1, wherein the electric conductor layer is electrically connected to the outer shell.

14. The first connector according to claim 1, wherein a first surface of the outer shell faces the second surface of the substrate, wherein the first surface of the outer shell is in contact with the second surface of the substrate, and wherein the first surface of the outer shell is thicker than a second surface of the outer shell which faces the dielectric region.

15. The first connector according to claim 1, wherein each signal pin of the plurality of signal pins is allocated to a different type of signal.

16. A data transmitting apparatus, comprising:

a connector that includes:

a plurality of signal pins, wherein each signal pin of the plurality of signal pins extends in a first direction, wherein the plurality of signal pins comprise a pair of adjacent signal pins and a first signal pin, wherein the pair of adjacent signal pins transmit a differential signal to a data receiving apparatus, wherein the first signal pin is adjacent to the pair of adjacent signal pins, wherein the first signal pin transmits a data signal to the data receiving apparatus, and wherein a first distance between the pair of adjacent signal pins is shorter than a second distance between the first signal pin and the pair of adjacent signal pins;

a substrate, wherein the plurality of signal pins are on a first surface of the substrate;

an electric conductor layer, wherein the electric conductor layer is connected to a ground potential, wherein the electric conductor layer is on a second surface of the substrate, and wherein the second surface is opposite to the first surface;

a dielectric region, wherein the dielectric region is on the plurality of signal pins, and wherein a portion of the plurality of signal pins in the dielectric region; and an outer shell, wherein the outer shell covers the plurality of signal pins, the substrate and the dielectric region, wherein the outer shell is connected to the ground potential, and wherein the data signal is transmitted to the data receiving apparatus via the connector.

17. A data receiving apparatus, comprising:

a connector that includes:

a plurality of signal pins, wherein each signal pin of the plurality of signal pins extends in a first direction, wherein the plurality of signal pins comprise a pair of adjacent signal pins and a first signal pin, wherein the pair of adjacent signal pins receives a differential signal from a data transmitting apparatus, wherein the first signal pin is adjacent to the pair of adjacent signal pins, wherein the first signal pin to receives a data signal from the data transmitting apparatus, and wherein a first distance between the pair of adjacent signal pins is shorter than a second distance between the first signal pin and the pair of adjacent signal pins;

a substrate, wherein the plurality of signal pins are on a first surface of the substrate;

an electric conductor layer, wherein the electric conductor layer is connected to a ground potential, wherein the electric conductor layer is on a second surface of the substrate, and wherein the second surface is opposite to the first surface;

a dielectric region, wherein the dielectric region is on the plurality of signal pins, and wherein a portion of the plurality of signal pins is in the dielectric region; and an outer shell, wherein the outer shell covers the plurality of signal pins, the substrate and the dielectric region, wherein the outer shell is connected to the ground potential, and wherein the data signal transmitted from the data transmitting apparatus is received via the connector.

18. A data transmitting and receiving system, comprising:

a data transmitting apparatus configured to transmit a data signal via a connector, wherein the connector includes:

a plurality of signal pins, wherein each signal pin of the plurality of signal pins extends in a first direction, wherein the plurality of signal pins comprise a pair of adjacent signal pins and a first signal pin, wherein the pair of adjacent signal pins transmit a differential signal to a data receiving apparatus, wherein the first signal pin is adjacent to the pair of adjacent signal pins, wherein the first signal pin transmits the data signal to the data receiving apparatus, and wherein a first distance between the pair of adjacent signal pins is shorter than a second distance between the first signal pin and the pair of adjacent signal pins;

a substrate, wherein the plurality of signal pins are on a first surface of the substrate;

an electric conductor layer, wherein the electric conductor layer is connected to a ground potential, wherein the electric conductor layer is on a second surface of the substrate, and wherein the second surface is opposite to the first surface;

a dielectric region, wherein the dielectric region is on the plurality of signal pins, and wherein a portion of the plurality of signal pins in the dielectric region; and an outer shell, wherein the outer shell covers the plurality of signal pins, the substrate and the dielectric region, and wherein the outer shell is connected to the ground potential, and the data receiving apparatus configured to receive the data signal transmitted from the data transmitting apparatus.

* * * * *